US007693468B2

(12) United States Patent
Ehara et al.

(10) Patent No.: US 7,693,468 B2
(45) Date of Patent: Apr. 6, 2010

(54) IMAGE FORMING APPARATUS CAPABLE OF EFFECTIVELY FORMING A QUALITY COLOR IMAGE

(75) Inventors: Yasuhisa Ehara, Kanagawa-ken (JP); Kazuhiko Kobayashi, Tokyo (JP); Joh Ebara, Kanagawa-ken (JP); Kouji Amanai, Kanagawa-ken (JP); Seiichi Handa, Tokyo (JP); Yuji Matsuda, Tokyo (JP); Toshiyuki Uchida, Kanagawa-ken (JP); Noriaki Funamoto, Tokyo (JP); Keisuke Sugiyama, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 294 days.

(21) Appl. No.: 11/790,756

(22) Filed: Apr. 27, 2007

(65) Prior Publication Data

US 2007/0253736 A1 Nov. 1, 2007

(30) Foreign Application Priority Data

Apr. 28, 2006 (JP) ..... 2006-125189

(51) Int. Cl.
*G03G 15/01* (2006.01)

(52) U.S. Cl. ..... 399/301

(58) Field of Classification Search ..... 399/167, 399/299, 301, 302; 347/116
See application file for complete search history.

(56) References Cited

U.S. PATENT DOCUMENTS 5,995,802 A * 11/1999 Mori et al. ..... 399/167 X
6,049,690 A * 4/2000 Nakayasu et al. ..... 399/301
6,154,628 A * 11/2000 Kawano ..... 399/301
6,788,914 B1 * 9/2004 Wasai ..... 399/301
6,876,821 B2 * 4/2005 Ishii et al. ..... 399/299 X

FOREIGN PATENT DOCUMENTS

| | | |
|---|---|---|
| JP | 09-146329 | 6/1997 |
| JP | 10-020607 | 1/1998 |
| JP | 10-078734 | 3/1998 |
| JP | 2000-181171 | 6/2000 |
| JP | 2000-250284 | 9/2000 |
| JP | 2001-215771 | 8/2001 |
| JP | 2006-259468 | 9/2006 |

* cited by examiner

*Primary Examiner*—Sandra L Brase
(74) *Attorney, Agent, or Firm*—Harness, Dickey & Pierce, P.L.C.

(57) ABSTRACT

An image forming apparatus includes a plurality of image carriers, an optical writing unit, a plurality of developing units, a transfer member, a transfer unit, an image sensor, and a control unit. In at least one embodiment, the image sensor is configured to sense a positional displacement detection pattern including visible images on the transfer member to detect a positional displacement between the visible images on each of the plurality of image carriers. The control unit is configured to execute a positional displacement correction control to calculate an amount of the positional displacement and determine respective target drive speeds of the plurality of drive sources. The control unit is also configured to control so that the positional displacement detection pattern is formed when the plurality of drive sources are driven at substantially identical speeds and the positional displacement detection pattern thus formed is sensed by the image sensor.

12 Claims, 26 Drawing Sheets

IMAGE FORMING APPARATUS CAPABLE OF EFFECTIVELY FORMING A QUALITY COLOR IMAGE

PRIORITY STATEMENT

The present patent application claims priority under 35 U.S.C. §119 upon Japanese patent application, No. JP2006-125189 filed on Apr. 28, 2006, in the Japan Patent Office, the entire contents of which are hereby incorporated by reference herein.

BACKGROUND

Image forming apparatuses include copiers, printers, facsimiles, multi-function devices thereof, etc. Some image forming apparatuses include a plurality of photoreceptors serving as image carriers and a belt member serving as a transfer member. The belt member endlessly moves while passing through transfer points facing the plurality of photoreceptors.

Some image forming apparatuses employ an electrophotographic method to form toner images of different colors on respective surfaces of the plurality of photoreceptors. The toner images on the respective surfaces of the plurality of photoreceptors are superimposingly transferred to a recording medium, which is carried by the transfer member so as to sequentially pass through the transfer nips. Through the transfer process, superimposed color toner images are formed on the surface of the recording medium.

For such configuration, a temperature change in an optical system for optically scanning the photoreceptors may cause a change of a light path of the optical system. Further, once the photoreceptor is demounted from and mounted to the image forming apparatus, a poor fit may be caused between the photoreceptor and the image forming apparatus.

Thus, a relative positional displacement may be caused between toner images formed on the respective photoreceptors. Consequently, such a displacement may cause a superimposition displacement between toner images of different colors on the recording medium, thereby deteriorating image quality of the resultant superimposed color toner images.

Hence, a conventional image forming apparatus conducts a positional displacement correction control to calculate an appropriate linear velocity difference between the photoreceptors of different colors. The conventional image forming apparatus also sets the calculated linear velocity difference between the photoreceptors so as to suppress the superimposition displacement between toner images of different colors.

For the positional displacement correction control, the conventional image forming apparatus first forms reference toner images on each photoreceptor at a given timing. Then, the conventional image forming apparatus transfers the reference toner images to the surface of a belt member to form a positional displacement detection pattern.

Unless a relative positional displacement occurs between the reference toner images formed on each photoreceptor, the reference toner images are transferred at a certain distance along a moving direction of the belt member.

Then, the conventional image forming apparatus detects the reference toner images by a photosensor and calculates a relative positional displacement amount between the reference toner images on each photoreceptor based on detection time intervals thereof. Further, based on calculation results, the conventional image forming apparatus determines a drive speed of each photoreceptor so as to cancel the calculated relative positional displacement amount.

Further, on executing a print job, the conventional image forming apparatus drives the respective photoreceptors at the drive speeds thus determined. Thereby, the conventional image forming apparatus drives the photoreceptors with the linear velocity difference being set therebetween.

Thus, the conventional image forming apparatus attempts to superimposingly transfer toner images of different colors from the photoreceptors to the recording medium while suppressing the relative positional displacement.

Furthermore, for the positional displacement correction control, the conventional image forming apparatus first roughly corrects a positional displacement between toner images of different colors in a sub-scanning direction, i.e. a moving direction of the photoreceptor surface by correcting a start timing of optical writing for each photoreceptor. Then, the conventional image forming apparatus calculates an appropriate correction amount of the drive speed of each photoreceptor to accurately correct the positional displacement.

Specifically, according to an optical writing manner, a main scanning operation is conducted by deflecting respective light beams by a single polygon mirror to write latent images on the plurality of photoreceptors. The conventional image forming apparatus adjusts the start timing of optical writing for each photoreceptor in unit of time for writing one scan line. In such case, even when the start timing of optical writing is adjusted, a positional displacement of less than half a dot may still remain in the sub-scanning direction.

Suppose that, if a positional displacement of substantially a ¾ dot in the sub-scanning direction occurs between two photoreceptors, a start timing of optical writing to any one of the photoreceptors is shifted before or after by the writing time for one scan line. Then, the positional displacement amount in the sub-scanning direction can be reduced to substantially a ¼ dot.

However, if the start timing of optical writing is further shifted before or after by the writing time for one scan line, the positional displacement amount in the sub-scanning direction may be increased to substantially a ⁵⁄₄ dot, which is larger than the original displacement amount of a ¾ dot.

Then, if the start timing of optical writing is furthermore shifted before or after by the writing time for one scan line, the positional displacement amount of substantially a ¼ dot remains again.

Hence, the conventional image forming apparatus attempts to reduce the remaining positional displacement amount of substantially a ¼ dot by setting a linear velocity difference between the photoreceptors.

However, the positional displacement between toner images of different colors may be caused by a change in light path or a poor fit between the image forming apparatus and each photoreceptor as described above. Further, the positional displacement may be caused by an eccentricity of a drive-force transmission rotation member, such as a photoreceptor gear or a coupling, which transmits a drive force to the photoreceptor while coaxially rotating therewith.

If such an eccentricity occurs in the drive-force transmission member that coaxially rotates with the photoreceptor, the eccentricity may generate first and second points on the photoreceptor surface that move from the optical writing position to the transfer position at relatively higher and lower speeds, respectively, than any other point thereof. At this time, the first and second points occur in substantially 180 degrees opposite to each other on the photoreceptor.

Thus, a first dot on the first point reaches a transfer nip at an earlier timing than a normal timing, while a second dot on the second point at a later timing. If the first dot of a first photoreceptor is transferred on a recording medium and then the second dot of a second photoreceptor is superimposed onto the first dot, a superimposition displacement may occur between the first and second dots.

Hence, in order to suppress a superimposition displacement as described above, another conventional image forming apparatus conducts a speed variation detection control to detect rotation speed variations of the plurality of photoreceptors and a phase adjustment control to adjust phases of the rotation speed variations.

For the speed variation detection control, the conventional image forming apparatus forms a plurality of toner images at a certain distance along the moving direction of the surface of photoreceptor to form a speed variation detection pattern. After transferring the speed variation detection pattern to a belt member, the conventional image forming apparatus detects the toner images of the speed variation detection pattern by a photosensor, and then determines a speed variation during rotation of each photoreceptor based on detection time intervals.

On the other hand, the conventional image forming apparatus detects a mark, which is provided on a photoreceptor gear, etc., by another photosensor, and thus determines a timing at which each photoreceptor reaches a given rotational angle.

Thus, a time difference can be obtained between the timing at which each photoreceptor reaches a given rotational angle and the timing at which the surface speed of each photoreceptor reaches a maximum or a minimum value. After the speed variation detection control is finished, the conventional image forming apparatus conducts the phase adjustment control before executing a print job, and thus adjusts phase differences in speed variations between the photoreceptors.

Specifically, first, as described above, the conventional image forming apparatus determines a timing at which each photoreceptor reaches a given rotational angle. Based on the timing and the time difference previously calculated in the speed variation detection control, the conventional image forming apparatus temporarily changes drive speeds of a plurality of drive motors that separately drive the photoreceptors. Thus, the conventional image forming apparatus attempts to adjust a phase difference in speed variations between the photoreceptors.

Alternatively, after finishing a print job, the conventional image forming apparatus stops the drive motors so that the phase difference in speed variations is appropriately adjusted between the photoreceptors. Then, the conventional image forming apparatus starts another print job with the phase difference being appropriately adjusted.

Thus, the conventional image forming apparatus performs the phase adjustment control so that a plurality of dots reaching a transfer position at an earlier timing than a normal timing or a plurality of dots reaching at a later timing is synchronized with each other. Thereby, the conventional image forming apparatus attempts to suppress a superimposition displacement between toner images of different colors.

When a distance between each adjacent pair of a plurality of photoreceptors is set to an integral multiple of a circumference of each photoreceptor, each photoreceptor rotates the integral multiple number of times while a recording sheet is conveyed from a transfer nip to an adjacent transfer nip. Thus, dots that are in an appropriate relationship to each other may be synchronized with each other by adjusting a phase difference in speed variations between the photoreceptors to zero.

On the other hand, a distance between each adjacent pair of the plurality of photoreceptors may be different from an integral multiple of a circumference of each photoreceptor. In such a configuration, dots that are in an appropriate relationship to each other may be synchronized with each other by setting a given time for each photoreceptor corresponding to a phase difference in speed variation.

However, even if the positional displacement correction control or the phase adjustment control as described above is conducted, a positional displacement may still occur between toner images of different colors. Then, the inventors have conducted various experiments and analyses to find a possible cause of the positional displacement.

According to the results of experiments and analyses, setting a linear velocity difference between photoreceptors may result in another linear velocity difference between the belt member and the photoreceptors. When the positional displacement detection pattern or the speed variation detection pattern including reference toner images is formed under such condition, unevenness in density may be caused between the toner images of different colors.

Suppose that, when a first photoreceptor drives at a higher linear velocity than a belt member, a toner image is transferred from the first photoreceptor to the belt member. Then, the toner image has a relatively higher density on the upstream side than on the downstream side in the moving direction of the belt member.

On the other hand, suppose that, when a second photoreceptor drives at a lower linear velocity than the belt member, a toner image is transferred from the second photoreceptor to the belt member. Then, the toner image has a relatively higher density on the downstream side than on the upstream side in the moving direction of the belt member.

Thus, when the positional displacement correction control is conducted with such a linear velocity difference being set between the photoreceptors, unevenness in density may be caused between the toner images of different colors. Such unevenness in density may deteriorate accuracy in the position detection of toner images, the positional displacement correction, or the phase adjustment.

Hence, a need exists for an image forming apparatus capable of effectively suppressing deterioration in accuracy of the positional displacement correction, the phase adjustment, etc, which may be caused by forming the positional displacement detection pattern or the speed variation detection pattern with a linear velocity difference being set between a plurality of photoreceptors.

SUMMARY

At least one embodiment of the present specification provides an image forming apparatus including a plurality of image carriers, a plurality of drive sources, an optical writing unit, a plurality of developing units, a transfer member, a transfer unit, an image sensor, and a control unit. The plurality of image carriers are configured to carry respective latent images. The plurality of drive sources are configured to separately drive the plurality of image carriers. The optical writing unit is configured to write the respective latent images on the plurality of image carriers. The plurality of developing units are configured to separately develop the respective latent images written on the plurality of image carriers to form respective visible images. The transfer member has a surface configured to endlessly move and includes an intermediate transfer member and a recording medium. The transfer unit is configured to transfer the respective visible images formed on the plurality of image carriers to the transfer member. The image sensor is configured to sense a positional displacement detection pattern including the visible images on the transfer member to detect a positional displacement between the visible images on each of the plurality of image carriers, and output a detection result of the positional displacement. The control unit is configured to execute a positional displacement correction control to calculate an amount of the positional displacement based on the detection result and to determine respective target drive speeds of the plurality of drive sources based on calculation results. The control unit also controls so that the positional displacement detection pattern is formed when the plurality of drive sources are driven at substantially identical speeds, and the positional displacement detection pattern thus formed is sensed by the image sensor.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
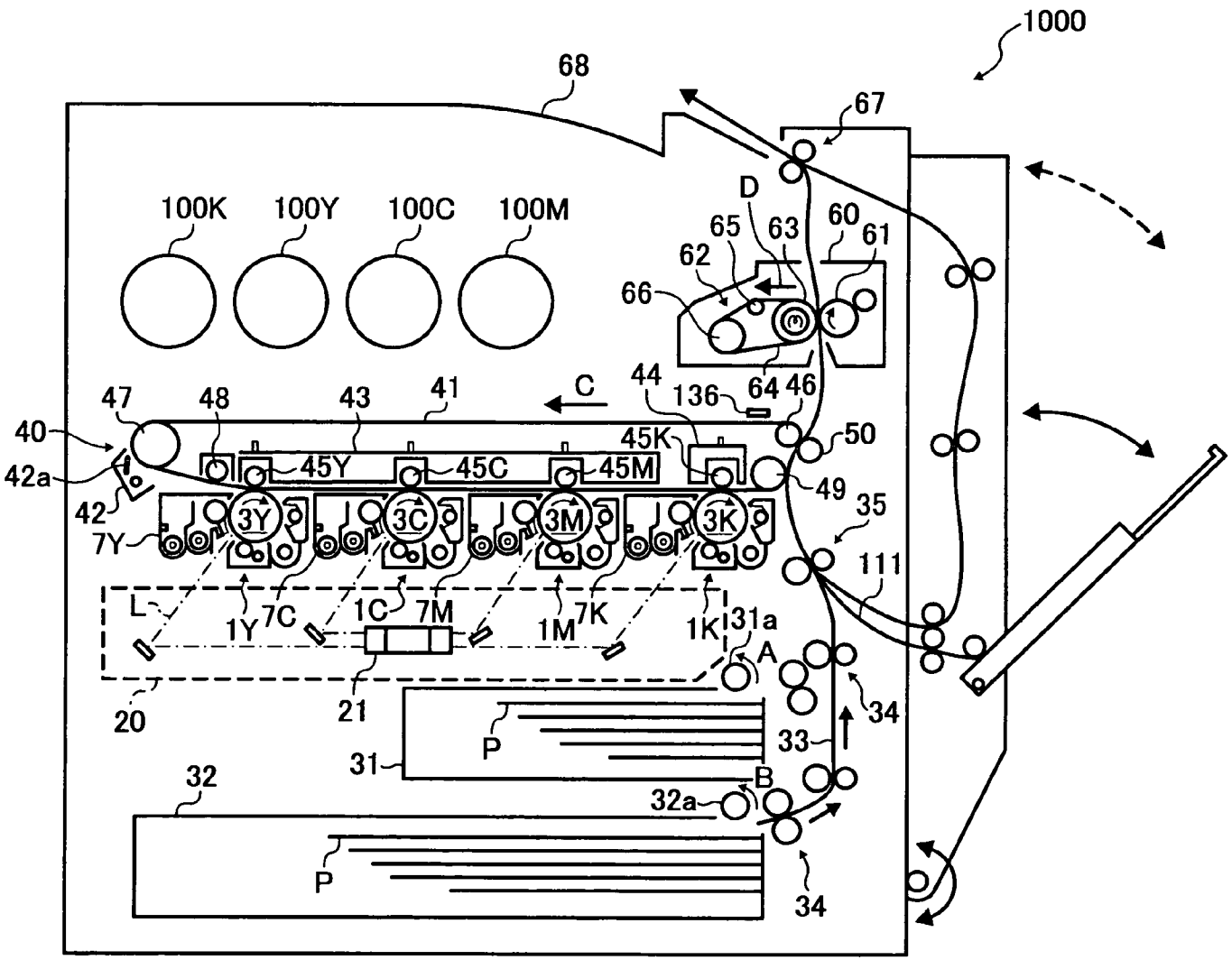
FIG. 1 is a schematic view illustrating a configuration of an image forming apparatus according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent invention are described.

FIG. 1 is a schematic view illustrating a configuration of an image forming apparatus 1000 according to an example embodiment of the present invention.

As illustrated in FIG. 1, the image forming apparatus 1000 includes process units 1Y, 1C, 1M, and 1K, an intermediate transfer belt 41, an optical writing unit 20, sheet feed cassettes 31 and 32, sheet feed rollers 31*a* and 32*a*, a sheet feed path 33, a plurality of conveyance roller pairs 34, a registration roller pair 35, a transfer unit 40, a fixing unit 60, an sheet output roller pair 67, a sheet output tray 68, and four toner cartridges 100Y, 100C, 100M, and 100K.

The process units 1Y, 1C, 1M, and 1K form toner images in yellow, cyan, magenta, and black, respectively. The process units 1Y, 1C, 1M, and 1K have substantially similar configurations and functions except for toner colors. Accordingly, the configuration of the process unit 1Y is described below as representative, and repeated descriptions for the other colors are omitted.

Figure 2:
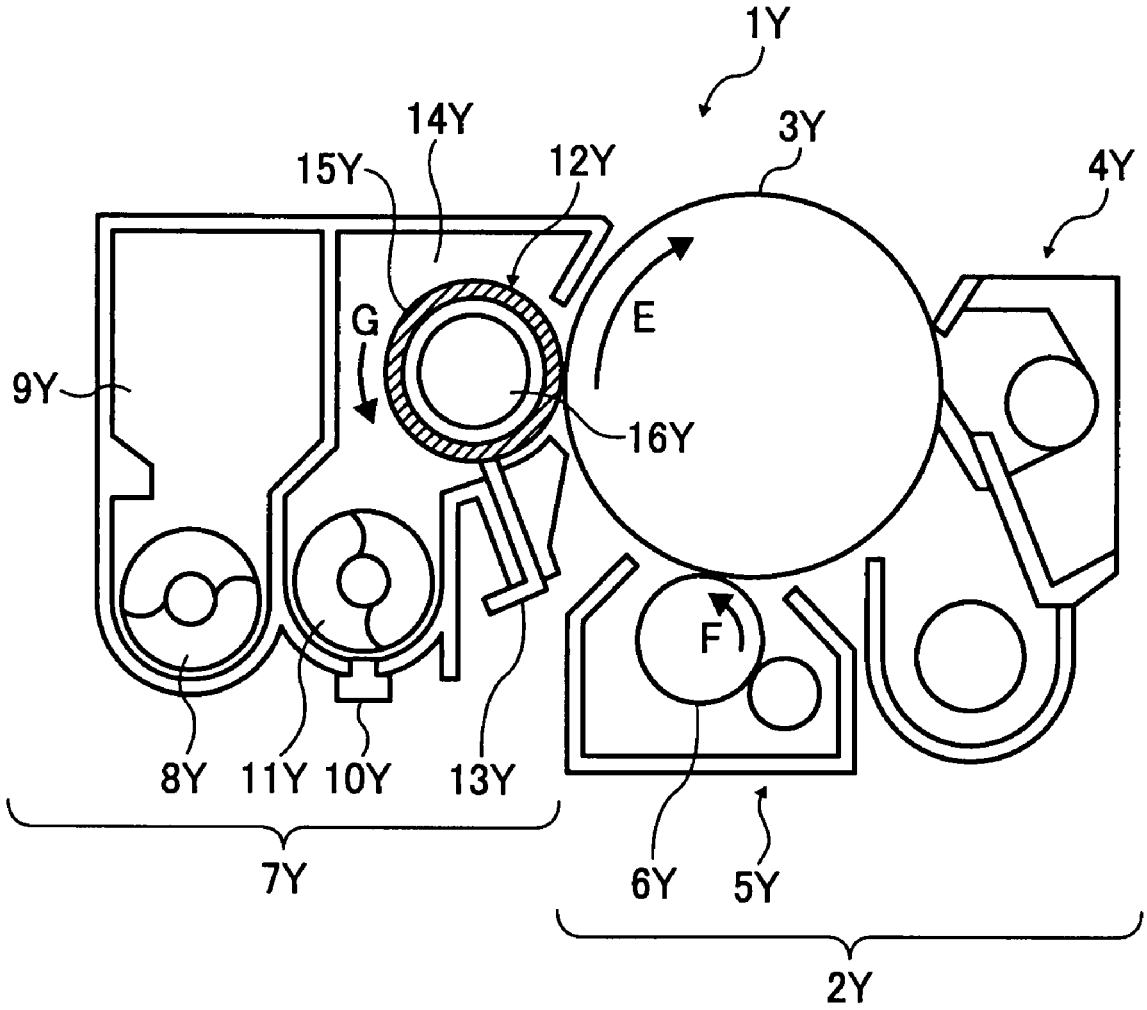
FIG. 2 is an enlarged view illustrating (according to an example embodiment of the present invention) a configuration of a process unit for yellow of the image forming apparatus.
Figure 3:
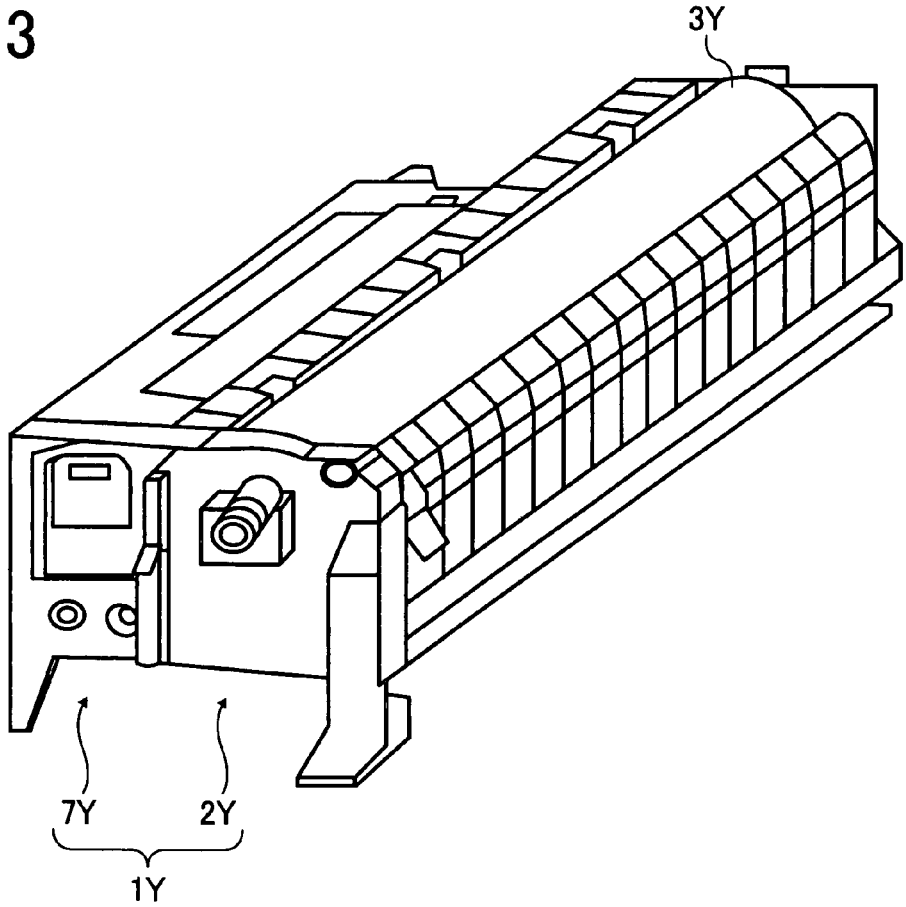
FIG. 3 is a perspective view illustrating the process unit illustrated in FIG. 2.
Figure 4:
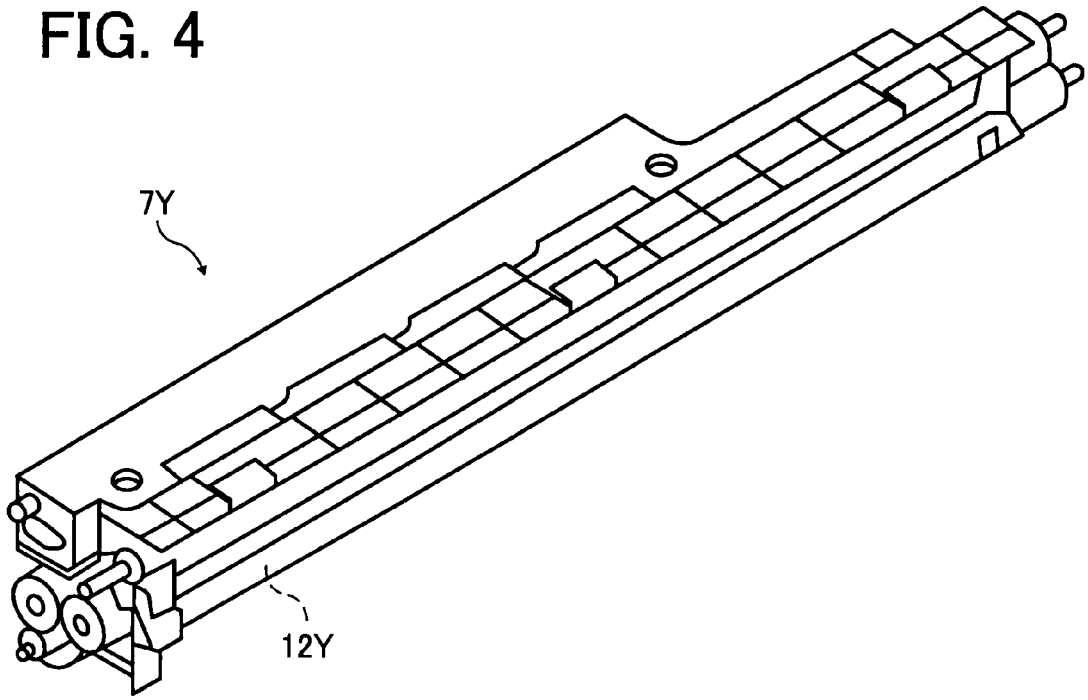
FIG. 4 is a perspective view illustrating (according to an example embodiment of the present invention) a development unit of the process unit illustrated in FIG. 2.

As illustrated in FIG. 2, the process unit 1Y includes a photoreceptor unit 2Y and a development unit 7Y. Further, as illustrated in FIG. 3, the photoreceptor unit 2Y and the development unit 7Y are integrally formed as the process unit 1Y so as to be dismountably mounted to the image forming apparatus 1000. On the other hand, when the process unit 1Y is dismounted from the image forming apparatus 1000, the development unit 7Y is mountable to and dismountable from the photoreceptor unit 2Y, which is not illustrated in FIG. 4.

As illustrated in FIG. 2, the photoreceptor unit 2Y includes a photoreceptor 3Y, a drum cleaner 4Y, a charger 5Y, a charge remover (not illustrated), etc.

The charger 5Y is rotationally driven by a drive device in a clockwise direction as indicated by the arrow E in FIG. 2. Thus, the charger 5Y uniformly charges the surface of the photoreceptor 3Y.

As illustrated in FIG. 2, the charger 5Y includes a charge roller 6Y. The charge roller 6Y is rotationally driven in a counterclockwise direction as indicated by the arrow F in FIG. 2 while a charge bias is applied thereto from a power supply. Further, the charge roller 6Y is located proximate to the photoreceptor 3Y. Thus, the charger 5Y uniformly charges the photoreceptor 3Y by the charge roller 6Y.

Alternatively, a charge brush or a scorotron charger may be employed in the charger 5Y to charge the photoreceptor 3Y. The surface of the photoreceptor 3Y, which is uniformly charged by the charger 5Y, is exposed and scanned by a light beam irradiated from the optical writing unit 20 so as to carry an electrostatic latent image for yellow color thereon.

The development unit 7Y includes developer chambers 9Y and 14Y. The developer chamber 9Y is provided with a conveyance screw 8Y. On the other hand, the developer chamber 14Y is provided with a toner density sensor 10Y, which is a magnetic permeability sensor, a conveyance screw 11Y, a developing roller 12Y, a blade 13Y, etc. The developer chambers 9Y and 14Y each accommodates yellow developer containing magnetic carrier and negative-charged yellow toner.

The conveyance screw 8Y is rotationally driven by a drive device. Thereby, the yellow developer accommodated in the developer chamber 9Y is conveyed to the developer chamber 14Y through a communicating hole (not illustrated) that is provided in a wall between the developer chambers 9Y and 14Y.

The conveyance screw 11Y in the developer chamber 14Y is rotationally driven by the drive device so as to convey the yellow developer. During the conveyance, the toner density sensor 10Y, which is fixed at the bottom of the developer chamber 14Y, detects the toner density of the yellow developer.

In FIG. 2, the developing roller 12Y is provided in parallel to the conveyance screw 11Y. The developing roller 12Y includes a development sleeve 15Y and a magnet roller 16Y. The development sleeve 15Y is formed with a non-magnetic pipe, and is rotationally driven in a counterclockwise direction as indicated by the arrow G in FIG. 2.

The magnet roller 16Y is provided in the inner side of the development sleeve 15Y. The yellow developer that is conveyed with the conveyance screw 11Y is partially attracted to the surface of the development sleeve 15Y by the magnetic force of the magnetic roller 16Y.

The blade 13Y is located at a distance away from the development sleeve 15Y. Thus, the blade 13 controls the thickness of magnetically attracted yellow developer on the surface of the development sleeve 15Y. The yellow developer thus attracted is conveyed to a development zone facing the photoreceptor 3Y. Then, the yellow toner included in the yellow developer is attracted to the electrostatic latent image for yellow color formed on the photoreceptor 3Y. Thus, a yellow toner image is formed on the photoreceptor 3Y.

The yellow developer that has consumed yellow toner in the above development process is conveyed back to the conveyance screw 11Y by the rotation of the development sleeve 15Y in the developing roller 12Y. Further, the yellow developer is conveyed back to the developer chamber 9Y through the communicating hole.

Detection results of the magnetic permeability of the yellow developer by the toner density sensor 10Y is sent to a control unit as a voltage signal. The magnetic permeability of the yellow developer has a certain correlation with the yellow toner density thereof. Therefore, the toner density sensor 10Y can output a voltage signal corresponding to the yellow toner density.

The control unit includes a RAM (random access memory). The RAM stores a yellow Vtref representing a target value of the voltage signal output from the toner density sensor 10Y. The RAM also stores data such as a cyan Vtref, a magenta Vtref, and a black Vtref representing target values of the voltage signals output from the toner density sensor 10C, 10M, and 10K.

For the development unit 7Y, the control unit compares a value of the voltage signal output from the toner density sensor 10Y to the yellow Vtref. The drive time of a toner supply device is determined based on a comparison result. Thus, an appropriate amount of yellow toner can be supplied to the yellow developer that has been subjected to the reduction of toner density in the above development process.

Thus, the yellow toner density of the yellow developer in the developer chamber 14Y is maintained within a given density range. A substantially identical toner supply control is conducted for developers for cyan, magenta, and black, which are accommodated in the process units 1C, 1M, and 1K, respectively.

The yellow toner image formed on the photoreceptor 3Y is first transferred on the intermediate transfer belt 41. The drum cleaner 4Y in the photoreceptor unit 2Y cleans excess toner remaining on the surface of the photoreceptor 3Y after the above intermediate transfer process.

Then, the charge remover removes charges remaining on the surface of the photoreceptor 3Y. Thus, the surface of the photoreceptor 3Y is reset for another image forming operation.

Similarly, in the process units 1C, 1M, and 1K as illustrated in FIG. 1, toner images of cyan, magenta, and black are formed on the photoreceptors 3C, 3M, and 3K, and are superimposingly transferred on the intermediate transfer belt 41.

The optical writing unit 20 is located below the process units 1Y, 1C, 1M, and 1K as illustrated in FIG. 1. The optical writing unit 20 irradiates a light beam L to the photoreceptors 3Y, 3C, 3M, and 3K, corresponding to image data. Thus, electrostatic latent images for yellow, cyan, magenta, and black are formed on the photoreceptors 3Y, 3C, 3M, and 3K, respectively.

The optical writing unit 20 irradiates the light beam L to the photoreceptor 3Y, 3C, 3M, and 3K via a plurality of optical lenses or mirrors. At this time, the light beam L is irradiated from a light source and is deflected by a polygon mirror 21. Alternatively, instead of the above configuration, an LED array may be employed for optical scanning.

The sheet feed cassettes 31 and 32 are provided in a two-tier fashion. The sheet feed cassettes 31 and 32 each accommodates a stack of recording sheets P. The sheet feed rollers 31*a* and 32*a* each is pressingly in contact with the uppermost recording sheets P in the sheet feed cassettes 31 and 32, respectively.

The sheet feed roller 31*a* is rotationally driven by a drive device in a counterclockwise direction as indicated by the arrow A in FIG. 1. Thereby, the uppermost recording sheet P in the sheet feed cassette 31 is fed to the sheet feed path 33 that is provided vertically extending in the right side of the sheet feed cassette in FIG. 1.

The sheet feed roller 32*a* is rotationally driven by a drive device in a counterclockwise direction as indicated by the arrow B in FIG. 1. Thereby, the uppermost recording sheet P in the sheet feed cassette 32 is fed to the sheet feed path 33.

The plurality of conveyance roller pairs 34 are provided along the sheet feed path 33. After being sent into the sheet feed path 33, the recording sheet P is conveyed from the lower portion to the upper portion thereof in FIG. 1 while passing through respective nips of the plurality of conveyance roller pairs 34.

The registration roller pair 35 is provided at the upper end of the sheet feed path 33. When the recording sheet P is conveyed to the nip of the registration roller pair 35, the rotation of the registration roller pair 35 is temporarily stopped. Then, the registration roller pair 35 feeds the recording sheet P at an appropriate timing out to a secondary transfer nip, which is later described in detail.

The transfer unit 40 is provided above the process units 1Y, 1C, 1M, and 1K. The transfer unit 40 includes the intermediate transfer belt 41 as an transfer member. In the transfer unit 40, the intermediate transfer belt 41 endlessly moves in a counterclockwise direction as indicated by the arrow C in FIG. 1.

The transfer unit 40 further includes a belt cleaner unit 42, brackets 43 and 44, primary transfer rollers 45Y, 45C, 45M, and 45K, a secondary transfer backup roller 46, a drive roller 47, an auxiliary roller 48, a tension roller 49, and a secondary transfer roller 50.

The intermediate transfer belt 41 is tightly extended by the primary transfer rollers 45Y, 45C, 45M, and 45K, the secondary transfer backup roller 46, the drive roller 47, an auxiliary roller 48, and the tension roller 49. Thus, the intermediate transfer belt 41 is endlessly moved in the counterclockwise direction by the rotational drive of the drive roller 47.

The primary transfer rollers 45Y, 45C, 45M, and 45K sandwiches the intermediate transfer belt 41 together with the photoreceptors 3Y, 3C, 3M, and 3K, respectively, so as to form primary transfer nips. Thus, a transfer bias of a polarity opposite to toner is applied to the inner surface of the intermediate transfer belt 41.

When the intermediate transfer belt 41 sequentially passes through the primary transfer nips for respective colors, the toner images of yellow, cyan, magenta, and black are superimposingly transferred from the photoreceptors 3Y, 3C, 3M, and 3K to the outer surface of the intermediate transfer belt 41. Thus, superimposed color toner images are formed on the intermediate transfer belt 41.

The secondary transfer backup roller 46 sandwiches the intermediate transfer belt 41 together with the secondary transfer roller 50 to form the secondary transfer nip. When the recording sheet P is conveyed to the registration roller pair 35, the registration roller pair 35 sends out to the secondary transfer nip in accordance with a timing at which the superimposed color toner image is conveyed thereto.

Then, the superimposed color toner image on the intermediate transfer belt 41 is collectively transferred onto the recording sheet P at the secondary transfer nip by action of nip pressure or secondary transfer electric field. The secondary transfer electric field is formed between the secondary transfer roller 50 and the secondary transfer backup roller 46 by applying a transfer bias to the secondary transfer roller 50. Thus, a full-color toner image is formed on the recording sheet P.

After the intermediate transfer belt 41 passes through the secondary transfer nip, the belt cleaner unit 42 cleans excess toner remaining on the intermediate transfer belt 41. Specifically, the belt cleaner unit 42 presses a cleaning blade 42*a* against the outer surface of the intermediate transfer belt 41. The cleaning belt 42*a* scrapes the excess toner off the intermediate transfer belt 41.

The bracket 43 of the transfer unit 40 is provided so as to be pivotable within a given angle range around the rotation axis line of the auxiliary roller 48 in response to the on-and-off operation of the driving of a solenoid.

When the image forming apparatus 1000 according to the present example embodiment forms a monochromatic image, the bracket 43 is slightly rotated in the counterclockwise direction in FIG. 1 by the driving of the solenoid. The slight rotation causes the primary transfer rollers 45Y, 45C, and 45M to rotate in the counterclockwise direction in FIG. 1 around the rotation axis line of the auxiliary roller 48.

Thereby, the photoreceptors 3Y, 3C, and 3M are separated from the intermediate transfer belt 41. Then, only the process unit 1K is driven to form the monochromatic image. Thus, the image forming apparatus 1000 can suppress wear-and-tear of the process units 1Y, 1C, and 1M that may be caused by unnecessary driving thereof during an monochromatic image forming operation.

The fixing unit 60 is provided above the secondary transfer nip as illustrated in FIG. 1. The fixing unit 60 includes a press-and-heat roller 61 and a fixing belt unit 62. The press-and-heat roller 61 further includes a heat source such as a halogen lamp.

On the other hand, the fixing belt unit 62 includes a heat roller 63, a fixing belt 64, a tension roller 65, a drive roller 66, a temperature sensor (not illustrated), etc. The heat roller 63 also includes a heat source such as a halogen lamp.

The fixing belt 64 is formed in an endless shape, and is tightly looped over the heat roller 63, the tension roller 65, and the drive roller 66. Thus, the fixing belt 64 is endlessly moved in a counterclockwise direction as indicated by the arrow D in FIG. 1. During the endless movement, the fixing belt 64 is heated from the inner surface thereof by the heat roller 63.

The heat roller 63 is in contact with the fixing belt 64 at a point on the inner surface of the fixing belt 64. On the other hand, the press-and-heat roller 61 is in contact with the fixing belt 64 at a substantially identical point on the outer surface of the fixing belt 64. Thus, the press-and-heat roller 61 and the fixing belt 64 forms a fixing nip.

Outside the loop of the fixing belt 64, the temperature sensor is provided so as to face the outer surface of the fixing belt 64 with a certain gap. The temperature sensor detects the surface temperature of the fixing belt 64 immediately in front of the fixing nip. A detection result of the surface temperature is transmitted to a fixing power-supply circuit (not illustrated).

The fixing power-supply circuit controls the on-and-off operation for supplying the power to the heat source in the heat roller 63, the heat source in the press-and-heat roller 61, etc. Thus, the surface temperature of the fixing belt 64 can be maintained at a substantially constant temperature of 140 degrees centigrade.

As illustrated in FIG. 1, after passing through the secondary transfer nip, the recording sheet P is separated from the intermediate transfer belt 41, and is then sent into the fixing unit 60. While being conveyed from the lower portion through the fixing nip to the upper portion of the fixing unit 60, the recording sheet P is heated and pressed by the fixing belt 64. Thus, the full-color toner image is fixed on the recording sheet, P.

After the above fixing process, the recording sheet P is ejected to the outside of the image forming apparatus 1000 through a nip between the sheet ejection rollers 67. The sheet tray 68 is formed on the top of the image forming apparatus 1000 so as to stack the recording sheet P ejected through the nip between the sheet ejection rollers 67.

The toner cartridge 10Y, 100C, 100M, and 100K are provided above the transfer unit 40 so as to accommodate yellow, cyan, magenta, and black toners, respectively. The yellow, cyan, magenta, and black toners are appropriately supplied to the development units 7Y, 7C, 7M, and 7K, respectively. The toner cartridges 100Y, 100C, 100M, and 100K each is mountable to and dismountable from the image forming apparatus 1000 independently of the process units 1Y, 1C, 1M, and 1K.

Figure 5:
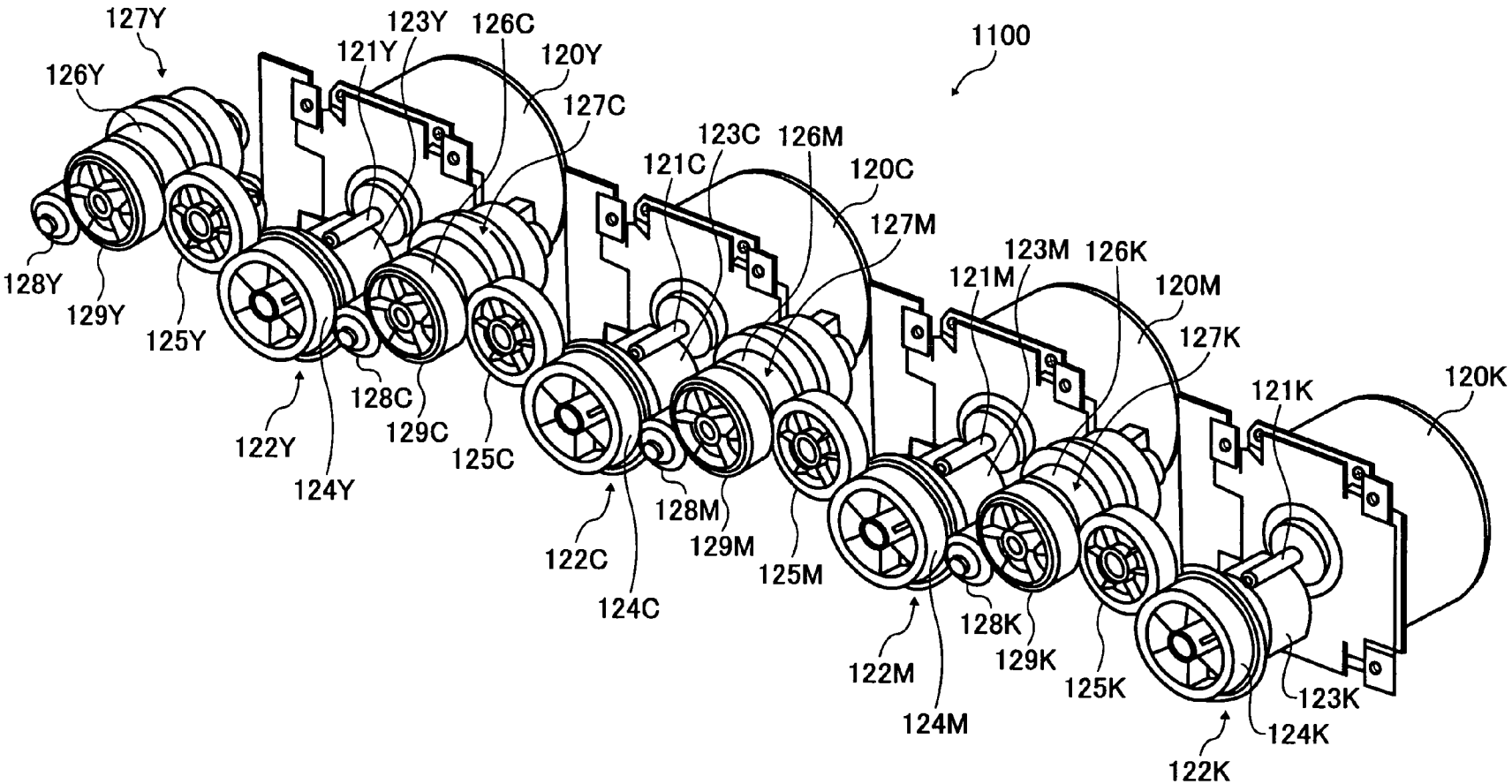
FIG. 5 is a perspective view illustrating (according to an example embodiment of the present invention) a drive-force transmission section that serves as a drive-force transmission system and is fixed in the image forming apparatus illustrated in FIG. 1.
Figure 6:
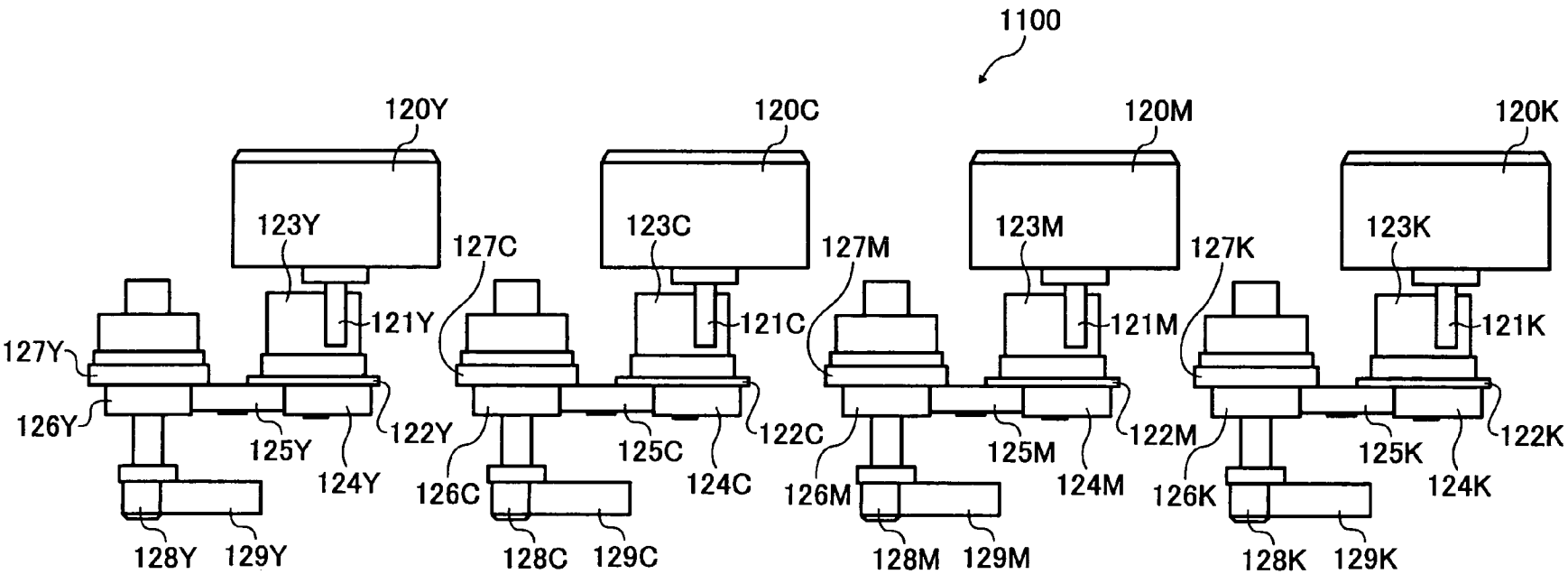
FIG. 6 is a plan view of the drive-force transmission section of FIG. 5 seen from above.

FIG. 5 is a perspective view illustrating a drive-force transmission section 1100 according to an example embodiment of the present invention. FIG. 6 is a plan view illustrating the drive-force transmission section 1100 of FIG. 5 seen from above.

The drive-force transmission section 1100 includes process drive motors 120Y, 120C, 120M, and 120K, drive gears 121Y, 121C, 121M, and 121K, development gears 122Y, 122C, 122M, and 122K, transmission gears 125Y, 125C, 125M, and 125K, clutch input gears 126Y, 126C, 126M, and 126K, development clutches 127Y, 127C, 127M, and 127K, clutch output gears 128Y, 128C, 128M, and 128K, and transmission gears 129Y, 129C, 129M, and 129K.

In FIGS. 5 and 6, the components denoted by the identical numbers have substantially similar configurations and operations. Therefore, only the components for yellow color are described below as representative, and repeated descriptions for the other colors are omitted unless otherwise needed.

The drive-force transmission section 1100 is fixedly provided in the image forming apparatus 1000, and serves as a drive-force transmission system. The process drive motor 120Y is fixedly mounted on the support plate that is vertically provided in the image forming apparatus 1000. The process drive motor 120Y has a rotation shaft on which a drive gear 121Y is mounted.

The development gear 122Y is provided at a lower position relative to the rotation axis of the process drive motor 120Y. The development gear 122Y is slidably and rotatably engaged with a fixed shaft (not illustrated) that is projectingly provided from the support plate.

The development gear 122Y includes gear portions 123Y and 124Y. The gear portion 123Y coaxially rotates with the gear portion 124Y. The gear portion 124Y is located proximate to the front end of the rotation shaft of the process drive motor 120Y compared to the gear portion 123Y.

The gear portion 123Y of the development gear 122Y is engaged with the drive gear 121Y of the process drive motor 120Y. Thus, the development gear 122Y is slidingly rotated around the fixed shaft by the rotation of the process drive motor 120Y.

The process drive motor 120Y is a DC servo motor, which is a type of DC brushless motor. For the process drive motor 120Y, the speed reduction ratio of the drive gear 121Y and the photoreceptor gear 133Y is set to, for example, 1:20. In this regard, the number of speed reduction steps from the drive gear 121Y to the photoreceptor gear 133Y is set to one step in order to reduce the component number and save the manufacturing cost. Such one-step speed reduction can reduce transmission error factors, such as engagement error or eccentricity, by restricting the gear number to two.

Further, when the speed reduction ratio is set to a relatively high ratio of 1:20 as described above, the one-step speed reduction causes the photoreceptor gear 133Y to have a relatively large diameter compared to the photoreceptor 3Y. The photoreceptor gear 133Y having such a large diameter can reduce a pitch error on the surface of the photoreceptor 3Y per pair of gear teeth. Thus, uneven print density such as banding may be suppressed in the sub-scanning direction.

An actual speed reduction ratio is determined based on a speed range in which excellent efficiencies and high rotation accuracies can be obtained with regard to the relationship between a target speed of the photoreceptor 3Y and a motor characteristic of the process drive motor 120Y.

The transmission gear 125Y is provided on the left side of the development gear 122Y in FIGS. 5 and 6. The transmission gear 125Y slidingly rotates while engaging with a fixed shaft (not illustrated). The transmission gear 125Y is engaged with the gear portion 124Y of the development gear 122Y so as to receive a rotational drive force from the development gear 122Y. Thus, the transmission gear 125Y is slidingly rotatable on the fixed shaft.

The transmission gear 125Y is engaged with the gear portion 124Y on the upstream side in the transmission direction of the drive force. On the other hand, the transmission gear 125Y is engaged with the clutch input gear 126Y on the downstream side in the transmission direction of the drive force.

The clutch input gear 126Y is supported on the development clutch 127Y. The development clutch 127Y receives the drive force of the clutch input gear 126Y via a clutch shaft of the development clutch 127Y. The development clutch 127Y also idles the clutch input gear 126Y in accordance with on-and-off states of the supply of power thereto alternated by a control unit.

The clutch output gear 128Y is fixed on the front end of the clutch shaft of the development clutch 127Y. When the supply of power to the development clutch 127Y is turned on, the rotational drive force of the clutch input gear 126Y is transmitted to the clutch shaft of the development clutch 127Y, thereby rotating the clutch output gear 128Y.

On the other hand, when the supply of power to the development clutch 127Y is turned off, the rotation of the clutch output gear 128Y is stopped. At this time, even if the process drive motor 120Y is continuously rotating, the clutch input gear 126Y is idled around the clutch shaft of the development clutch 127Y, thus stopping the rotation of the clutch output gear 128Y.

The transmission gear 129Y is provided so as to be slidingly rotatable while engaging with a fixed shaft (not illustrated). The transmission gear 129Y also rotates while engaging with the clutch output gear 128Y.

Thus, the image forming apparatus 1000 is provided with drive-force transmission systems corresponding to the process units 1Y, 1C, 1M, and 1K. In each drive-force transmission system, a drive force is transmitted in the following order: the process drive motor 120, the drive gear 121, the gear portion 123 of the development gear 122, the gear portion 124 of the development gear 122, the transmission gear 125, the clutch input gear 126, and the transmission gear 129.

Figure 7:
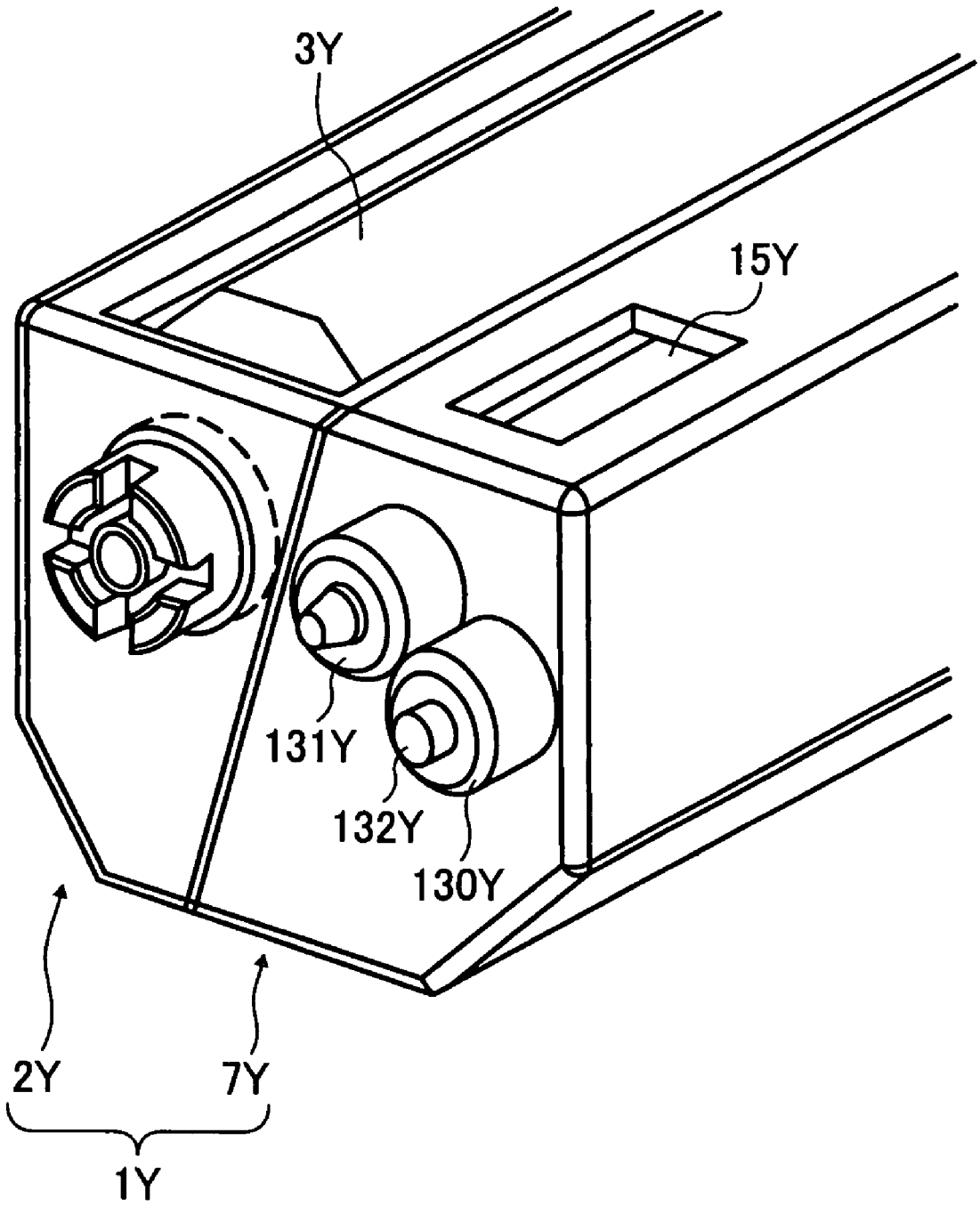
FIG. 7 is a partial perspective view illustrating (according to an example embodiment of the present invention) one end of a process unit for yellow.

FIG. 7 is a partial perspective view illustrating one end of the process unit 1Y according to an example embodiment of the present invention. The development sleeve 15Y is provided in a casing 80 of the development unit 7Y. The development sleeve 15Y has a development sleeve shaft that passes through and projects from a first sidewall 81 of the casing 80.

As illustrated in FIG. 7, a sleeve upstream gear 131Y is fixed on a first projected portion of the development sleeve shaft. Further, a fixed shaft 132Y is projectingly provided in the first sidewall 81 of the casing 80. A transmission gear 130Y is engaged with the fixed shaft 132Y so as to be slidingly rotatable thereon. The transmission gear 130Y is also engaged with the sleeve upstream gear 131Y.

when the process unit 1Y is mounted on the image forming apparatus 1000, the transmission gear 130Y is engaged with the transmission gear 129Y as illustrated in FIGS. 5 and 6, in addition to the sleeve upstream gear 131Y. Thus, the rotational drive force of the transmission gear 129Y is sequentially transmitted to the transmission gear 130Y and the sleeve upstream gear 131Y so as to rotationally drive the development sleeve 13Y.

In the above description, only the process unit 1Y is explained with reference to FIG. 7. Similarly, the rotational drive force is transmitted to the corresponding development sleeve in each of the process units 1C, 1M, and 1K.

Further, only the one end of the process unit 1Y is illustrated in FIG. 7. In the other end of the process unit 1Y, the development sleeve shaft of the development sleeve 15Y also passes through and projects outward from a second sideplate on the other end of the casing 80. A sleeve downstream gear is fixed on a projected portion of the development sleeve shaft.

Furthermore, the conveyance screw 8Y as illustrated in FIG. 2 has a screw shaft that passes through and projects outward from the second sidewall on the other end of the casing 80. A first screw gear (not illustrated) is fixed on one projected portion of the screw shaft. The conveyance screw 11Y as illustrated in FIG. 2 is substantially similar in configuration to the conveyance screw 8Y.

When the development sleeve 15Y is rotated by the drive force transmitted via the sleeve upstream gear 131Y, the sleeve downstream gear is rotated on the other end of the development sleeve shaft. Then, the conveyance screw 11Y is rotated by receiving the drive force via the screw gear engaging with the sleeve downstream gear. Subsequently, the conveyance screw 8Y is rotated by receiving the drive force via the first screw gear engaging with the second screw gear. The process unit 1C, 1M, and 1K are substantially similar in configuration to the process unit 1Y.

As described above, the image forming apparatus 1000 is provided with a set of development gears corresponding to the process unit 1Y. Similarly, the image forming apparatus 1000 is provided with another three sets of development gears corresponding to the process units 1C, 1M, and 1K. Specifically, each of the three sets includes the drive gear 121, the development gear 122, the transmission gear 125, the clutch input gear 126, the clutch output gear 128, the transmission gear 129, the transmission gear 130, the sleeve upstream gear 131, the sleeve downstream gear, and the two screw gears.

Figure 8:
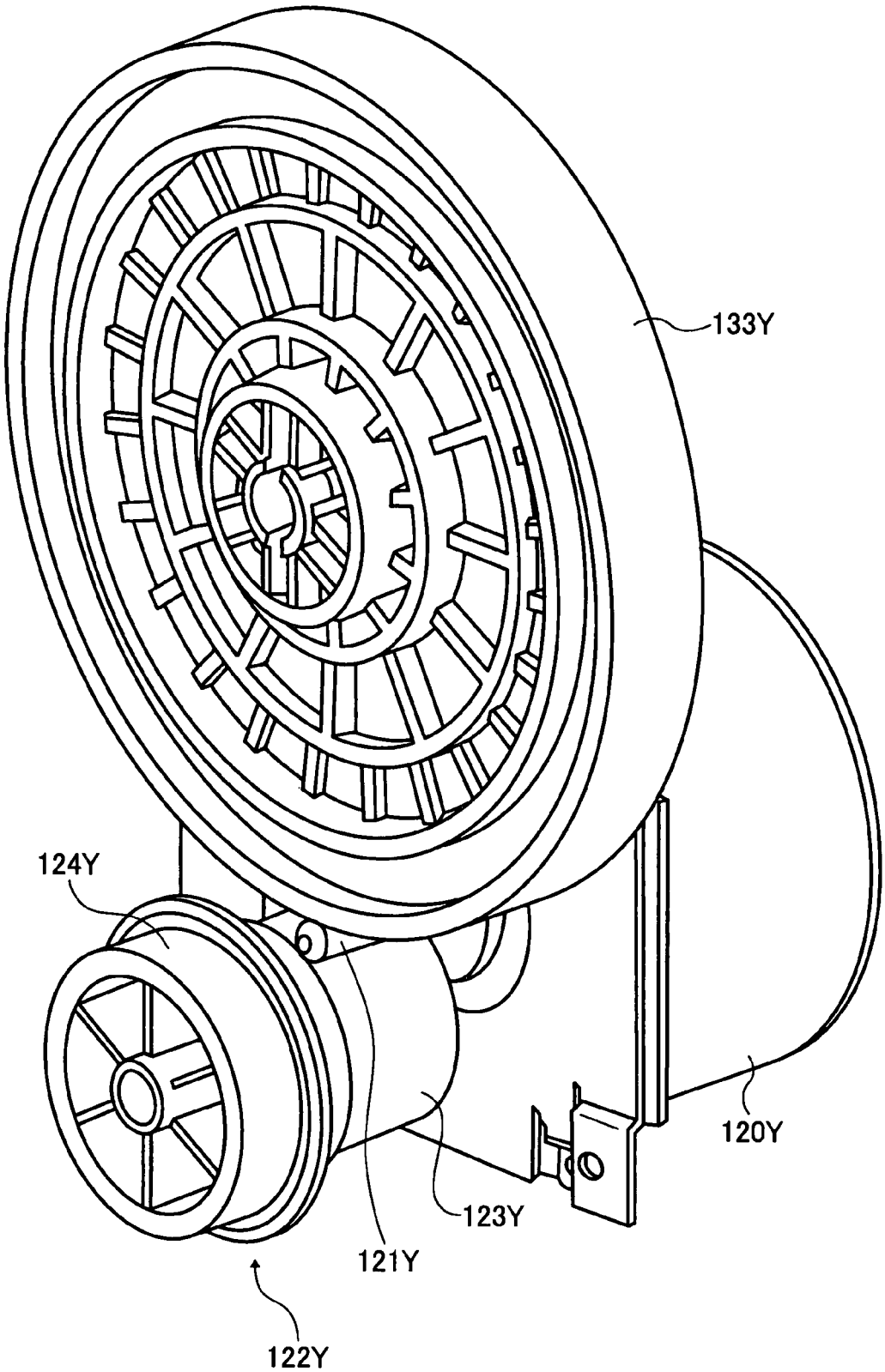
FIG. 8 is a perspective view illustrating (according to an example embodiment of the present invention) a photoreceptor gear of a photoreceptor for yellow and other components adjacent thereto in the image forming apparatus illustrated in FIG. 1.

FIG. 8 is a perspective view illustrating a photoreceptor gear 133Y and adjacent components thereof according to an example embodiment of the present invention. In FIG. 8, the drive gear 121Y is engaged with the gear portion 123Y of the development gear 122Y as described above. The drive gear 121Y is also engaged with the photoreceptor gear 133Y so as to serve as a gear for image carrier. The photoreceptor gear 133Y is also rotatably supported in the drive-force transmission section 1100 so as to serve as a drive-force transmission rotation member.

The photoreceptor gear 133Y has a relatively large diameter compared to the photoreceptor 3Y. When the process drive motor 120Y starts to rotate, the rotation drive force thereof is transmitted from the drive gear 121Y to the photoreceptor gear 133Y so as to rotate the photoreceptor 3Y. At this time, the rotation drive force thereof is transmitted in the one-step speed reduction manner as described above. The process units 1C, 1M, and 1K have substantially similar configurations to the process unit 1Y.

Thus, a gear set for image carrier includes the drive gear 121 and the photoreceptor gear 121. According to the present example embodiment, the image forming apparatus 1000 includes four gear sets for image carriers corresponding to the process units 1Y, 1C, 1M, and 1K.

The rotation shaft of the photoreceptor 3Y in the process unit 1Y is coupled with the photoreceptor gear 133Y via a coupling that is fixed on one end of the rotation shaft of the photoreceptor 3Y. The development gear 122Y may be driven by a motor different from the motor, such as the process drive motor 120Y, for the photoreceptor gear 133. The above configuration is applied to the components for the other colors.

Next, an example configuration of the image forming section according to the present example embodiment is described with reference to FIG. 9.

Figure 9:
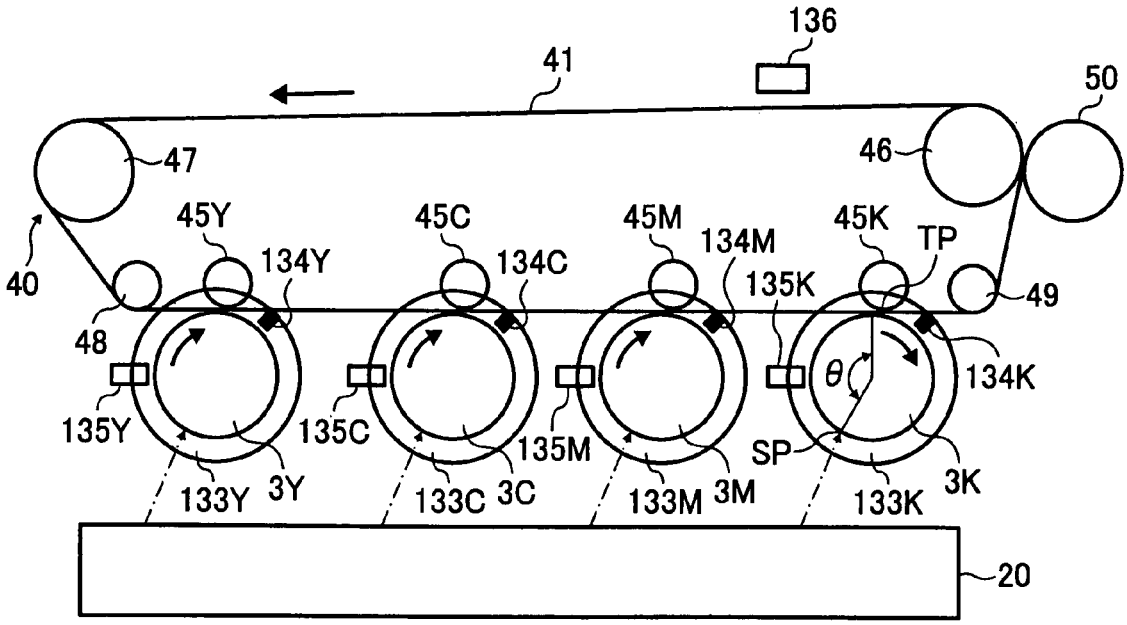
FIG. 9 is a side view illustrating (according to an example embodiment of the present invention) photoreceptors and transfer units for yellow, cyan, magenta, and black colors, and an optical writing unit in the image forming apparatus illustrated in FIG. 1.

FIG. 9 is a side view illustrating the four photoreceptors 3Y, 3C, 3M, and 3K, the transfer unit 40, and the optical writing unit 20. The photoreceptor gear 133Y for transmitting a rotation drive force to the photoreceptor 3Y is provided with a mark 134Y. The mark 134Y is detected by a position sensor 135Y such as a photosensor at a certain timing per rotation of the photoreceptor gear 133Y. Thus, a timing at which the photoreceptor 3Y reaches a certain rotational angle is detected per rotation thereof. The components for the other colors have substantially similar configurations to the above configuration of the components for yellow.

An optical sensor unit 136 is provided above the transfer unit 40. The optical sensor unit 136 includes two reflective photosensors (not illustrated), which are located at a certain distance in parallel with each other along the width direction of the intermediate transfer belt 41.

Figure 10:
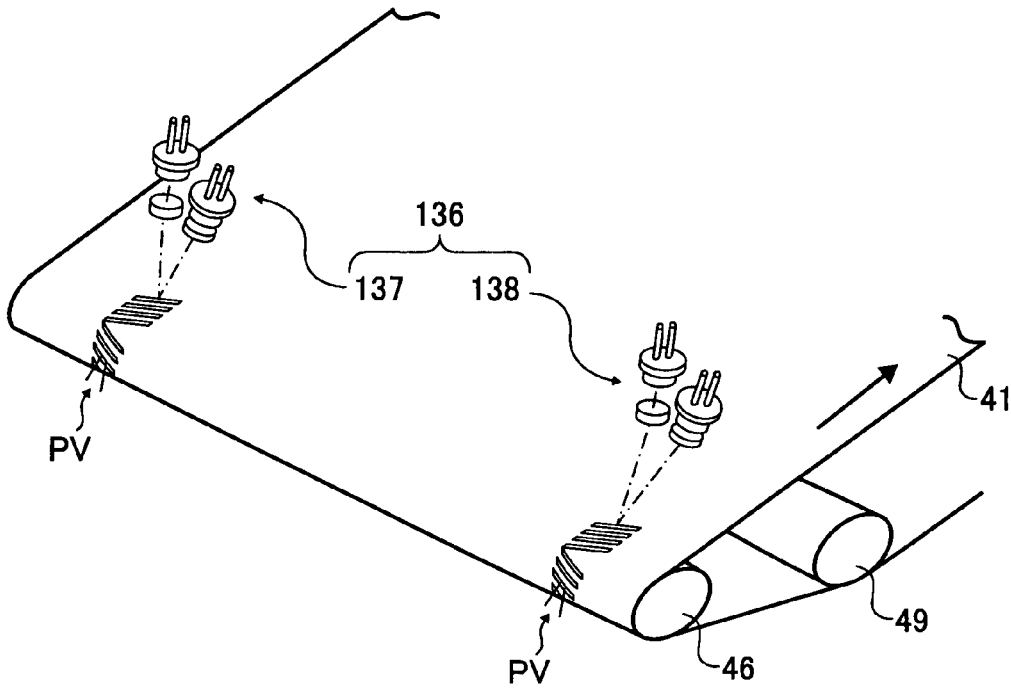
FIG. 10 is a perspective view illustrating (according to an example embodiment of the present invention) a portion of an intermediate transfer belt, and optical sensor units in the image forming apparatus illustrated in FIG. 1.

FIG. 10 is a perspective view illustrating the optical sensor unit 136 and a portion of the intermediate transfer belt 41 according to the present example embodiment.

The image forming apparatus 1000 includes a control unit 1200. The control unit 1200 conducts a positional displacement correction control as a timing adjustment control at a certain timing, such as immediately after a power switch is turned on, after a certain time has elapsed, etc.

In the positional displacement correction control, a positional displacement detection pattern P1 including a plurality of toner images is formed on each lateral side of the surface of the intermediate transfer belt 41.

The optical sensor unit 136 is located above the intermediate transfer belt 41. The optical sensor unit 136 includes optical sensors 137 and 138. Each of the optical sensors 137 and 138 further includes a light emitter, a light receiver, and a condenser lens.

The optical sensor 137 emits light from the light emitter, causes the light to pass through the condenser lens, and receives the light by the light receiver. Then, the optical sensor 137 outputs a voltage signal corresponding to the light intensity received by the light receiver.

When the toner images of the positional displacement detection pattern P1 that are formed on a first lateral side of the surface of the intermediate transfer belt 41 pass under the optical sensor 137, the light intensity received by the light receiver significantly changes. Thereby, the optical sensor 137 detects the toner images of the positional displacement detection pattern P1 and appropriately changes the voltage values output from the light receiver.

Similarly, the optical sensor 138 detects the toner images of the positional displacement detection pattern P1that are formed on a second lateral side of the surface of the intermediate transfer belt 41.

Thus, the optical sensors 137 and 138 each serves as an image sensor for detecting the toner images of the positional displacement detection pattern P1. The light emitter may be a light-emitting element, such as an LED, being capable of emitting a sufficient intensity of light for forming reflected light to detect the toner images. Further, the light-receiver may be a CCD (charge-coupled device) having a plurality of light-receiving elements that are linearly arranged.

As described above, the image forming apparatus 1000 uses the optical sensors 137 and 138 to detect the positional displacement detection patterns P1 that are formed on the first and second lateral sides, respectively, of the surface of the intermediate transfer belt 41. Such detection can adjust positional displacements between toner images in the main- and sub-scanning directions, a magnification error or a skew thereof of toner images in the main scanning direction, etc. In this regard, the main scanning direction is a scanning direction of the light beam irradiated from the optical writing unit 20, while the sub-scanning direction is a moving direction of the surface of the intermediate transfer belt 41.

Figure 11:
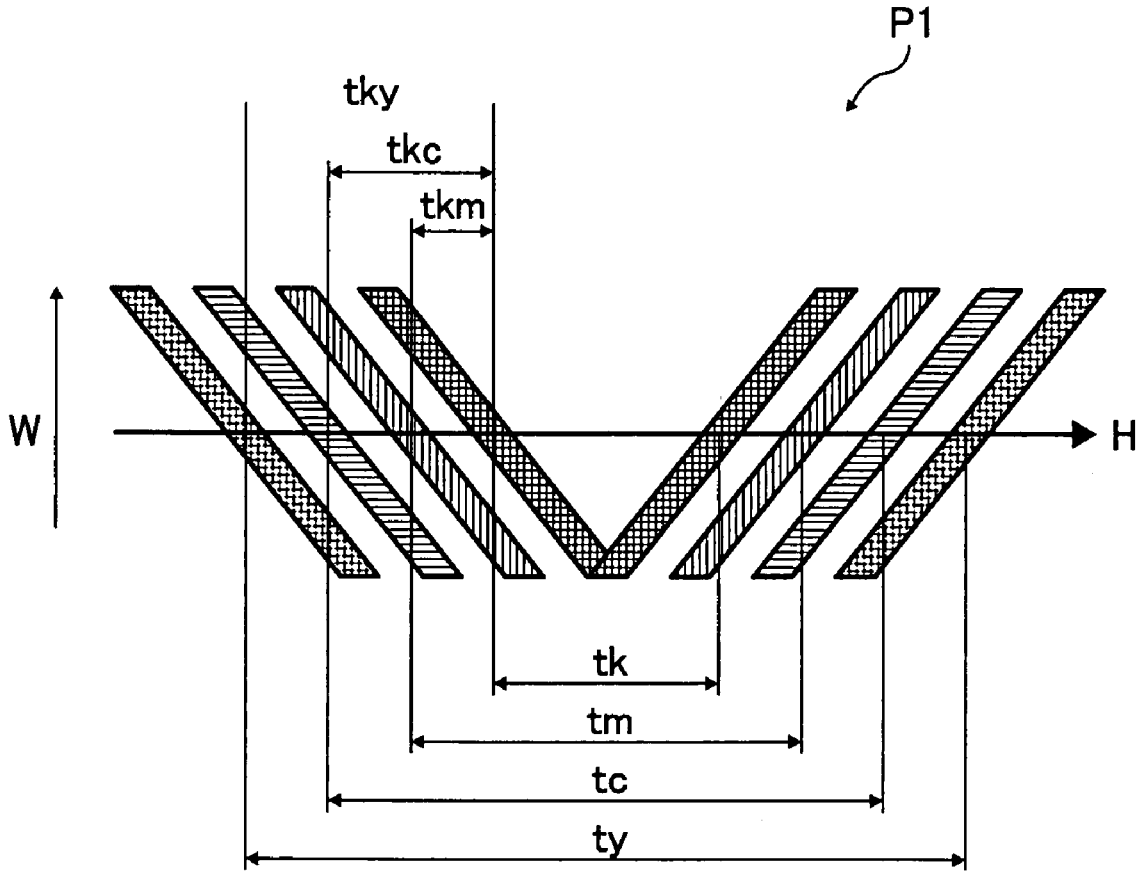
FIG. 11 is an enlarged schematic view illustrating (according to an example embodiment of the present invention) a positional displacement detection pattern.

As illustrated in FIG. 11, the positional displacement detection pattern P1 is formed of a line pattern called a chevron patch. Specifically, the positional displacement detection pattern P1 is formed of toner images in yellow, cyan, magenta, and black, each of which is arranged so as to have a substantially 45-degree inclination relative to the main scanning direction.

Then, the detection time differences, tyk, tck, and tmk, are determined between the black toner image, which is a reference color toner image, and each of the toner images in yellow, cyan, and magenta.

In FIG. 11, the main scanning direction is illustrated by an arrow W. The yellow, cyan, magenta, and black toner images are sequentially arranged along the sub-scanning direction so as to have a substantially 45-degree inclination to the left with respect to the main scanning direction. Further, the black, magenta, cyan, and yellow toner images are sequentially arranged so as to have a substantially 45-degree inclination to the right with respect to the main scanning direction.

Further, a difference between detected value and theoretical value is calculated for each of the detection time differences, tyk, tck, and tmk. Then, the positional displacement amount of a toner image of each color in the sub-scanning direction H can be determined based on the difference between detected value and theoretical value.

Furthermore, based on the position displacement amount, the start timing of optical writing to each photoreceptor is adjusted in units of one scan-line pitch. The one scan-line pitch corresponds to one facet of the polygon mirror in the optical writing unit 20. Through the above timing adjustment, the image forming apparatus 1000 can suppress a superimposition displacement between toner images of different colors in the sub-scanning direction H.

Moreover, the detection time differences, ty, tc, tm, and tk are determined between the two toner images of each color that are inclined perpendicular to each other. Further, a difference between detected value and theoretical value is calculated for each of the detection time differences, ty, tc, tm, and tk. Then, the position displacement amount of the toner images of each color in the main scanning direction can be determined based on the difference between detected value and theoretical value.

In addition, the skew of toner images in the main scanning direction can be calculated based on a difference in positional displacement amounts in the sub-scanning direction between the toner images of each color, which are formed on both lateral sides of the intermediate transfer belt 41.

Then, based on the calculated skew, a lens inclination adjustment mechanism is driven to adjust an inclination of a toroidal lens in the optical writing unit 20. Thus, the skew of toner images in the main scanning direction can be reduced.

According to the present example embodiment, the image forming apparatus 1000 uses a single polygon mirror to deflect laser beams corresponding to the photoreceptors 3Y, 3C, 3M, and 3K and thereby performs optical scanning of the photoreceptors 3Y, 3C, 3M, and 3K in the main scanning direction. In this configuration, the start timing of optical writing to each photoreceptor is adjusted through the positional displacement correction control in units of time for writing one line, that is, one scan line.

For example, a superimposition displacement of more than half a dot in the sub-scanning direction may occur between any two of the photoreceptors 1Y, 1C, 1M, and 1K. In this case, the start timing of optical writing to one of the two photoreceptors is shifted before or after the original start timing in units of an integral multiple of the time for writing one line.

Specifically, when the amount of superimposition displacement is substantially a ¾ dot, the start timing of optical writing is shifted before or after the original start timing by one multiple of the time for writing one line. Alternatively, when the amount of superimposition displacement is substantially a 7/4 dot, the start timing of optical writing is shifted before or after the original start timing by two multiples of the time for writing one line. Thus, the amount of superimposition displacement in the sub-scanning direction can be reduced to less than half a dot diameters.

However, when the amount of superimposition displacement in the sub-scanning direction is substantially half a dot, the amount of superimposition displacement remains unchanged even if the start timing of optical writing is shifted before or after the original start timing by the time for writing one line. Further, in such case, the amount of superimposition displacement contrarily becomes larger if the start timing of optical writing is shifted before or after the original start timing in units of the time for writing one line.

The superimposition displacement of lower than half a dot is preferably suppressed to meet recent growing demand for high quality image. Hence, according to the present example embodiment, when the superimposition displacement of lower than half a dot remains unchanged after the adjustment of the start timing of optical writing, the image forming apparatus 1000 calculates correction values for the drive speeds of the photoreceptors 3Y, 3C, 3M, and 3K corresponding to the amounts of superimposition displacements of respective colors. Then, the image forming apparatus 1000 stores the drive speed correction values into a drive controller 150.

Further, when the image forming apparatus 1000 executes a print job based on image data transmitted from an external computer, etc., the process drive motors 120Y, 120C, 120M, and 120K drive the photoreceptors 3Y, 3C, 3M, and 3K, respectively, at corrected drive speeds based on the drive speed correction values.

Thus, as needed, the linear velocity differences between the photoreceptors 3Y, 3C, 3M, and 3K are set for the print job corresponding to the superimposition displacement of lower than half a dot. Thereby, the superimposition displacement of lower than half a dot can be further reduced.

Figure 12:
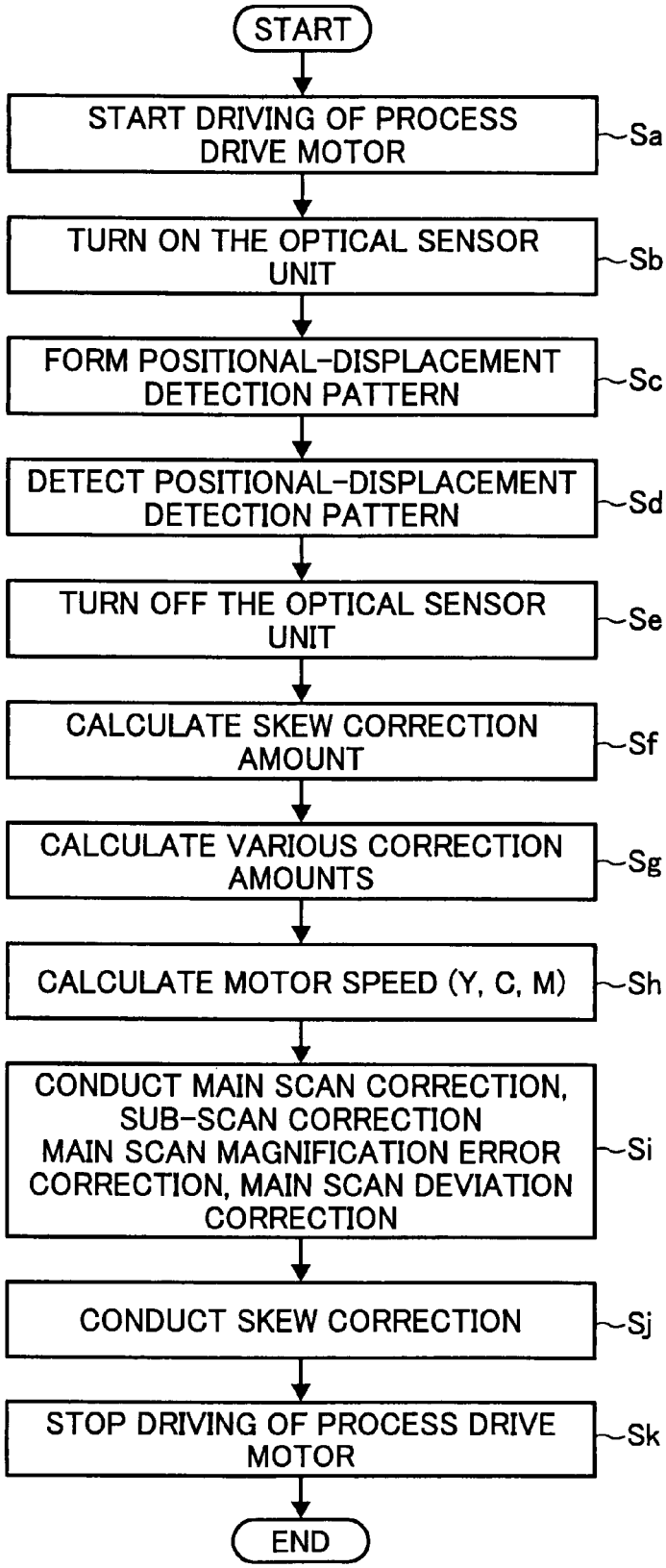
FIG. 12 is a flowchart illustrating (according to an example embodiment of the present invention) processing steps of a positional displacement correction control executed by a control unit of the image forming apparatus illustrated in FIG. 1.

FIG. 12 is a flowchart illustrating processing steps of the positional displacement correction control executed by the control unit 1200 in the image forming apparatus 1000 according to the present example embodiment of the present invention.

Figure 13:
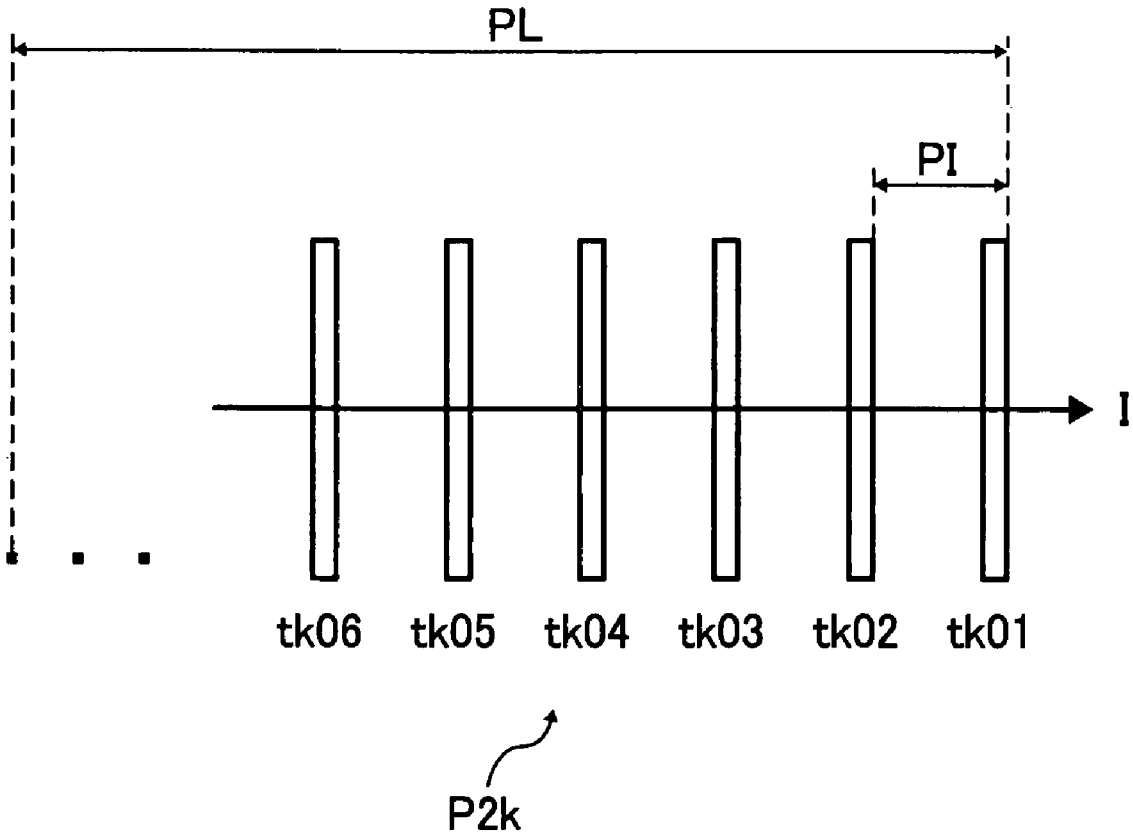
FIG. 13 is an enlarged schematic view illustrating (according to an example embodiment of the present invention) a speed variation detection pattern for detecting a rotation speed variation of a photoreceptor for black.

For the positional displacement correction control, first, at step Sa in FIG. 13, the control unit 1200 starts the driving of the process drive motors 120Y, 120C, 120M, and 120K. At step Sb, the control unit 1200 turns on the optical sensor unit 136. At step Sc, the positional displacement detection pattern P1 is formed on the intermediate transfer belt 41. At step Sd, the optical sensor unit 136 detects the positional displacement detection pattern P1.

At step Se, the control unit 1200 turns off the optical sensor unit 136. At step Sf, a correction amount is calculated for main scan skew. At step Sg, various correction amounts are calculated for main- and sub-scan positions, main scan magnification error, and main scan deviation for each color. At step Sh, an appropriate drive speed is calculated for each of the process drive motor 120Y, 120C, 120M, and 120K so as to suppress even a position displacement of lower than half a dot in the sub-scanning direction.

At step Si, the main scan position, the sub-scan position, the main scan magnification error, and the main scan displacement are corrected based on the various correction amounts. At Step Sj, the main scan skew is corrected based on the correction amount calculated at step Sf. At step Sk, the driving of the process drive motors 120Y, 120C, 120M, and 120K are stopped.

According to the present example embodiment, the control unit 1200 conducts a speed variation detection control to detect a speed variation during a rotation of each of the photoreceptors 3Y, 3C, 3M, and 3K. In the speed variation detection control, a speed variation detection pattern P2 for each photoreceptor is formed on the surface of the intermediate transfer belt 41.

For example, as the speed variation detection pattern P2*k* for black, a plurality of black toner images, tk01, tk02, tk03, etc. are sequentially formed at a certain distance along the belt moving direction indicated by the arrow I in FIG. 13. In this regard, the plurality of black toner images are theoretically formed at a certain distance.

However, a speed variation during rotation of the photoreceptor 1K may cause an error in distance between each adjacent pair of the plurality of black toner images. The optical sensors 137 and 138 each reads such an error in distance as an error in detection time interval.

Whenever forming one of the speed variation detection patterns P2*y*, P2*c*, and P2*m* for yellow, cyan, and magenta, the image forming apparatus 1000 also forms the speed variation detection pattern P2*k* for black in combination therewith.

Specifically, the image forming apparatus 1000 forms the speed variation detection patterns P2*y* and P2*k* on a first and second lateral sides, respectively, of the surface of the intermediate transfer belt 41. Then, the optical sensors 137 and 138 simultaneously detect the speed variation detection patterns P2*y* and P2*k*, respectively. Similarly, each of the speed variation detection patterns P2*c* and P2*m* is formed and detected together with the speed variation detection pattern P2*k*.

Thus, the speed variation detection control conducted in the image forming apparatus 1000 includes a step in which the two speed variation detection patterns P2*y* and P2*k* are formed on the intermediate transfer belt 41 and detected by the optical sensor unit 136, another step in which the two speed variation detection patterns P2*c* and P2*k* are formed on the intermediate transfer belt 41 and detected by the optical sensor unit 136, and still another step in which the two speed variation detection patterns P2*m* and P2*k* are formed on the intermediate transfer belt 41 and detected by the optical sensor unit 136. A possible reason that the speed variation detection is performed as above is described below in detail.

The positional displacement detection pattern P1 or the speed variation detection pattern P2 is formed on the intermediate transfer belt 41 and then is conveyed to a point facing the optical sensor unit 136 as illustrated in FIG. 1. On the way, the positional displacement detection pattern P1or the speed variation detection pattern P2 passes through a point facing the secondary transfer roller 50.

At this time, if the secondary transfer roller 50 is in contact with the intermediate transfer belt 41 to form the secondary transfer nip, the positional displacement detection pattern P1 or the speed variation detection pattern P2contacts the secondary transfer roller 50, and thereby are transferred to the surface thereof.

Hence, according to the present example embodiment, the image forming apparatus 1000 drives in advance a roller separation mechanism to separate the secondary transfer roller 50 from the intermediate transfer belt 41 before conducting the positional displacement correction control or the speed variation detection control. Through the separating operation, the image forming apparatus 1000 can suppress an unnecessary transfer of the positional displacement detection pattern P1 or the speed variation detection pattern P2 to the secondary transfer roller 50.

Figure 14:
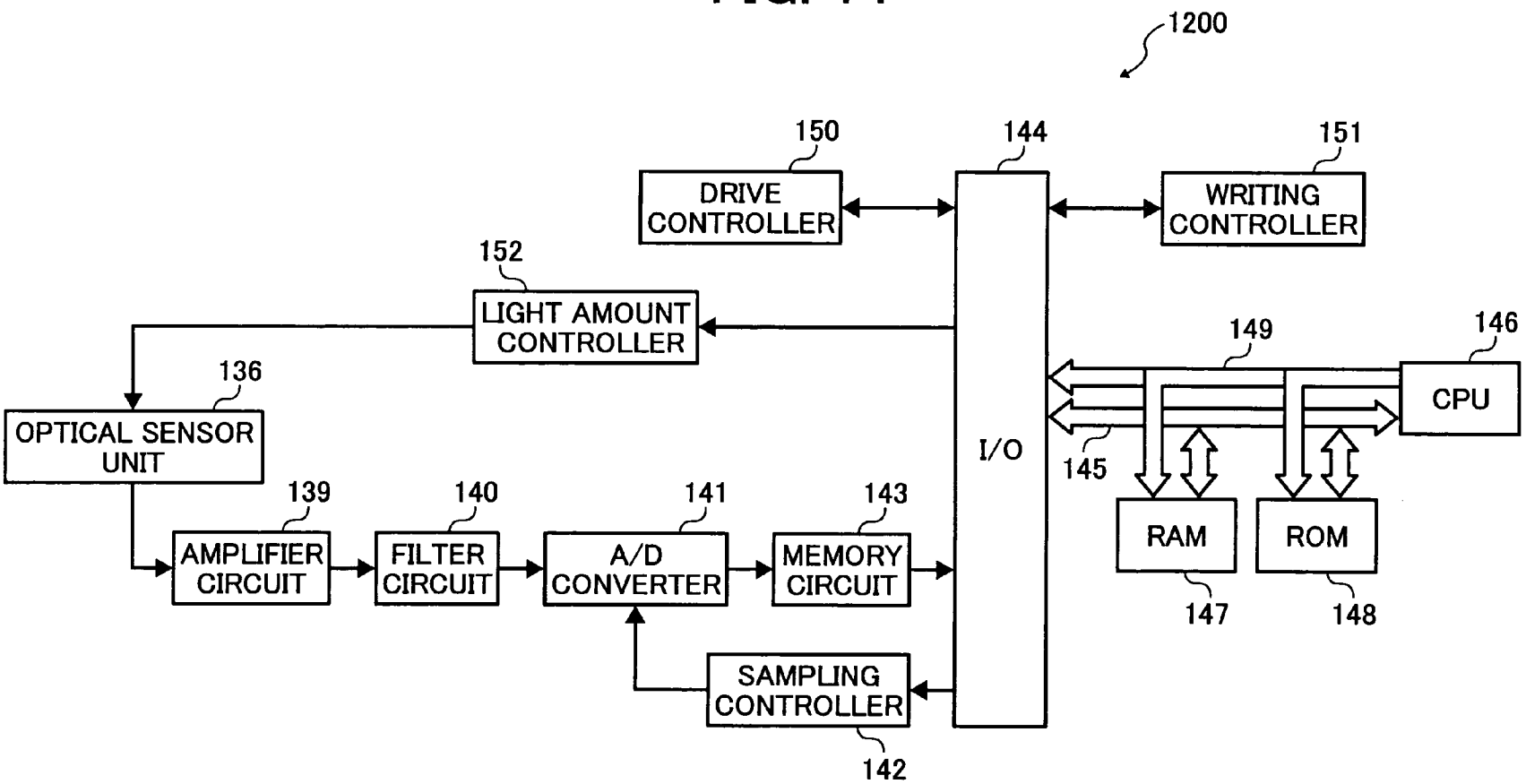
FIG. 14 is a block diagram illustrating (according to an example embodiment of the present invention) a circuitry of the control unit of FIG. 12.

FIG. 14 is a block diagram illustrating a circuit configuration of the control unit 1200 for use in the image forming apparatus 1000. The control unit 1200 includes the optical sensor unit 136 and the drive controller 150 as above. The control unit 1200 also includes an amplifier circuit 139, a filter circuit 140, an analog-to-digital (A/D) converter 141, a sampling controller 142, an memory circuit 143, an input-and-output (I/O) interface 144, a data bus 145, a CPU (central processing unit) 146, an RAM (random access memory) 147, a ROM (read only memory) 148, an address bus 149, a writing controller 151, and a light intensity controller 152.

When the positional displacement correction control or the speed variation detection control is started, first, the amplifier circuit 139 amplifies a voltage signal output from the optical sensor unit 136. Then, the filter circuit 140 selects only a signal component of line detection from the amplified voltage signal. Further, the analog-to-digital converter 141 converts the selected signal component from analog to digital format. The sampling controller 142 controls data sampling in the analog-to-digital conversion. Sampled data are stored in the memory circuit 143 of FIFO (first-in-first-out) type.

When the detection of the positional displacement detection pattern P1 or the speed variation detection pattern P2 is finished, the data stored in the memory circuit 143 are transmitted via the input-and-output interface and are loaded to the CPU 146 or the RAM 147 through the data bus 145.

The CPU 146 calculates various displacement amounts, such as the amount of superimposition displacement between toner images of different colors, the skew amount of toner images in the main scanning direction, and the amount of phase difference in rotation speeds between the photoreceptors 3Y, 3C, 3M, and 3K. The CPU 146 also calculates magnifications in the main- and sub-scanning directions for each color.

The CPU 146 causes the drive controller 150 and the writing controller 151 to store data for correcting the superimposition displacement, the skew, the phase difference, the magnification error, etc. based on the various calculated amounts. The drive controller 150 is a circuit that controls the process drive motors 120Y, 120C, 120M, and 120*k* for driving the photoreceptors 3Y, 3C, 3M, and 3K, respectively. The writing controller 151 is a circuit that controls the optical writing unit 20.

The writing controller 151 includes a device such as a clock generator employing a VCO (voltage controlled oscillator) for each color. The device is capable of accurately tuning the output frequency, and adjusts a start point of optical writing in the main scanning direction or the sub-scanning direction based on the data from the CPU 146. According to the present example embodiment, the image forming apparatus 1000 uses output data from the writing controller 150 as image clock signal.

The drive controller 150 forms drive control data for each of the process drive motors 120Y, 120C, 120M, and 120K so as to appropriately control a phase of speed variation during the rotation of each of the photoreceptors 3Y, 3C, 3M, and 3K based on the data sent from the optical sensor unit 136.

For the image forming apparatus 1000 according to the present example embodiment, even if the light emitter of the optical sensor unit 136 is deteriorated, the light intensity controller 152 controls the light emission intensity of the light emitter to reliably detect toner images of the positional displacement detection pattern P1 or the speed variation detection pattern P2. Thus, the light intensity received by the light receiver of the optical sensor unit 136 is maintained substantially constant.

The ROM 148, which is connected to the data bus 145, stores algorithms for calculating various displacement amounts, a control program for executing a print job, programs for executing the positional displacement correction control and the speed variation detection control, etc. The CPU 146 addresses the ROM 148 and the RAM 147, and specifies various input-and-output devices.

As described above, the speed variation detection pattern P2 for each color includes the plurality of toner images of a single color, which are formed at a certain distance along the sub-scanning direction.

A pattern interval P1 between each adjacent pair of toner images of the speed variation detection pattern P2 as illustrated in FIG. 13 is preferably set as short as possible. However, a minimum length of pattern interval P1 is determined based on relationships among a width of toner image, a calculation time, etc.

On the other hand, a pattern length PL of the speed variation detection pattern P2 in the sub-scanning direction as indicated by the arrow I in FIG. 13 is set to an integral multiple of the circumference of the corresponding one of the photoreceptors 3Y, 3C, 3M, and 3K.

Regarding the above settings, further consideration is preferably given to other periodical variations that may be generated in forming or detecting the speed variation detection pattern P2 on the intermediate transfer belt 41. Such periodical variations include a variation in linear velocity generated during the rotation of the drive roller 47 of the intermediate transfer belt 41, pitch errors or eccentricity components of gears for transmitting the drive force of the drive roller 47, the winding of the intermediate transfer belt 41, a thickness deviation distribution in a circumference direction of the intermediate transfer belt 41, and other frequency components.

Such periodical variation components are all superimposed in a detection value of the speed variation detection pattern P2. Therefore, only the speed variation components during the rotation of the photoreceptor is preferably detected in the detection value.

In this regard, for example, an error in detection time interval between each adjacent pair of the toner images of the speed variation detection pattern P2 includes a relatively large amount of speed variation components generated during rotation of the drive roller 47 of the intermediate transfer belt 41, in addition to the speed variation components during the rotation of the corresponding photoreceptor. In such case, the pattern length PL of the speed variation detection pattern P2 is also preferably set in consideration with the speed variation components of the drive roller 47.

Supposing that the diameters of the photoreceptor 3Y and the drive roller 47 are 40 mm and 30 mm respectively, the rotation periods of the photoreceptor 3Y and the drive roller 47 are 125.7 mm and 94.2 mm, respectively, when converted to moving distances of the intermediate transfer belt 41. A common multiple between the two rotation periods, for example, 377 mm can be used as the pattern length PL of the speed variation detection pattern P2. Then, the pattern interval P1 between each adjacent pair of toner images of the speed variation detection pattern P2 can be set corresponding to the pattern length PL.

With the above settings, the image forming apparatus 1000 can calculate, with a relatively high accuracy, a maximum amplitude or a phase value of a speed variation during the rotation of each photoreceptor while suppressing undesirable effects of periodical variation components of the drive roller 47. The above calculation takes advantage of the fact that the term including the periodical variation components of the drive roller 47 theoretically becomes zero in the calculation of the maximum amplitude and the phase value.

Similarly, an error in detection time interval between each adjacent pair of the toner images of the speed variation detection pattern P2 may include a relatively large amount of periodical variation components that may be caused by a thickness deviation distribution in the circumference direction of the intermediate transfer belt 41.

In such case, the pattern length PL of the speed variation detection pattern P2 is preferably set to a value closest to the circumference length of the intermediate transfer belt 41 among integral multiples of the circumference length of the corresponding photoreceptor. With the setting, the image forming apparatus 1000 can reduce undesirable effects of the periodical variation components of the intermediate transfer belt 41.

Some frequency components, such as a periodical variation component of a roller drive motor for driving the drive roller 47, may have a difference in frequency of ten or more times as compared to the periodical variation component of the corresponding photoreceptor. Such frequency components can be omitted with a low pass filter.

The pulse width of data stored in the memory circuit 143 varies with the light intensity received by the light receiver of the optical sensor unit 136. The received light intensity also varies with the density of toner image. Therefore, The pulse width of data stored in the memory circuit 143 varies with the density of toner image.

For the positional displacement correction control or the speed variation detection control, the toner images of the positional displacement detection pattern P1 or the speed variation detection pattern P2 should be detected with relatively high accuracy. Therefore, even if the toner images are different in pulse width from each other, the CPU 146 should recognize correspondences between the toner images and the different pulse widths.

Hence, in the image forming apparatus 1000 according to the present example embodiment, the CPU 146 recognizes a pulse peak rather than a pulse width beyond a threshold value. With the above configuration, the image forming apparatus 1000 can suppress undesirable effects of density variations of toner images that may be caused by a rotation speed variation of the photoreceptor 3.

Figure 15:
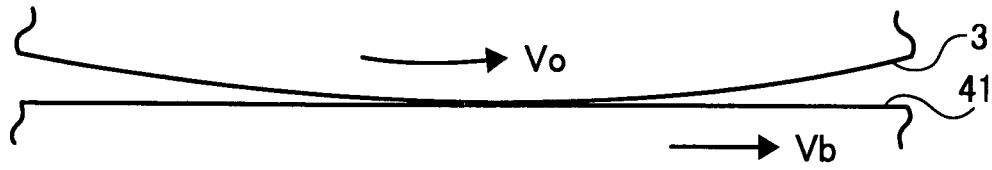
FIG. 15 is an enlarged schematic view illustrating (according to an example embodiment of the present invention) a primary transfer nip formed between a photoreceptor and an intermediate transfer belt.
Figure 16:
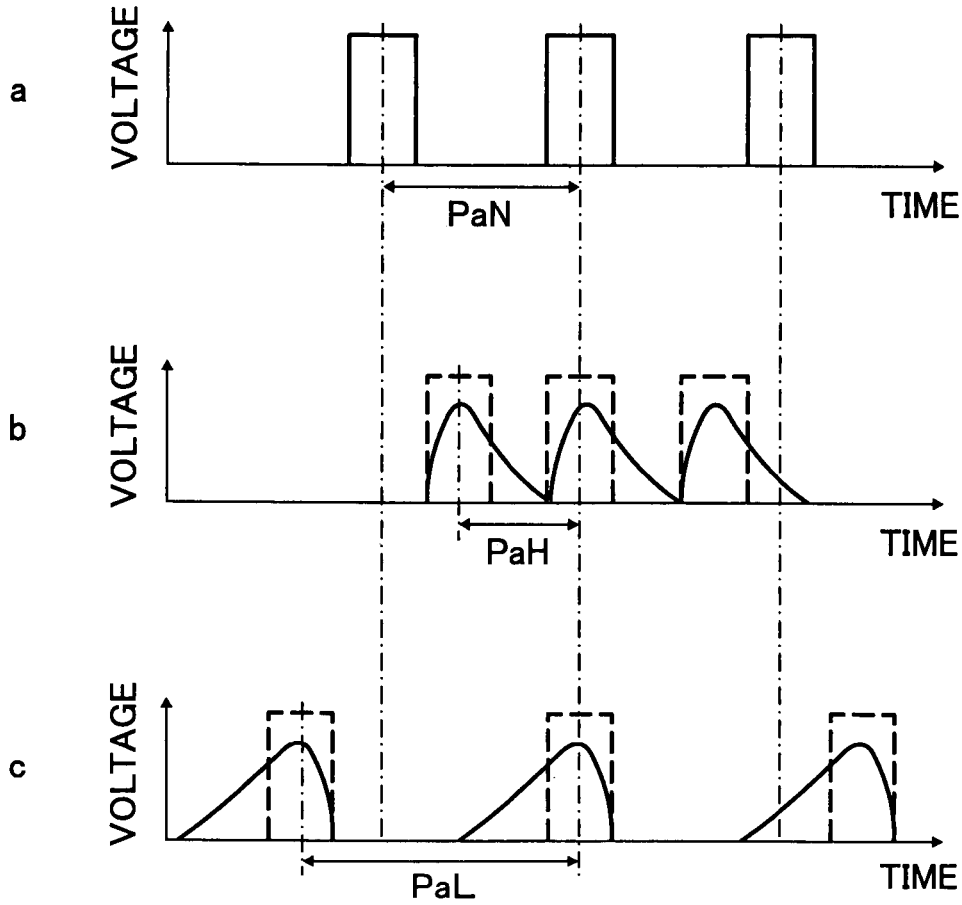
FIG. 16 is a graph illustrating (according to an example embodiment of the present invention) output pulses from an optical sensor unit.

A possible reason thereof is described in detail with reference to FIGS. 15 and 16. FIG. 15 is an enlarged schematic view illustrating a primary transfer nip formed by a contact between the intermediate transfer belt 41 and the photoreceptor 3. The photoreceptor 3 may be any one of the photoreceptors 3Y, 3C, 3M, and 3K.

FIG. 16A is a graph illustrating output pulses from the optical sensor unit 136 in detecting the speed variation detection pattern P2 that is transferred on the intermediate transfer belt 41 when the surface speed $V_0$ of the photoreceptor 3 is substantially equal to the surface speed Vb of the intermediate transfer belt 41 at the primary transfer nip.

FIG. 16B is a graph illustrating output pulses from the optical sensor unit 136 in detecting the speed variation detection pattern P2 that is transferred on the intermediate transfer belt 41 when the surface speed $V_0$ of the photoreceptor 3 is faster than the surface speed Vb of the intermediate transfer belt 41 at the primary transfer nip.

FIG. 16C is a graph illustrating output pulses from the optical sensor unit 136 in detecting the speed variation detection pattern P2 that is transferred on the intermediate transfer belt 41 when the surface speed $V_0$ of the photoreceptor 3 is slower than the surface speed Vb of the intermediate transfer belt 41 at the primary transfer nip.

The surfaces of the photoreceptor 3 and the intermediate transfer belt 41 travels at respective speeds while being in contact with each other at the primary transfer nip.

When the surface speed $V_0$ of the photoreceptor 3 is substantially equal to the surface speed Vb of the intermediate transfer belt 41, pulse waves corresponding to toner images being output from the optical sensor unit 136 are rectangular in shape as illustrated in FIG. 16A. At this time, detection time intervals between each adjacent pair of the toner images are substantially PaN.

Alternatively, when the surface speed $V_0$ of the photoreceptor 3 is faster than the surface speed Vb of the intermediate transfer belt 41, detection time intervals between each adjacent pair of the toner images are substantially PaH, which is shorter than PaN, as illustrated in FIG. 16B. In this case, pulse waves have a shape with a long right tail, in which each pulse first steeply rises up and then gradually falls down. Such a shape is formed because a difference in surface speeds between the photoreceptor 3 and the intermediate transfer belt 41 causes respective tone images to be tilted toward the upstream side in the belt moving direction. Thus, uneven density may be generated in a resultant color toner image.

On the other hand, when the surface speed $V_0$ of the photoreceptor 3 is slower than the surface speed Vb of the intermediate transfer belt 41, detection time intervals between each adjacent pair of the toner images are substantially PaL, which is longer than PaN, as illustrated in FIG. 16C. In this case, pulse waves have a shape with a long left tail, in which each pulse first gradually rises up and then steeply falls down. Such a shape is formed because a difference in surface speeds between the photoreceptor 3 and the intermediate transfer belt 41 causes respective tone images to be tilted toward the downstream side in the belt moving direction. Thus, uneven density may be generated in a resultant color toner image.

With the configuration where the CPU 146 recognizes a pulse peak over a threshold value as a toner image, the tilt of toner image as illustrated in FIGS. 16B and 16C may cause the pulse peak to be lower than the threshold. Further, the tilt of toner image may deteriorate accuracy in detecting a highest density point in the toner image.

Hence, according to the present example embodiment, the image forming apparatus 1000 treats the pulse peak as a detection timing of the toner image. Specifically, the CPU 146 recognizes the pulse peak based on data stored in the memory circuit 143 as illustrated in FIG. 14, and then stores the detection timing data into the RAM 147. Thereby, the image forming apparatus 1000 can detect, with relatively high accuracy, an error in detection time interval between each adjacent pair of toner images.

Such an error in detection time interval, which is reflected in the data stored in the RAM 147, corresponds with a speed variation during the rotation of the photoreceptor 3. The timings at which the rotation speed of the photoreceptor 3 reaches a maximum and a minimum value during rotation thereof correspond with the timings at which a sine curve reaches upper and lower limits, respectively. The sign curve is generated by one having a largest eccentricity among the photoreceptor 3, the photoreceptor gear 133, and the coupling for coupling the photoreceptor gear 133 with the photoreceptor 3

Then, as indicators of speed variation, the shape and amplitude of the sine curve are analyzed in relationship to a timing at which the mark 134 is detected by the position sensor 135. In this regard, one conventional method analyzes the amplitude and phase of a variation component based on a zero cross point and a peak point of a variable under the assumption that an average value of all detection data is zero. However, the detection data are significantly subjected to noise, which may cause a significant error in the analysis.

Hence, the image forming apparatus 1000 according to the present example embodiment employs an analysis method of analyzing the amplitude and phase of a speed variation through quadrature detection processing.

Figure 17:
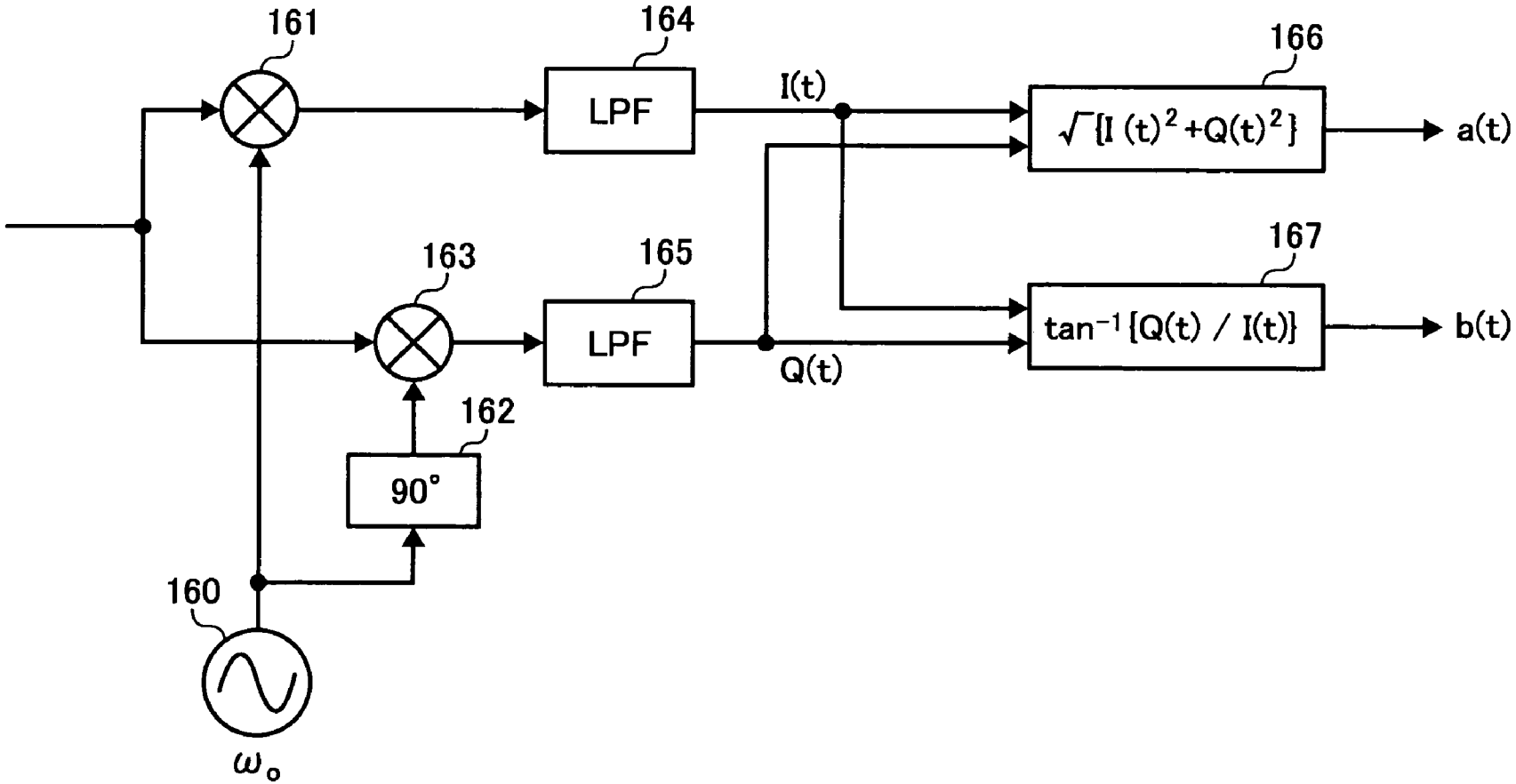
FIG. 17 is a block diagram illustrating (according to an example embodiment of the present invention) a circuitry for executing quadrature detection processing.

The quadrature detection processing is a signal analysis technology, which is generally used in demodulator circuits in the telecommunication sector. FIG. 17 illustrates a configuration example of a circuit for performing quadrature detection processing.

As illustrated in FIG. 17, the circuit includes an oscillator 160, a multiplier 161, a quadrature phase shifter 162, a multiplier 163, LPFs (low pass filters) 164 and 165, an amplitude calculator 166, and a phase calculator 167.

Data that are stored in the RAM 147 based on output signals from the optical sensor unit 136 form a data group indicating a monotonic increase. Several speed variation components including a speed variation component of the photoreceptor 3 are superimposed in the data group. The data stored in the RAM 147 are converted to variation data. At this time, an increasing inclination of the data group is calculated based on the least square method and is subtracted from the data stored in the RAM 147. The increasing inclination is also used as a correction value of magnification.

The converted variation data are processed as follows. First, the oscillator 160 oscillates a given frequency component at a phase that is based on the reference timing used in the formation of the speed variation detection pattern P2. Incidentally, according to the present example embodiment, the given frequency component is a frequency signal having a frequency of a rotation period $\omega_o$ of the photoreceptor 3.

The frequency signal is directly output to the multiplier 161 or is output via the quadrature phase shifter 162 to the multiplier 163. The rotation period $\omega_o$ of the photoreceptor 3 can be determined with relatively high accuracy by measuring detection time intervals between detection signals of the mark 164 on the photoreceptor 3.

The multiplier 161 multiplies the variation data stored in the RAM 147 by the frequency signal being output from the oscillator 160. The multiplier 163 multiplies the variation data stored in the RAM 147 by the frequency signal being output from the quadrature phase shifter 162.

Through the above multiplications, the variation data are separated into a signal having an in-phase component of the photoreceptor 3 and a signal having a quadrature component thereof. That is, the multiplier 161 outputs the in-phase component, while the multiplier 163 outputs the quadrature component.

The LPF 164 passes only signals in a low frequency band of I component. According to the present example embodiment, the image forming apparatus 1000 employs a low pass filter that performs data smoothing in units of the pattern length PL of the speed variation detection pattern P2so as to pass only data corresponding to an integral multiple of the rotation period $\omega_o$.

Similarly, the LPF 165 performs data smoothing in units of the pattern length PL of the speed variation detection pattern P2. Thus, periodical variation components of the drive roller, etc. are canceled to zero by the data smoothing.

Then, the amplitude calculator 166 calculates an amplitude value a(t) based on the two inputs: the in-phase component and the quadrature component. On the other hand, the phase calculator 167 calculates a phase value b(t) based on the two inputs: the in-phase component and the quadrature component. The amplitude value a(t) and the phase value b(t) correspond with an amplitude of the periodical variation of the photoreceptor 3 and a phase angle relative to a reference timing thereof, respectively.

Similarly, quadrature detection processing may be used to detect an amplitude and phase of a periodical variation component during the rotation of the drive gear 121. At this time, the rotation period $\omega_o$ is set to a motor rotation period having a relatively high frequency component.

When the amplitude and phase of a variation component are calculated based on a zero cross point and a peak point of a detected signal voltage, a relatively large amount of data is preferably used in order to obtain a relatively high accuracy in the calculation. However, with the above-described quadrature detection processing, the image forming apparatus 1000 can calculate the amplitude and phase of a variation component based on a relatively small amount of variation data while maintaining a relatively high accuracy.

In particular, the pattern interval P1 between each adjacent pair of toner images in the speed variation detection pattern P2 is preferably set so that 4NP toner images are formed per rotation of the photoreceptor 3, where NP represents a natural number. In such case, even a relatively small number of toner images can provide a relatively high accuracy in the calculation of the amplitude and phase. A possible reason thereof is that positional relationships between the 4NP toner images are most distinguishable for the variable component, thereby providing a relatively high sensitivity in the detection.

For example, when four toner images are formed per rotation of the photoreceptor 3, the four toner images each corresponds with either a zero cross point or a peak point of the detected signal voltage. Therefore, relatively high sensitivity can be obtained in the detection thereof. Even if a difference in phase occurs between the four toner images, the positional relationships between the four toner images can still provide relatively high sensitivity in the detection.

Based on the speed variation thus analyzed, the CPU 146 calculates drive control correction data for each of the photoreceptors 3Y, 3C, 3M, and 3K. Then, the CPU 146 sends the drive control correction data to the drive controller 150. The drive control correction data are used to adjust a rotation phase of each photoreceptor so as to cancel a periodical rotation variation thereof and further adjust a phase of a speed variation of each photoreceptor.

The drive control correction data are calculated through a speed variation detection control for detecting a speed variation during rotation of each photoreceptor. Then, the drive control correction data are used in a phase adjustment control for adjusting a phase of the speed variation of each photoreceptor. The phase adjustment control can synchronize respective tips of yellow, cyan, magenta, and black toner images with one another on the intermediate transfer belt 41.

In the image forming apparatus 1000 according to the present example embodiment, the distances between each adjacent pair of the photoreceptors 3Y, 3C, 3M, and 3K are set to a length substantially equal to the circumference of each photoreceptor. Thus, respective phases of speed variations of the photoreceptors 3Y, 3C, 3M, and 3K can be synchronized with one another.

Specifically, the image forming apparatus 1000 temporarily changes the drive speeds of the process drive motors 120Y, 120C, 120M, and 120K so as to precisely synchronizes the timings at which the surface speed of each photoreceptor reaches a maximum and a minimum value. Thus, the respective tips of yellow, cyan, magenta, and black toner images can be synchronized with one another on the surface of the intermediate transfer belt 41.

According to the present example embodiment, the image forming apparatus 1000 conducts the phase adjustment control at the termination of each print job. Alternatively, the image forming apparatus 1000 may conduct the phase adjustment control at the start of each print job. In such case, however, the phase adjustment control is conducted at a timing between the start of a print job and the start of a printing to a first recording sheet. Thus, the first print time may be increased.

Hence, as described above, the image forming apparatus 1000 conducts the phase adjustment control when each print job is finished. Thus, in a following print job, the image forming apparatus 1000 can start the driving of the photoreceptors 3Y, 3C, 3M, and 3K in a preferable phase relationship while suppressing the increase in the first print time.

Generally, in image forming apparatuses including process units, the positions and sizes of process units may vary with a change in interior temperature or an external force. Such an external force may be applied to the process units during operations such as a recovery operation from sheet jam, a replacement for maintenance, an mount or dismount operation of a component, and a relocation of the image forming apparatus.

Such an application of an external force or a change in interior temperature may deteriorate accuracy in superimposing toner images of respective colors formed by using the process units 1Y, 1C, 1M, and 1K.

Hence, the image forming apparatus 1000 conducts the positional displacement correction control immediately after the power switch is turned on and when a certain time elapses. Thus, the image forming apparatus 1000 can suppress a superimposition displacement between toner images of different colors.

However, when a difference in linear velocity is set between the photoreceptors 3Y, 3C, 3M, and 3K, the phase relationship in speed variations between the photoreceptors 3Y, 3C, 3M, and 3K may be deviated from a preferable phase relationship. Such a phase difference does not cause so significant effects in a single print operation of printing an image on a single recording sheet.

On the other hand, for a continuous print operation of continuously printing an image on a plurality of recording sheets, the amount of phase difference increases with the increase of the number of recording sheets to be printed. Therefore, the setting of a linear velocity difference between the photoreceptors 3Y, 3C, 3M, and 3K may cause a relatively large superimposition displacement between toner images of different colors.

Hence, according to the present example embodiment, the image forming apparatus 1000 is configured to be capable of selecting one of an image quality priority mode, in which image quality has priority over print speed, and a print speed priority mode, in which print speed has priority over image quality. The selection is performed by an input operation from an operation display and a printer driver installed on an external computer.

Further, during the execution of the continuous print operation with the image quality priority mode, the continuous print operation is temporarily stopped to conduct the phase adjustment control every time a certain number of recording sheets are continuously printed.

Thus, the image forming apparatus 1000 can suppress a superimposition displacement of lower than half a dot. On the other hand, when conducting the positional displacement correction control or the speed variation detection control, the image forming apparatus 1000 drives the photoreceptors 3Y, 3C, 3M, and 3K at substantially identical speeds without setting a difference in linear velocity between the photoreceptors.

Thus, the image forming apparatus 1000 can suppress deterioration in the accuracy of the position displacement correction or phase adjustment, which may be caused by setting a linear velocity difference between the photoreceptors 3Y, 3C, 3M, and 3K.

The speed variation during the rotation of photoreceptor is not so much subjected to the change in interior temperature and the application of an external force. Therefore, the speed variation detection control need not be conducted as often as the positional displacement correction control.

However, once a dismount-and-mount operation is performed for the process unit 1, a speed variation of the corresponding photoreceptor in the process unit may be significantly changed. In this regard, the process unit 1 may be any one of the process units 1Y, 1C, 1M, and 1K. Hence, according to the present example embodiment, the image forming apparatus 1000 conducts the speed variation detection control only when the dismount-and-mount operation is performed for the process unit 1.

The positional displacement correction control is conducted at a given timing even while the dismount-and-mount operation of the process unit 1 is not performed. The dismount and mount states of the process unit 1 are detected with a dismount-and-mount detector (not illustrated).

The dismount-and-mount detector may include four sensors for separately detecting the process units 1*y*, 1*c*, 1*m*, and 1*k*. Further, the dismount-and-mount detector may detect the dismount-and-mount operation of the process unit 1 based on the fact that one of output signals from the four sensors is turned on and then is turned off.

The speed variation detection control is conducted in combination with the positional displacement correction control. Specifically, once the dismount-and-mount operation of the process unit 1 is detected, first, the image forming apparatus 1000 conducts the first positional displacement correction control. Further, the image forming apparatus 1000 conducts the speed variation detection control and the phase adjustment control. Then, the image forming apparatus 1000 conducts the second positional displacement correction control.

Incidentally, the image forming apparatus 1000 does not execute a print job during the execution of the above sequential control flow.

The image forming apparatus 1000 conducts the positional displacement correction control twice in the above sequential control flow. Specifically, the image forming apparatus 1000 conducts the first positional displacement correction control and the speed variation detection control. Then, the image forming apparatus 1000 conducts the second positional displacement correction control.

In this regard, if the speed variation detection control is conducted with a large amount of position displacement that may be caused by the dismount-and-mount operation of the process unit 1, the detection accuracy of speed variation may be deteriorated.

Hence, as described above, the image forming apparatus 1000 conducts the first positional displacement correction control to reduce the position displacement amount so as to suppress deterioration in the detection accuracy of speed variation. Then, the image forming apparatus 1000 conducts the second positional displacement correction control to further accurately correct the position displacement amount.

When the first positional displacement correction control is finished, the driving of the photoreceptors 3Y, 3C, 3M, and 3K are stopped before the start of the speed variation detection control. At this time, the driving of the photoreceptors are stopped in accordance with the respective reference rotation phases, not the phases of speed variations before the dismount-and-mount operation.

Specifically, each of the process drive motors 120Y, 120C, 120M, and 120K each is stopped at a reference timing at which a certain time elapses after the detection of the mark 134 of each photoreceptor. Thus, the photoreceptors 3Y, 3C, 3M, and 3K are stopped so that the marks 134Y, 134C, 134M, and 134K have substantially identical rotational angles. Then, on executing the speed variation detection control, the rotations of the photoreceptors 3Y, 3C, 3M, and 3K are started from substantially identical mark positions.

For the speed variation detection control, the image forming apparatus 1000 forms one of the speed variation detection patterns P2*y*, P2*c*, and P2*m* for yellow, cyan, and magenta in combination with the speed variation detection pattern P2*k* for black. The image forming apparatus 1000 also simultaneously detects one of the speed variation detection patterns P2*y*, P2*c*, and P2*m* and the speed variation detection pattern P2*k*.

The image forming apparatus 1000 employs the above detection manner to accurately match a phase of a speed variation of one of the speed variation detection patterns P2*y*, P2*c*, and P2*m* with a phase of a speed variation of the speed variation detection pattern P2*k* based on the speed variation of the speed variation detection pattern P2*k*, which serves as a reference image carrier. Further, the image forming apparatus 1000 employs the above detection manner to certainly reduce undesirable effects of a speed variation component of the intermediate transfer belt 41.

Specifically, a detected speed variation includes a speed variation of the intermediate transfer belt 41 at a point facing the optical sensor unit 136, in addition to the speed variation of each photoreceptor. Thus, even if the toner images of the speed variation detection pattern P2 are arranged at a certain distance on the intermediate transfer belt 41, an error in detection time interval between each adjacent pair of the toner images may be caused corresponding to a change in the moving speed of the intermediate transfer belt 41 at the point facing the optical sensor unit 136.

Therefore, the simultaneous detection of the speed variation detection pattern P2*k* and one of the speed variation detection patterns P2*y*, P2*c*, and P2*m* is preferably performed to reduce the error in detection time interval.

Hence, the image forming apparatus 1000 according to the present example embodiment forms one of the speed variation detection patterns P2*y*, P2*c*, and P2*m* on a first lateral side, and the speed variation detection pattern P2*k* on a second lateral side. At this time, the formation of the speed variation detection pattern P2*k* is started based on the detection timing of the mark 134*k* of the photoreceptor 3*k*.

Further, the formation of one of the speed variation detection patterns P2*y*, P2*c*, and P2*m* is also started based on the detection timing of the mark 134*k*, not the corresponding one of the marks 134*y*, 134*c*, and 134*m*. Thereby, the ends of the speed variation detection pattern P2*k* are aligned with the ends of one of the speed variation detection patterns P2*y*, P2*c*, and P2*m* in the belt width direction.

Thus, a phase difference can be determined between the speed variation detected based on one of the speed variation detection patterns P2*y*, P2*c*, and P2*m* and the speed variation detected based on the speed variation detection pattern P2*k*. Therefore, if the relative rotation positions of the mark 134*k* and one of the marks 134*y*, 134*c*, and 134*m* are shifted by an amount corresponding to the phase difference, the speed variation phase of the mark 134*k* can be appropriately adjusted so as to match the speed variation phase of one of the marks 134*c*, 134*m*, and 134*k*.

In this regard, the rotation phases between the mark 134*k* and one of the marks 134*y*, 134*c*, and 134*m* are synchronized with each other before the speed variation detection control. Thus, the phase difference amount between the speed variations is adjusted so as to correspond with an appropriate phase difference amount between the mark 134*k* and one of the marks 134*y*, 134*c*, and 134*m*.

With the speed variation detection control as described above, the image forming apparatus 1000 can detect a phase difference between the speed variation detection pattern P2*k* and one of the speed variation detection patterns P2*y*, P2*c*, and P2*m* without referring to the detection timing of one of the marks 134*y*, 134*c*, and 134*m*.

However, the dismount-and-mount operation of the process unit 1 may increase the amount of superimposition displacement between toner images of different colors compared to before the dismount-and-mount operation. In such case, a detection result of the phase difference is unnecessarily shifted by the amount of the phase difference due to the dismount-and-mount operation of the process unit.

Hence, according to the present example embodiment, the image forming apparatus 1000 conducts the positional displacement correction control in advance of the speed variation detection control so as to in advance reduce the superimposition displacement amount between toner images of different colors.

Figure 18A:
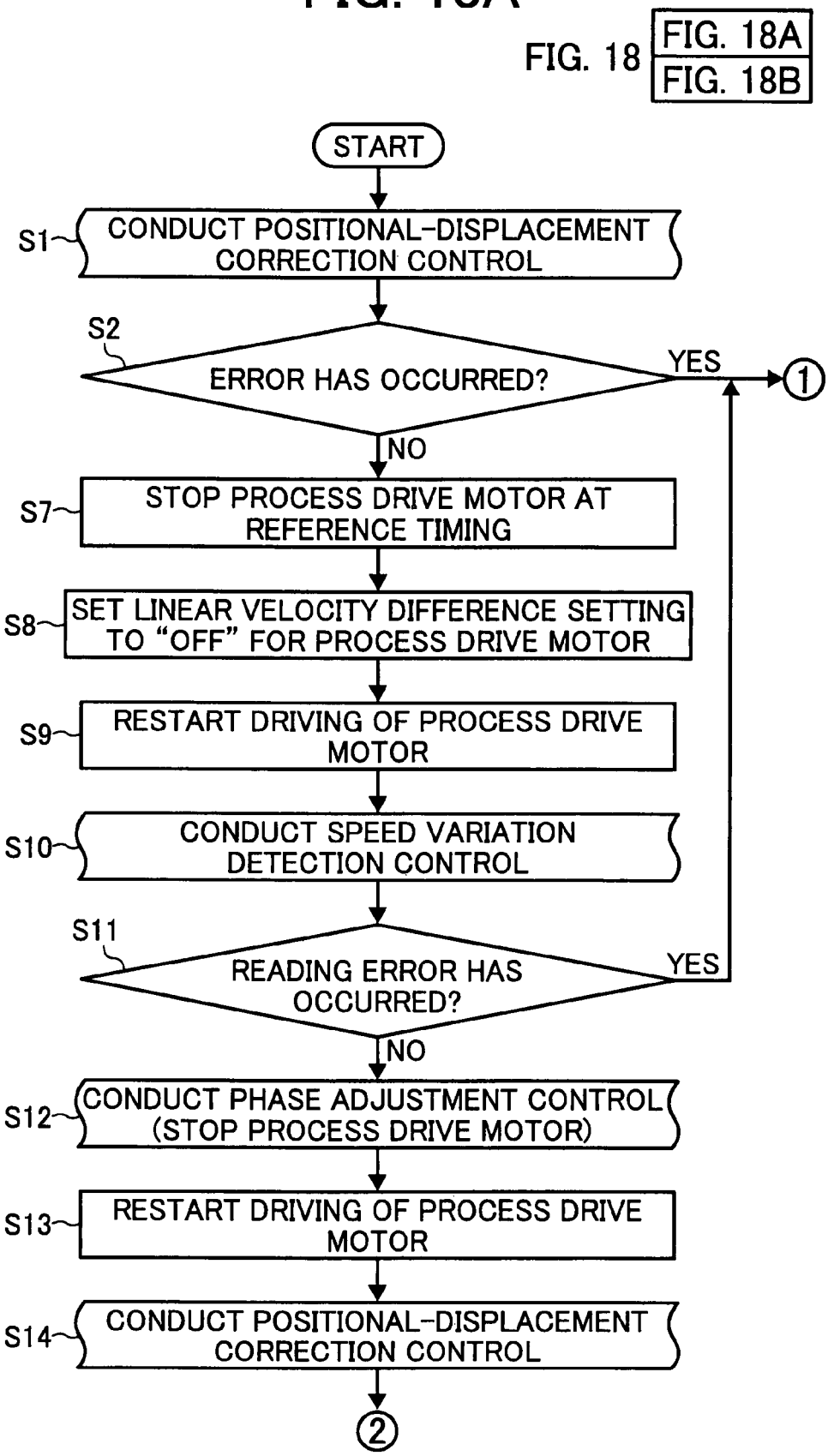
FIGS. 18A and 18B are flowcharts illustrating (according to an example embodiment of the present invention) a sequential control flow executed by the control unit of FIG. 12 after detection of a dismount-and-mount operation of a process unit and in advance of a print job.
Figure 18B:
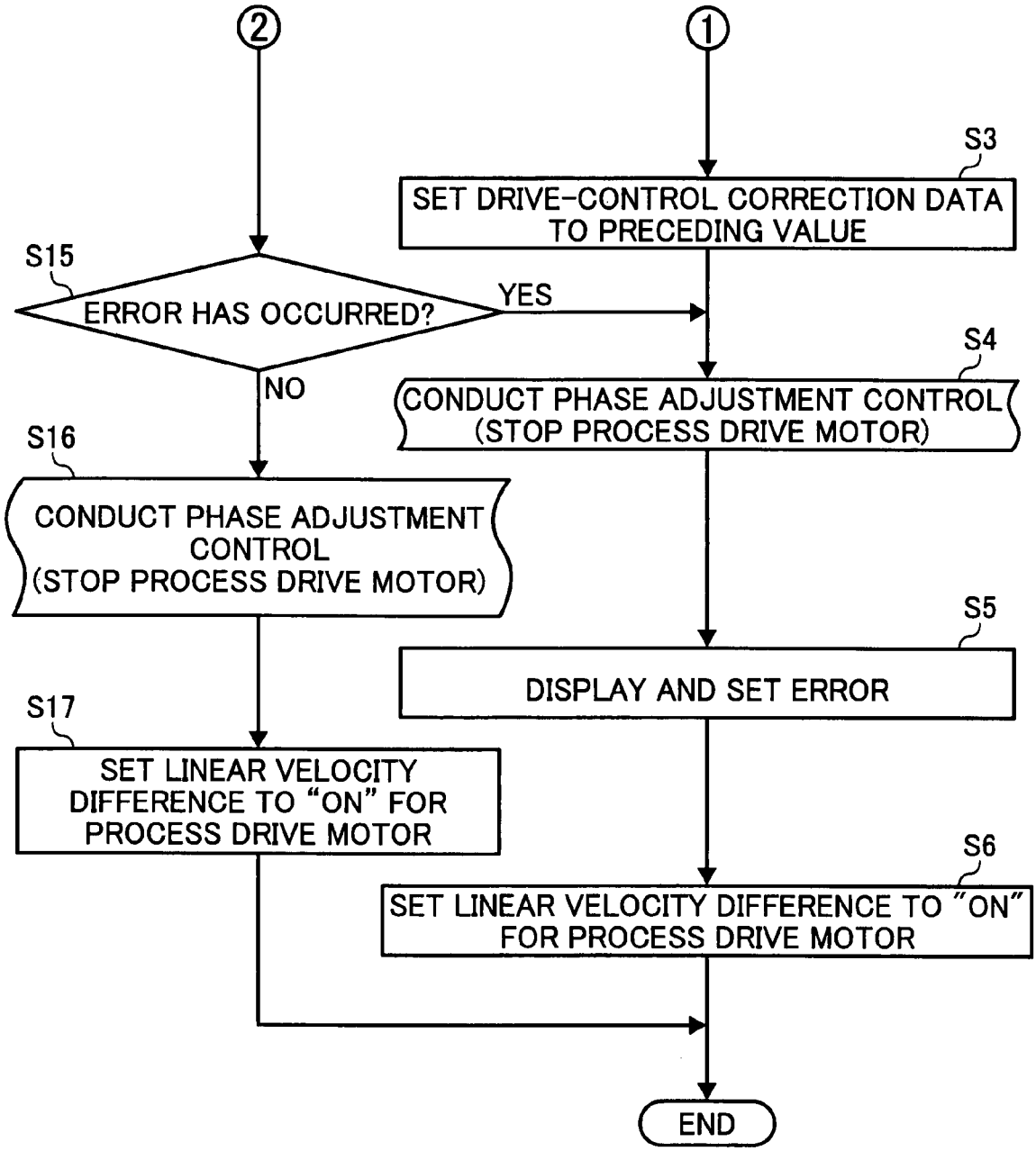

FIGS. 18A and 18B are flowcharts illustrating a sequential control flow executed by the control unit 1200 of the image forming apparatus 1000 according to the present example embodiment.

Once the dismount-and-mount operation is detected for the process unit 1, at step S1, the control unit 1200 conducts the positional displacement correction control Then, at step S2, the control unit 1200 determines whether or not an error has occurred in the position correction control of step S1.

If the control unit 1200 determines that an error has occurred ("YES" at step S2), at step S3, the control unit 1200 sets drive control correction data, which are used to adjust a phase of speed variation, to the data used in the immediately preceding dismount-and-mount operation. Further, at step S4, the control unit 1200 conducts the positional displacement correction control. At this time, the photoreceptors 3Y, 3C, 3M, and 3K are stopped so that the phases of speed variations thereof are synchronized with each other.

Then, at step S5, the control unit 1200 displays an error status on an operation display. At step S6, the control unit 1200 sets the linear velocity difference setting to "ON" for the process drive motors 120Y, 120C, 120M, and 120K. Thereby, in a subsequent print job, different linear velocities are set for the photoreceptors 3Y, 3C, 3M, and 3K so as to suppress a superimposition displacement of less than half a dot. Then, the control unit 1200 ends the sequential control flow.

Alternatively, if the control unit 1200 determines at step S2 that an error has not occurred ("No" at step S2), at step S7, the control unit 1200 stops the driving of each of the process drive motors 120Y, 120C, 120M, and 120K at a given reference timing at step S7. At this time, the photoreceptor gears 133Y, 133C, 133M, and 133K are stopped so that the marks 134Y, 134C, 134M, and 134K have substantially identical rotational positions.

Then, at step S8, the control unit 1200 sets the linear velocity difference setting to "OFF" for the process drive motors 120Y, 120C, 120M, and 120K.

Further, at step S9, the control unit 1200 restarts the driving of the process drive motors 120Y, 120C, 120M, and 120K. At step S10, the control unit 1200 conducts the speed variation detection control.

In the above control flow, at step S8, the control unit 1200 sets the linear velocity difference setting to "OFF" for the process drive motors 120Y, 120C, 120M, and 120K in advance of the speed variation detection control. Thereby, the photoreceptors 3Y, 3C, 3M, and 3K are driven at substantially identical speeds in the subsequent speed variation detection control and the second positional displacement correction control.

Thus, the image forming apparatus 1000 can suppress deterioration in the accuracy of the position displacement correction and the speed variation detection, which may be caused by setting different linear velocities for the photoreceptors 3Y, 3C, 3M, and 3K in the speed variation detection control.

When the speed variation detection control is finished, the control unit 1200 determines at step S11 whether or not an reading error has occurred. Here, if the control unit 1200 determines that an reading error has occurred ("YES" at step S11), the control unit 1200 conducts the above-described steps from steps S2 to S6. Then, the control unit 1200 ends the sequential control flow.

Alternatively, if the control unit 1200 determines at step S11 that an reading error has not occurred ("NO" at step S11), at step S12, the control unit 1200 conducts the phase adjustment control. At this time, based on a new set of drive control correction data, the control unit 1200 stops the photoreceptors 3Y, 3C, 3M, and 3K so that the speed variation phases thereof are synchronized with each other.

At step S13, the control unit 1200 restarts the driving of the process drive motors 120Y, 120C, 120M, and 120K. Then, at step S14, the control unit 1200 conducts the second positional displacement correction control.

In this regard, as described above, the dismount-and-mount operation of the process unit 1 may cause a change in the speed variation of the corresponding photoreceptor. The change in the speed variation may further cause an undesirable difference between the start timings of optical writing to respective photoreceptors. Hence, according to the present example embodiment, at step S14, the control unit 1200 corrects the undesirable difference through the second positional displacement correction control.

At step S15, the control unit 1200 determines whether or not an error has occurred. If the control unit 1200 determines that an error has occurred ("YES" at step S15), the control unit 1200 executes the above-described steps of steps S4 to S6. Then, the control unit ends the sequential control flow.

Alternatively, if the control unit 1200 determines at step S15 that an error has not occurred ("NO" at step S15), at step S16, the control unit 1200 stops the driving of the process drive motors 120Y, 120C, 120M, and 120K in the phase adjustment control. At step S17, the control unit 1200 sets the linear velocity difference setting to "ON" for the process drive motors 120Y, 120C, 120M, and 120K. Then, the control unit 1200 ends the sequential control flow.

In the above control flow, at step S8, the control unit 1200 sets the linear velocity difference setting to "OFF" for the process drive motors 120Y, 120C, 120M, and 120K. Thereby, in advance of the speed variation detection control of step S10, the driving of the process drive motors 120Y, 120C, 120M, and 120K are restarted at substantially identical speeds to each other. Thus, the image forming apparatus 1000 can suppress deterioration in the detection accuracy of speed variation that may be caused by setting a linear velocity difference between the photoreceptor 3K and one of the photoreceptors 3Y, 3C, and 3M immediately after the restart.

Specifically, as a first method to drive the process drive motors 120Y, 120C, 120M, and 120K at substantially identical speeds, the control unit 1200 may first drive the process drive motors 120Y, 120C, 120M, and 120K at different linear velocities each other, and then drive at substantially identical speeds.

As a second method to drive the process drive motors 120Y, 120C, 120M, and 120K at substantially identical speeds, the control unit 1200 may drive the process drive motors 120Y, 120C, 120M, and 120K at substantially identical speeds from the beginning of the restart.

However, for the first method, even if the photoreceptor gears 133Y, 133C, 133M, and 133K are stopped so that the marks 134Y, 134C, 134M, and 134K have substantially identical rotational angles, linear velocity differences between the photoreceptors 3Y, 3C, 3M, and 3K are set at the restart. Therefore, the speed variation detection patterns P2*y*, P2*c*, P2*m*, and P2*k* are formed under a condition where the rotational angles of the photoreceptor gears 133Y, 133C, 133M, and 133K are different from each other.

As described above, the image forming apparatus 1000 according to the present example embodiment forms one of the speed variation detection patterns P2*y*, P2*c*, and P2*m* in combination with the speed variation detection pattern P2*k* based on a detection timing of the mark 134*k*. For such configuration, the above-described difference in rotational angles between the photoreceptor gears 133Y, 133C, 133M, and 133K may cause a relative positional displacement between the speed variation detection pattern P2*k* and one of the speed variation detection patterns P2*y*, P2*c*, and P2*m*.

Here, the relative positional displacement is described below with reference to FIGS. 19 and 20. In the following description, the photoreceptor 3Y is referred to as representative of the three photoreceptors 3Y, 3C, and 3M.

Figure 19:
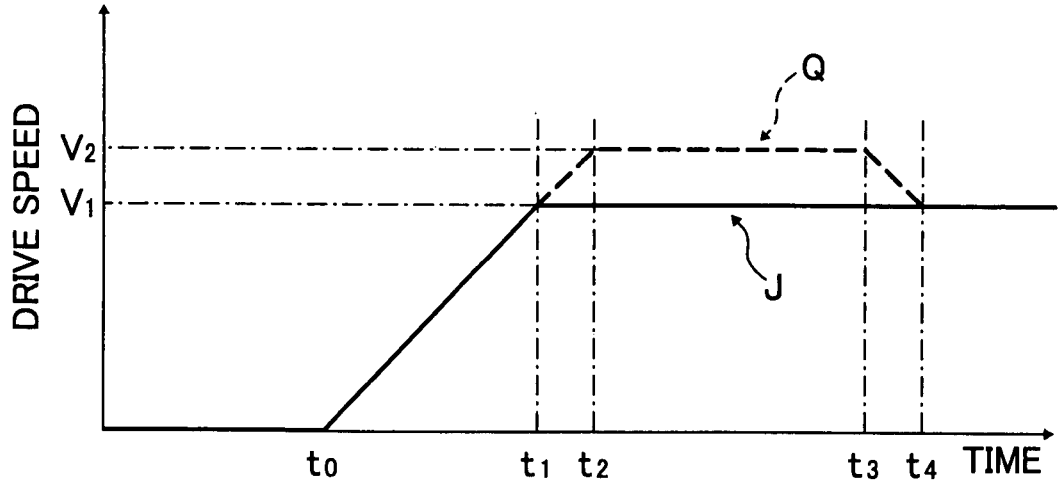
FIG. 19 is a graph illustrating (according to an example embodiment of the present invention) a rotation speed characteristic of a process drive motor at an initial period after starting the drive thereof.
Figure 20:
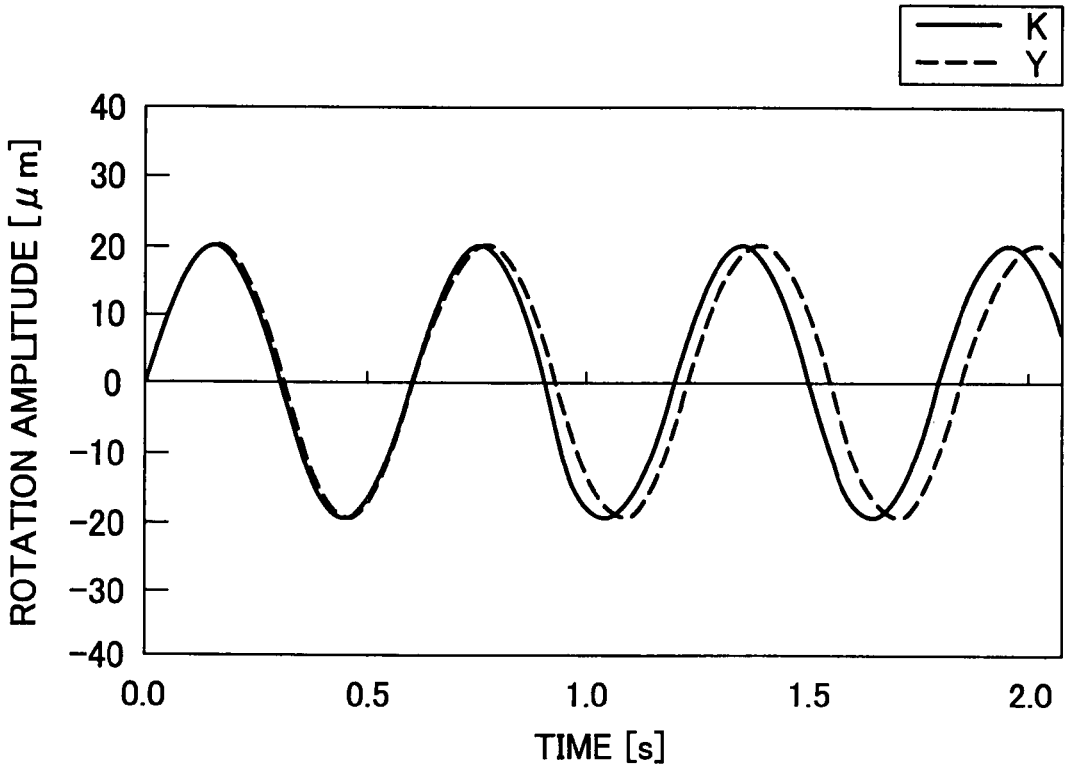
FIG. 20 is a graph illustrating (according to at least one example embodiment of the present invention) a rotational phase difference between photoreceptors for black and yellow.

For example, when the driving of the photoreceptor 3Y is started so that the photoreceptor 3Y may drive at a drive speed V1 similar to the photoreceptor 3K, the photoreceptor 3Y exhibits a speed characteristic as indicated by the solid line J in a graph of FIG. 19.

Specifically, after the drive of the photoreceptor 3Y is started at a time t0, the drive speed thereof reaches a first drive speed V1 at a time t1, and then is kept substantially at V1.

Alternatively, when the drive of the photoreceptor 3Y is started so that the photoreceptor 3Y may drive at a second drive speed V2 higher than the first drive speed V1 of the photoreceptor 3K, the drive speed of the photoreceptor 3Y reaches V2 at a time t2, and then is kept substantially at V2. In this regard, the time t2 is slightly later than the time t1 as illustrated in FIG. 19. Further, the drive speed of the photoreceptor 3Y starts to be decreased at a time t3, and then is kept substantially constant at V1 from a time t4.

Thus, from the time t1 to the time t4, the photoreceptors 3Y and 3K are driven at different speeds from each other. Therefore, during the time period, the rotation phase of the photoreceptor 3Y has a deviation from the rotation phase of the photoreceptor 3K as indicated by the dotted line Q in FIG. 20.

Such a deviation may deteriorate accuracy in detecting the speed variation of the photoreceptor 3Y. Hence, according to the present example embodiment, at step S8, the control unit 1200 sets the linear velocity difference setting to "OFF" for the process drive motor 120Y, and then starts the driving of the process drive motors 120Y and 120K at substantially identical speeds. With such driving manner, the image forming apparatus 1000 can suppress deterioration in the detection accuracy of speed variation, which may caused by setting a linear velocity difference between the photoreceptor 3Y and the photoreceptor 3K for a while after the restart.

As described above, the control unit 1200 conducts the positional displacement correction control at a given timing even while the dismount-and-mount operation of the process units 1 is not performed.

When the control unit 1200 conducts only the positional displacement correction control, the process drive motors 120Y and 120K are not necessarily needed to drive at substantially identical speeds. On the other hand, when the image forming apparatus 1000 forms or detects the positional displacement detection patterns P1, the process drive motors 120Y and 120K are preferably driven at substantially identical speeds.

The above description refers only to the relationship in drive speeds between the photoreceptors 3Y and 3K. Similarly, the above description can be applied to the relationship in drive speeds between the photoreceptor 3K and one of the photoreceptors 3C and 3M.

Next, other example embodiments of the present invention are described with reference to the drawings. Unless especially mentioned, the other example embodiments have substantially identical configurations to the above-described example embodiment.

Figure 21:
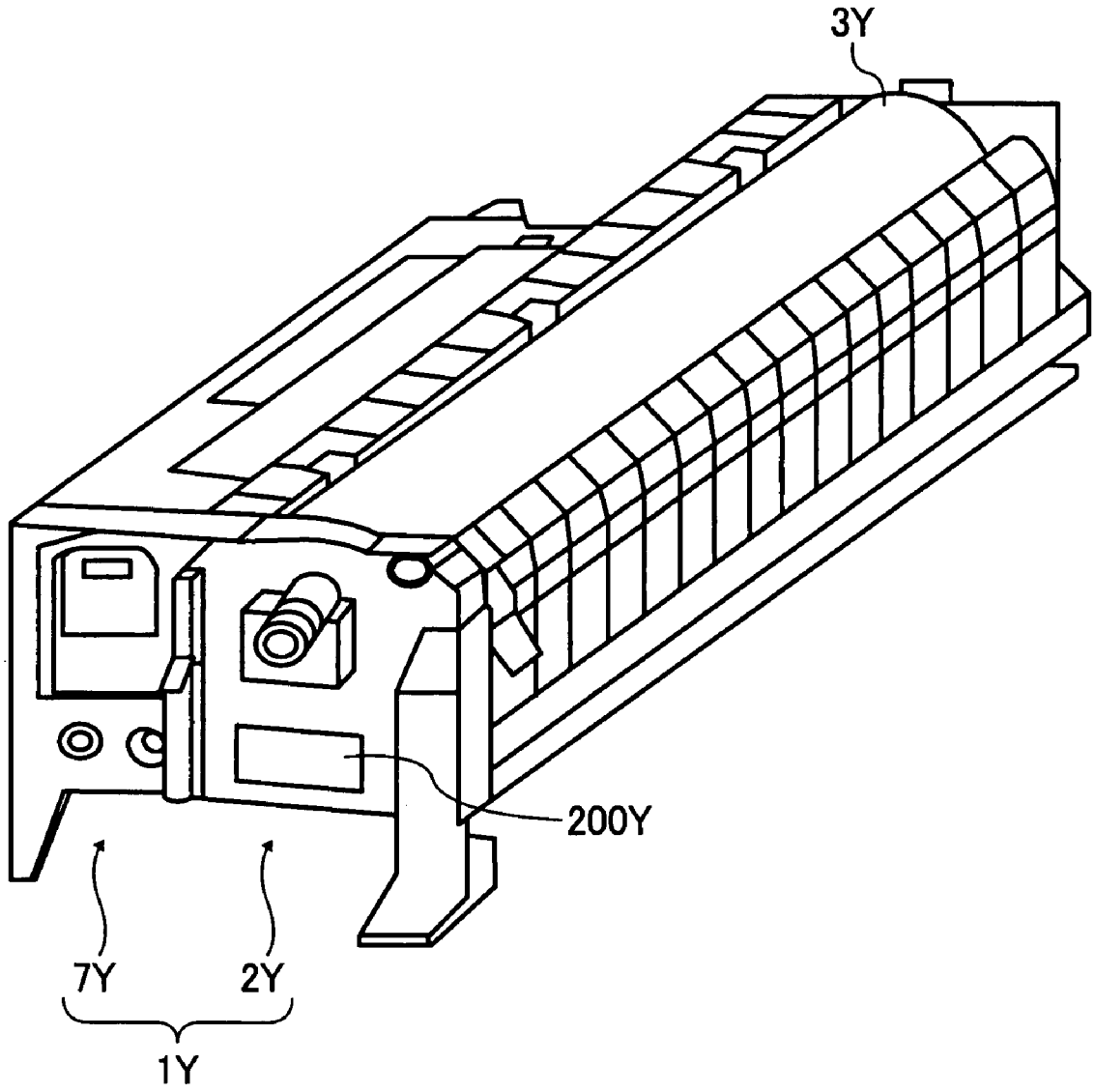
FIG. 21 is a perspective view illustrating a configuration of a process unit for yellow for use in an image forming apparatus according to another example embodiment of the present invention.

FIG. 21 is a perspective view illustrating a process unit 1Y for use in an image forming apparatus 1000 according to another example embodiment of the present invention. The process unit 1Y includes the photoreceptor unit 2Y. On a sidewall of the photoreceptor unit 2Y, an electronic circuit board 200Y is provided. An IC chip (not illustrated) is mounted on the electronic circuit board 200Y.

The IC chip on the electronic circuit board 200Y stores the data of unit ID number allocated for each product of the photoreceptor unit 2Y. When the process unit 1Y is mounted to the image forming apparatus 1000, the electronic circuit board 200Y is connected to a controller of the image forming apparatus 1000 via a contact point therebetween.

Through the connection, the electronic circuit board 200Y can communicate with the controller on the image forming apparatus 1000. The controller can also read the data of unit ID number stored in the IC chip on the electronic circuit board 200Y.

In the above-described state, the electronic circuit board 200Y continuously transmits, to the controller, a mount signal indicating that the process unit 1Y is mounted to the image forming apparatus 1000. When the receiving of the mount signal is temporarily stopped and then resumed, the controller determines that a demount-and-mount operation of the process unit 1Y has been performed.

In this regard, the demount-and mount operation refers to an operation in which the process unit 1Y is once demounted from and then mounted to the image forming apparatus 1000.

Thus, for the image forming apparatus 1000, the electronic circuit board 200Y, the controller on the image forming apparatus 1000, the contact point, etc. forms a dismount-and-mount detection mechanism for detecting the dismount-and-mount operation of the process unit 1Y.

When detecting the mounting of the process unit 1Y, the control unit 1200 of the image forming apparatus 1000 reads the data of unit ID number stored in the IC chip. Then, based on a reading result, the controller updates the data of unit ID number of the mounted process unit, which are stored in an RAM.

Before the update, the controller determines whether or not the read unit ID number and the stored unit ID number are identical. Then, if the two unit ID numbers are different, the controller determines that the replacement of the process unit 1Y has been performed.

Thus, the image forming apparatus 1000 employs the dismount-and-mount detection mechanism including the controller, etc. Thereby, for the dismount-and-mount operation of the process unit 1Y, the image forming apparatus 1000 can determine which of the replacement or re-mount of the process unit 1Y has been performed.

In the above description, the process unit 1Y is explained as representative. As described above, the process units 1Y, 1C, 1M, and 1K have substantially similar configuration except for toner colors. Thus, similarly, the controller can determine which of the replacement or the re-mount has been performed for each of the process units 1C, 1M, and 1K.

In this regard, for example, when the replacement of the process unit 1Y has been performed, the settings of imaging conditions such as development bias may become inappropriate regardless of whether the process unit 1Y mounted after the replacement is a new one or a used one. Then, if the positional displacement correction control or the speed variation detection control is conducted under such inappropriate imaging conditions, the positional displacement detection pattern P1 or the speed variation detection pattern P2 may be formed at an inappropriate density, thereby causing a detection error or an adjustment error.

Hence, when the image forming apparatus 1000 determines that the dismount-and-mount operation has been detected for one of the process units 1Y, 1C, 1M, and 1K, and the dismount-and-mount operation has been performed for the replacement, the image forming apparatus 1000 in advance conducts an imaging-condition adjustment control to set appropriate imaging conditions for the process unit 1Y mounted after the replacement, and then conducts the positional displacement correction control or the speed variation detection control.

However, when the image forming apparatus 1000 determines that the dismount-and-mount operation has been performed for the re-mount of the process unit 1Y after a temporal dismount, the image forming apparatus 1000 conducts the positional displacement correction control or the speed variation detection control without in advance conducting the imaging-condition adjustment control. The imaging-condition adjustment control is not conducted in advance because the appropriate value of imaging condition is not so significantly changed by the re-mount operation.

Figure 22A:
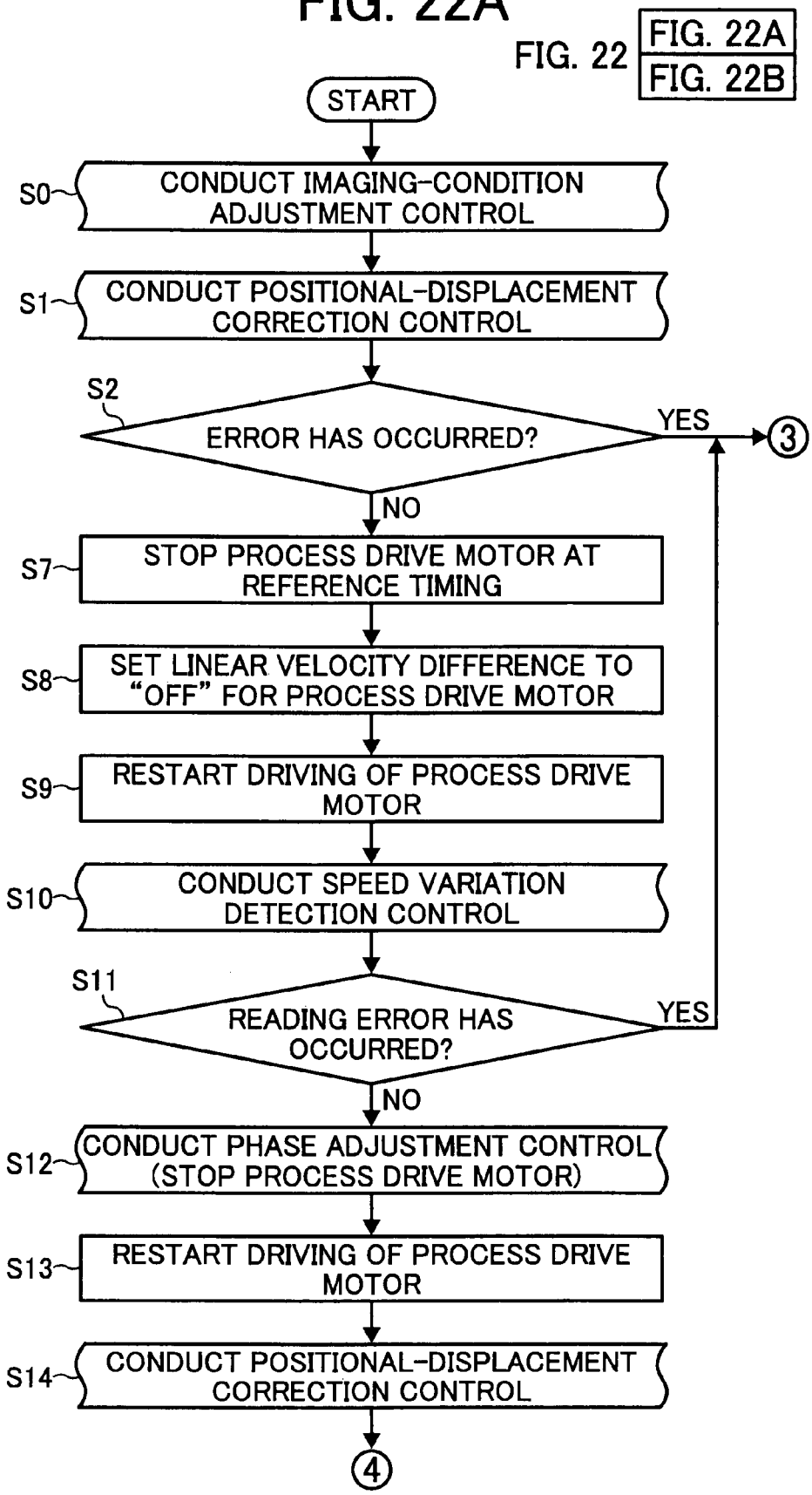
FIGS. 22A and 22B are flowcharts illustrating a sequential control flow executed by a control unit of an image forming apparatus according to another example embodiment of the present invention after the detection of a replacement operation of a process unit.
Figure 22B:
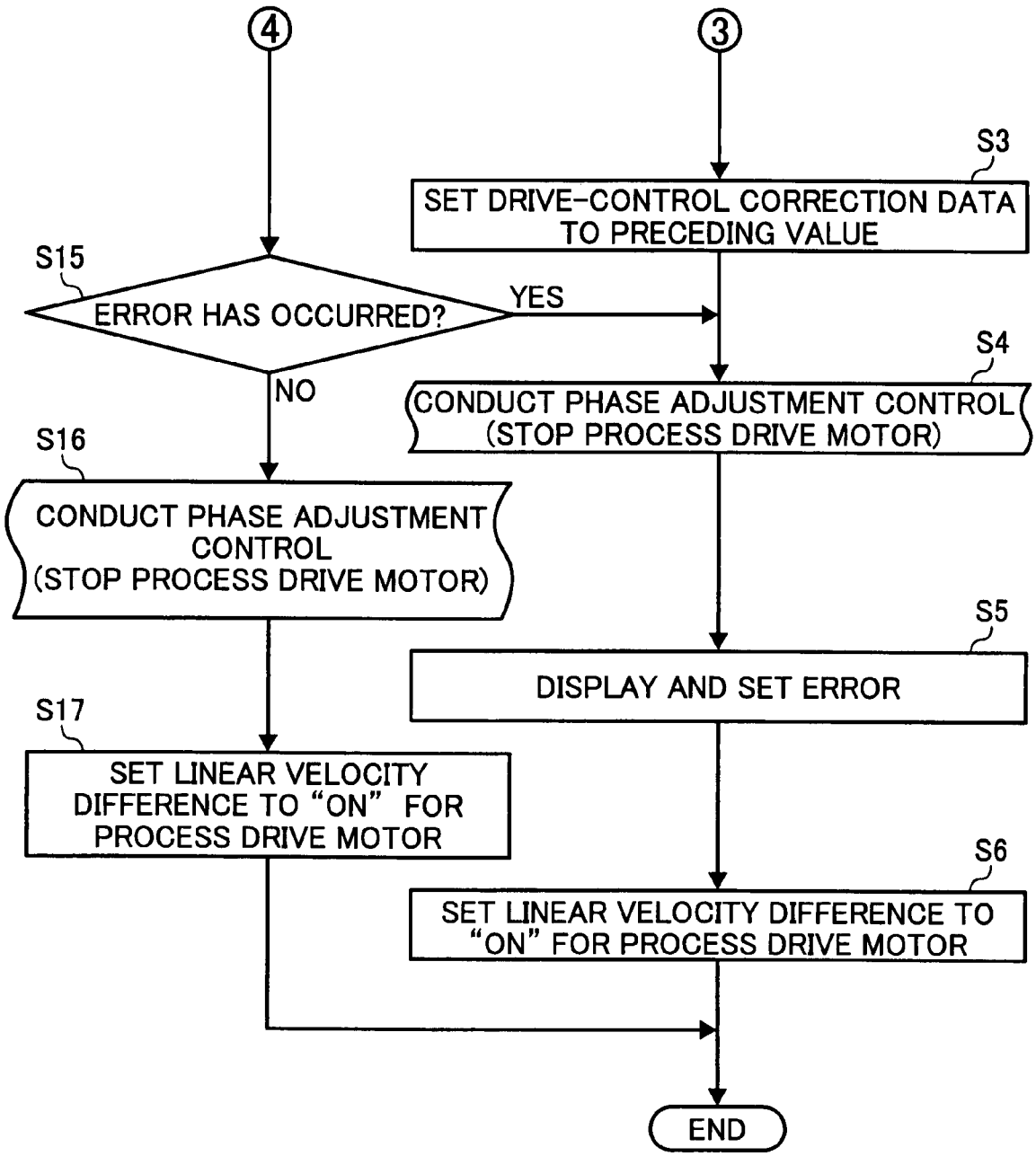

FIG. 22A and FIG. 22B are flowcharts illustrating a sequential control flow executed by a control unit 1200 of an image forming apparatus 1000 according to another example embodiment of the present invention. Similar to the above description, the control flow is executed after the dismount-and-mount operation is detected for any one of the process units 1Y, 1C, 1M, and 1K.

The control flow of FIGS. 22A and 22B is different from the control flow of FIGS. 18A and 18B in that, at step S0, the imaging-condition adjustment control is conducted in advance of the positional displacement correction control or the phase adjustment control.

Such a control flow can suppress a detection or adjustment error of the positional displacement detection pattern P1 or the speed variation detection pattern P2, which may be caused by conducting the positional displacement correction control or the phase adjustment control under an inappropriate imaging condition after the replacement of the process unit 1.

For the imaging-condition adjustment control, the image forming apparatus 1000 forms yellow, cyan, magenta, and black gradation patterns on the photoreceptors 3Y, 3C, 3M, and 3K corresponding to the process units 1Y, 1C, 1M, and 1K, respectively. Then, the image forming apparatus 1000 transfers the yellow, cyan, magenta, and black gradation patterns to the intermediate transfer belt 41.

The yellow, cyan, magenta, and black gradation patterns each includes a plurality of reference toner images. The reference toner images of each gradation pattern are different from each other in toner amount per unit area.

Specifically, the image forming apparatus 1000 forms, on the intermediate transfer belt 41, the yellow gradation pattern including a plurality of yellow reference toner images, the cyan gradation pattern including a plurality of cyan reference toner images, and the magenta gradation pattern including a plurality of magenta reference toner images. At this time, the yellow, cyan, and magenta gradation patterns each is formed so that the plurality of reference toner images are arranged along the moving direction of the intermediate transfer belt 41.

For the imaging-condition adjustment control, various imaging conditions such as development bias are adjusted based on detection results of the gradation patterns by the optical sensor unit 136.

The processing executed in the imaging-condition adjustment control are classified into three types: Vsg adjustment processing, potential setting adjustment processing, and halftone gamma correction processing.

For the Vsg adjustment processing, the optical sensor unit 136 detects an area where toner is not transferred on the intermediate transfer belt 41, and outputs a voltage value for the area. The control unit 1200 controls the light intensity emitted from the light-emitting element of the optical sensor unit 136 so that the voltage value becomes a given value, for example, 4.0V±0.2V.

For the potential setting adjustment processing, the optical sensor unit 136 detects reference toner images of each gradation pattern formed on the intermediate transfer belt 41. The controller calculates an appropriate value for development gamma based on a voltage value that is output from the optical sensor unit 136 corresponding to the reference toner image.

Based on calculation results, the control unit 1200 determines and sets an electric potential for uniformly charging the corresponding photoreceptor, a development bias, an optical writing intensity to obtain a desired image density.

For the halftone gamma correction processing, the control unit 1200 calculates a difference between a voltage value being output from the optical sensor unit 136 corresponding to the reference toner image and a target value determined by a desired gradation property. Based on the difference, the control unit 1200 corrects a writing gamma so as to obtain the desired gradation property.

The writing gamma is a setting value of optical writing intensity for the gradation pattern of each color. The development gamma is an inclination of a graph representing a relationship between development potential and attached toner amount per unit area. Further, the development potential is a difference in electronic potential between an electrostatic latent image formed on the surface of photoreceptor and the surface of development sleeve to which a development bias is applied.

FIGS. 23 to 27 are flowcharts illustrating a sequential control flow executed by a control unit 1200 of an image forming apparatus 1000 according to another example embodiment. The control flow illustrated in FIGS. 23 to 27 is executed after the replacement of one of the process units 1Y, 1C, 1M, and 1K is detected.

For the control flow, the control unit 1200 separately conducts the speed variation detection controls for yellow, cyan, and magenta. After finishing one of the positional displacement correction control and the speed variation detection controls for yellow, cyan, and magenta, the control unit 1200 temporarily stops and then restarts the process drive motors 120Y, 120C, 120M, and 120K.

In this regard, the control unit 1200 restarts the process drive motors 120Y, 120C, 120M, and 120K with the setting of linear velocity difference to "OFF". In other words, the control unit 1200 restarts the process drive motors 120Y, 120C, 120M, and 120K so as to drive at substantially identical speeds to each other.

For the speed variation detection control, the image forming apparatus 1000 detects a difference in speed variations between the photoreceptor 3*k* and one of the photoreceptors 3Y, 3C, and 3M.

Figure 23:
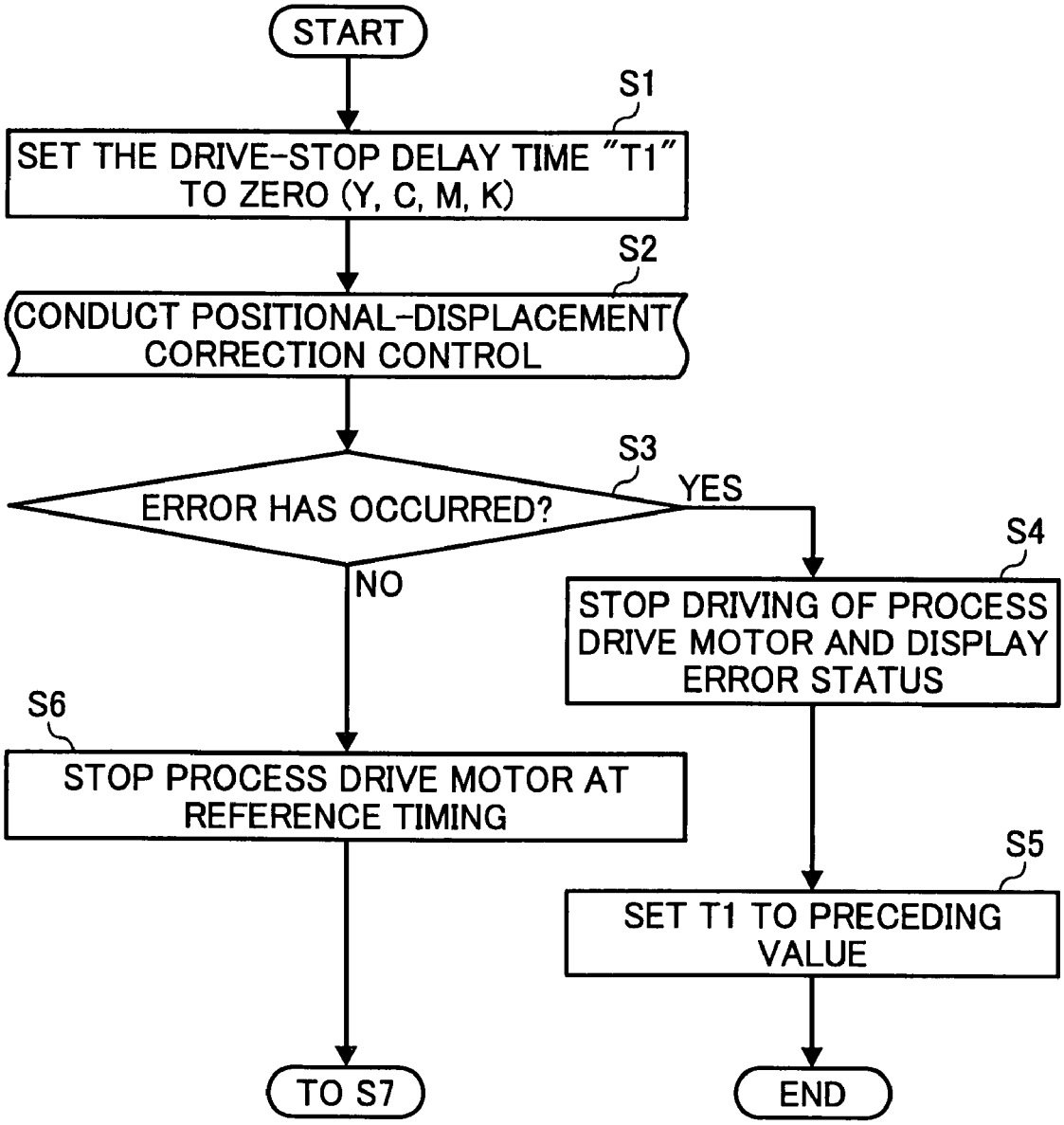
FIGS. 23 to 27 are flowcharts illustrating first to fifth stages of a sequential control flow executed by a control unit of an image forming apparatus according to another example embodiment of the present invention after detection of a dismount-and-mount operation of a process unit.

As illustrated in FIG. 23, when a dismount-and-mount operation is detected for one of the process units 1Y, 1C, 1M, and 1K, the control unit first sets a drive-stop delay time T1 to zero at step S1. The drive-stop delay time T1 is a time by which the drive-stop of each of the process drive motors 120Y, 120C, 120M, and 120K is delayed from a corresponding reference timing. Thus, each process drive motor is stopped at the corresponding reference timing.

After setting the drive-stop delay time T1 to zero, at step S2, the control unit 1200 conducts the positional displacement correction control. Then, at step S3, the control unit 1200 determines whether or not an error has occurred in the positional displacement correction control of step S2.

If the control unit determines that an error has occurred ("YES" at step S3), at step S4, the control unit 1200 stops the driving of the process drive motors 120Y, 120C, 120M, and 120K, and displays an error status on an operation display. Then, at step S5, the control unit 1200 sets T1 to the value used in the immediately preceding iteration. Then, the control unit ends the sequential control flow.

Figure 24:
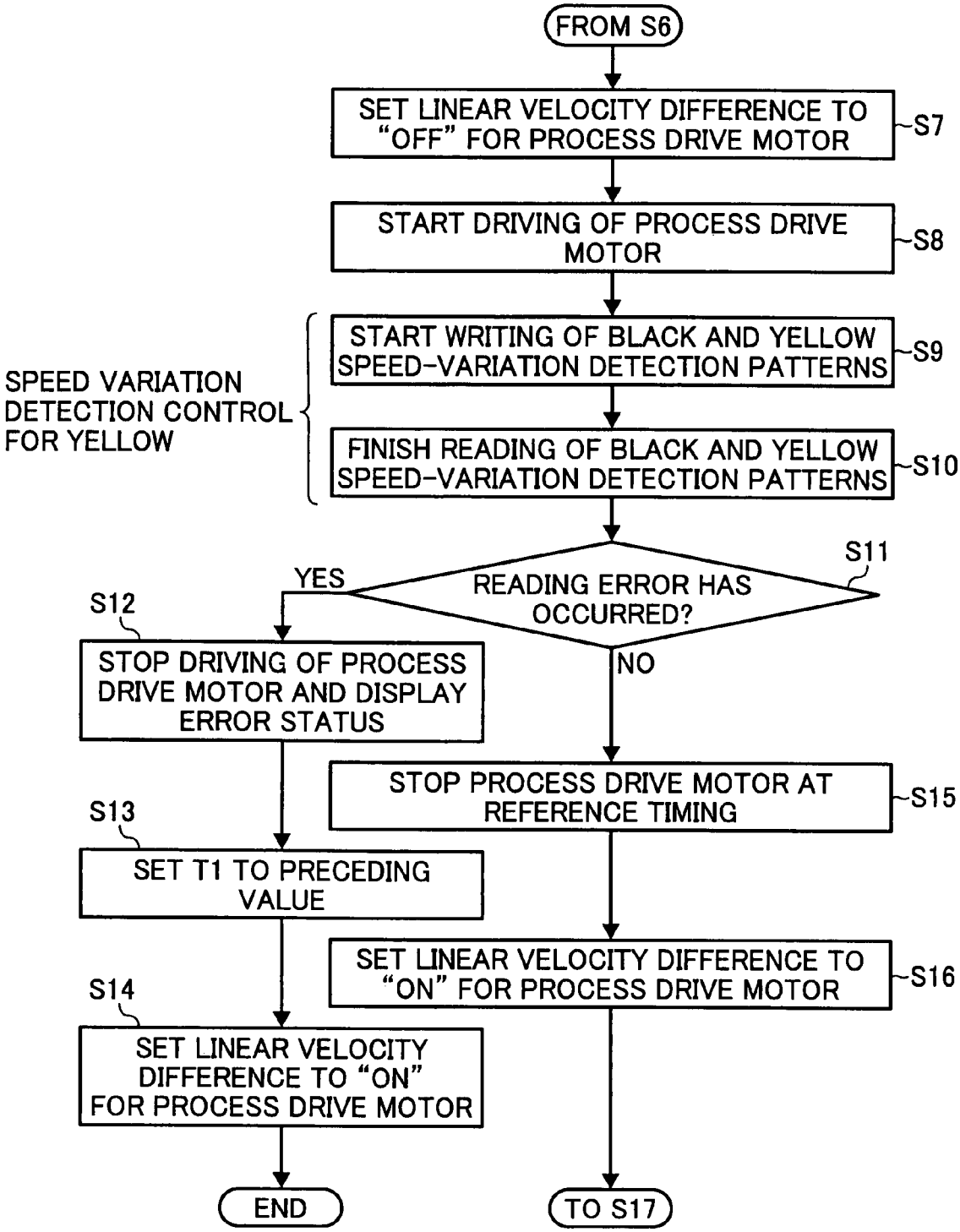

Alternatively, if the control unit determines that an error has not occurred ("NO" at step S3), at step S6, the control unit 1200 stops the process drive motors 120Y, 120C, 120M, and 120K at the corresponding reference timings. Then, a subsequent control flow of step S7 or later is executed as illustrated in FIG. 24.

After stopping the process drive motors 120Y, 120C, 120M, and 120K at the respective reference timings, at step S7, the control unit 1200 sets the linear velocity difference setting to "OFF" for each process drive motor. Then, at step S8, the driving of each process drive motor is started.

When the driving of each process drive motor is started with the linear velocity difference setting being set "OFF" as described above, phase difference in speed variations between the process drive motors 120Y, 120C, 120M, and 120K represents a reference phase difference generated when the driving of the process drive motors 120Y, 120C, 120M, and 120K are stopped at the respective reference timings.

On the other hand, as described above, the control unit may start the driving of the process drive motors 120Y, 120C, 120M, and 120K with the linear velocity difference setting being set "ON" and then may set the linear velocity difference setting to "OFF" for each process drive motor. In such case, a phase difference in speed variations between the process drive motors 120Y, 120C, 120M, and 120K is further deviated from the reference phase difference in a period from the drive start to the set-off of the linear velocity difference setting.

Thereby, deterioration may be caused in the accuracy of the positional displacement correction or the speed variation detection.

After starting the driving of the process drive motors 120Y, 120C, 120M, and 120K with the linear velocity difference setting being set "OFF", the control unit 1200 conducts the speed variation detection control for yellow to form and read the speed variation detection patterns P2 *k* and P2 *y* of black and yellow at steps S9 and S10, respectively.

Then, at step S11, the control unit 1200 determines whether or not an error has occurred in the reading of the speed variation detection patterns P2 *k* and P2 *y*. If the control unit determines that an error has occurred ("YES" at step S11), at step S12, the control unit stops the driving of the process drive motors 120Y, 120C, 120M, and 120K, and displays an error status on the operation display.

Then, at step S13, the control unit 1200 sets the drive-stop delay time T1 to the value used in the immediately preceding iteration. At S14, the control unit 1200 sets the linear difference setting to "ON" for each process drive motor. Thus, the control unit 1200 ends the sequential control flow.

Alternatively, if the control unit 1200 determines that an error has not occurred ("NO" at step S11), at step S15, the control unit 1200 stops the process drive motors 120Y, 120C, 120M, and 120K at the respective reference timings. At S16, the control unit 1200 sets the linear velocity difference setting to "ON" for each process drive motor. Then, a subsequent control flow of step S17 or later is executed as illustrated in FIG. 25.

Figure 25:
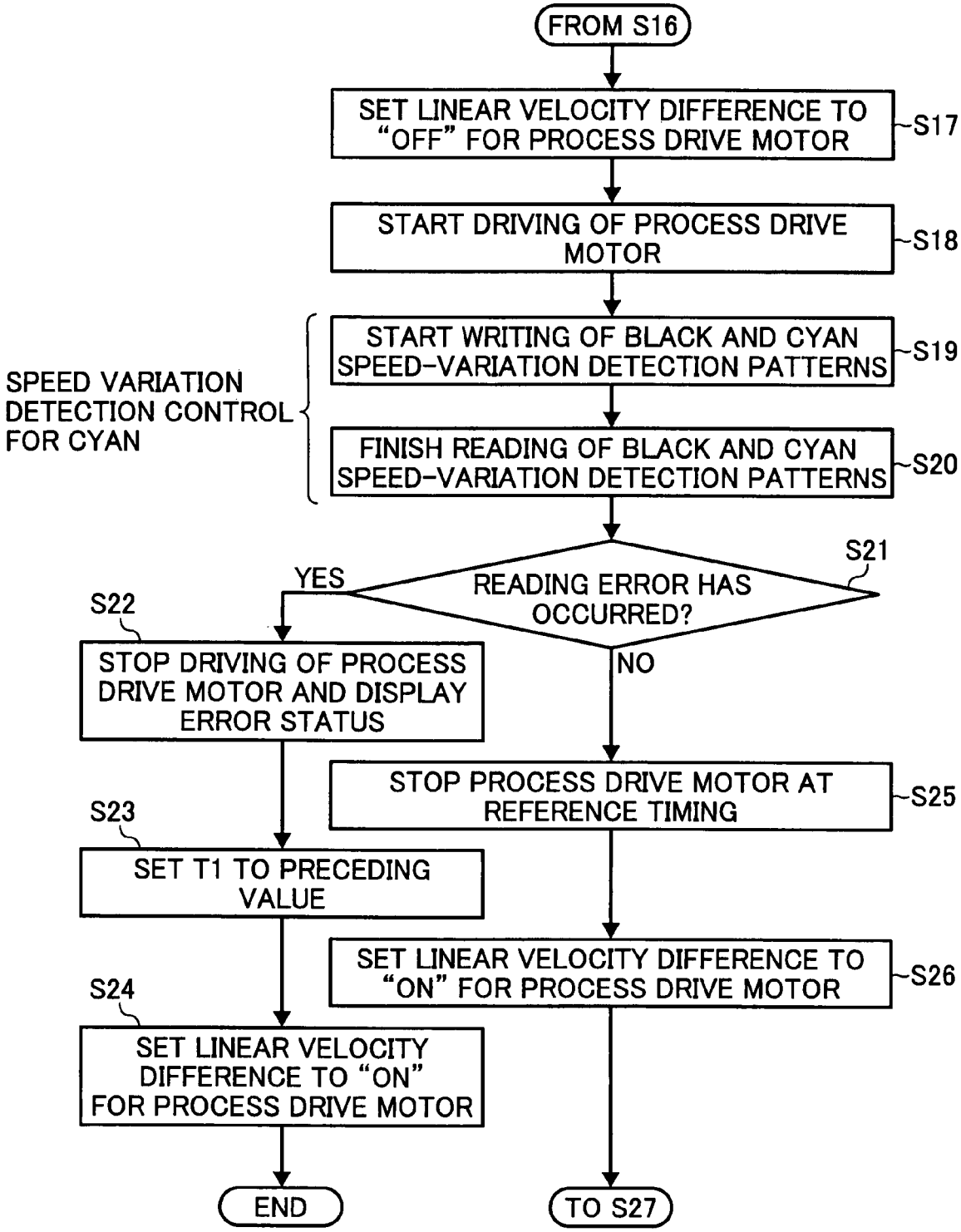

As illustrated in FIG. 25, the control flow from steps S17 to S26 is identical to the control flow in FIG. 24 except that, at steps S19 and S20, the speed variation detection control for cyan is conducted instead of the speed variation detection control for yellow.

Figure 26:
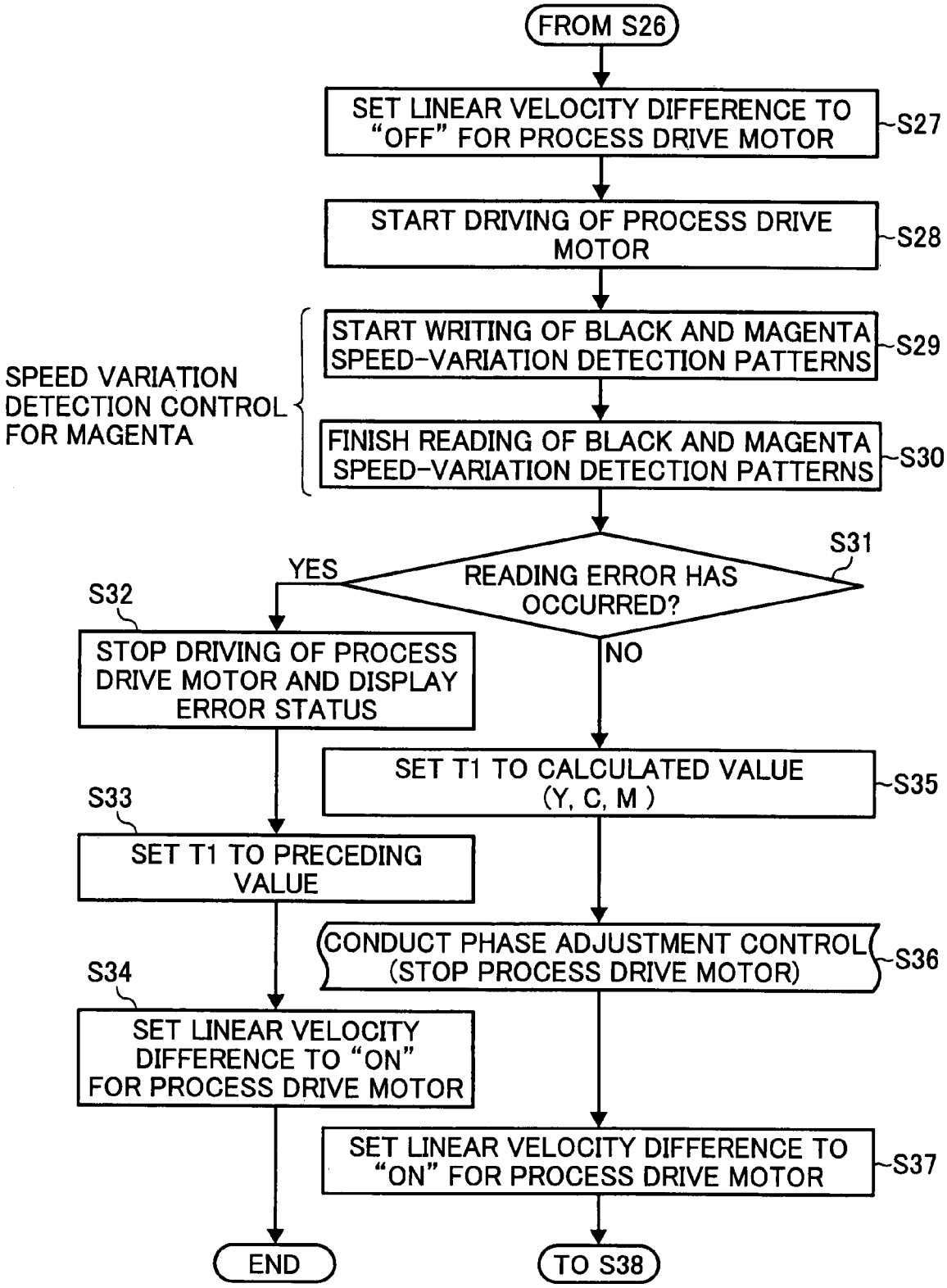

Further, as illustrated in FIG. 26, the control flow from steps S27 to S34 is identical to the control flow from steps S7 to S14 in FIG. 24 except that, at steps S29 and S30, the speed variation detection control for magenta is conducted instead of the speed variation detection control for yellow.

After the termination of the speed variation detection control for magenta, if the control unit 1200 determines that an error has not occurred ("NO" at step S31), at step S35, the drive-stop delay times T1 for the process drive motors 120Y, 120C, and 120M are set to values calculated in the speed variation detection controls for yellow, cyan, and magenta, respectively.

At S36, the control unit 1200 conducts the phase adjustment control and then stops the process drive motors 120Y, 120C, 120M, and 120K so that the phases of speed variation thereof are appropriately adjusted to each other. At S37, the controls section 1200 sets the linear velocity difference setting to "ON" for each process drive motor. Then, a subsequent control flow of step S38 or later is executed as illustrated as in FIG. 27.

Figure 27:
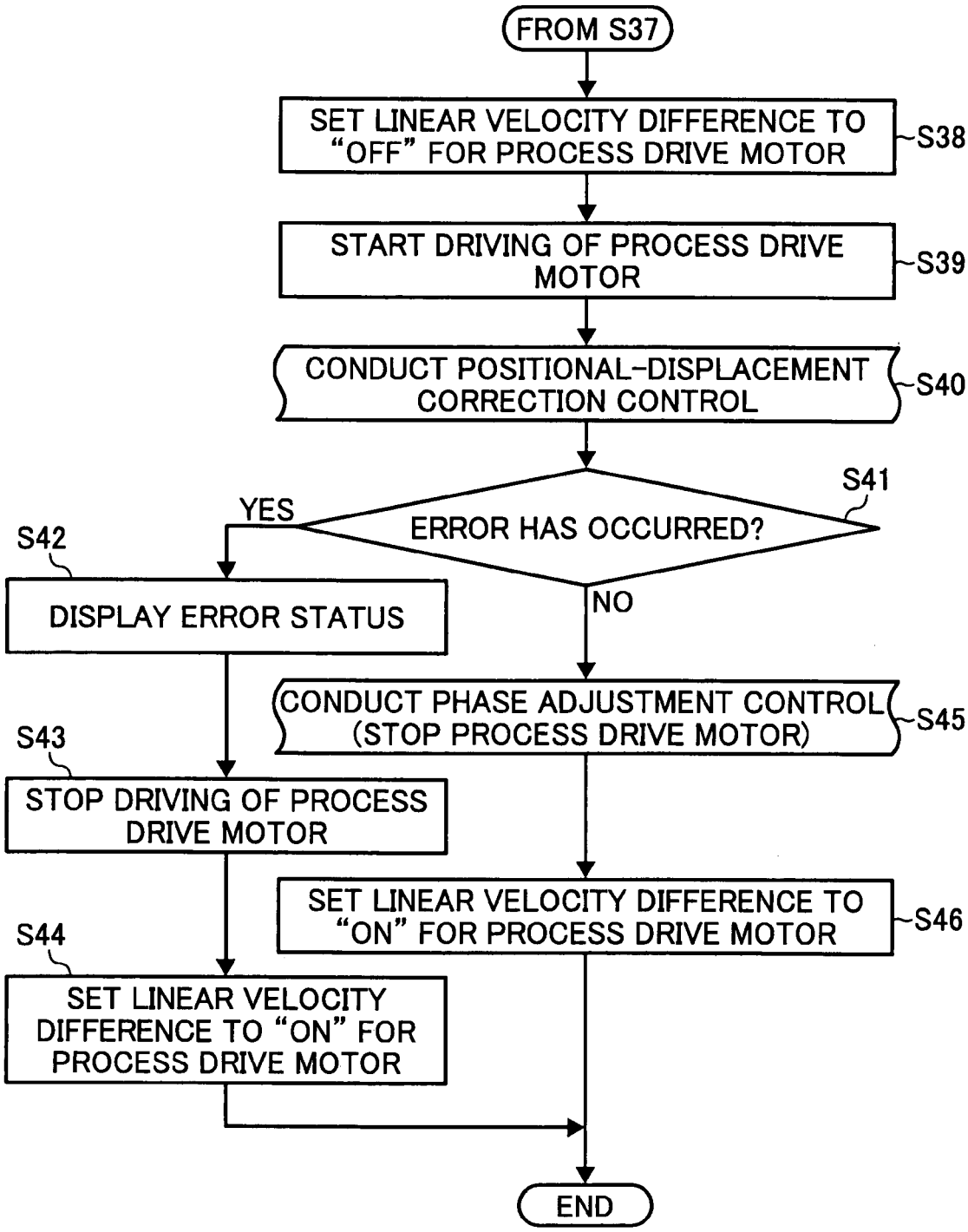

As illustrated in FIG. 27, in the control flow of step S38 or later, first, the control unit 1200 sets the linear velocity difference setting to "OFF" at step S38. Then, at step S39, the control unit 1200 stops the process drive motors 120Y, 120C, 120M, and 120K. Further, at step S40, the control unit 1200 conducts the positional displacement correction control. Then, at step S41, the control unit 1200 determines whether or not an error has occurred in the positional displacement correction control of step S40.

If the control unit 1200 determines that an error has occurred ("YES" at step S41), at step S42, the control unit 1200 displays an error status on the operation display. Then, at step S43, the control unit 1200 stops the driving of the process drive motors 120Y, 120C, 120M, and 120K. Further, at step S44, the control unit 1200 sets the linear velocity difference setting to "ON" for each process drive motor. Then, the control unit 1200 ends the sequential control flow.

Alternatively, if the control unit 1200 determines that an error has not occurred ("NO" at step S41), at step S45, the control unit 1200 stops the driving of the process drive motors 120Y, 120C, 120M, and 120K so that the phases of speed variations thereof are appropriately adjusted to each other. At S46, the control unit 1200 sets the linear velocity difference setting to "ON". Then, the control unit 1200 ends the sequential control flow.

With the above configuration, on conducting the positional displacement correction control or the speed variation detection control, the image forming apparatus 1000 starts the driving of the process drive motors 120Y, 120C, 120M, and 120K with the linear velocity difference being set "OFF". In other words, the control unit 1200 starts the driving of the process drive motors 120Y, 120C, 120M, and 120K at substantially identical speeds to each other.

Thereby, the control unit 1200 can effectively suppress deterioration in the accuracy of the positional displacement correction or the speed variation detection, which may be caused by setting the linear velocity difference setting to "OFF" for each process drive motor after starting the driving thereof with the linear velocity difference setting to "ON".

Figure 28:
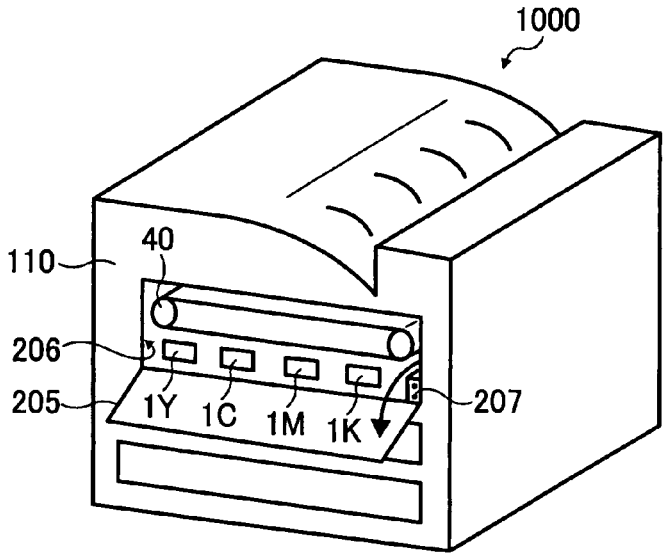
FIG. 28 is a perspective view illustrating an image forming apparatus according to another example embodiment of the present invention.

FIG. 28 is a perspective view illustrating an image forming apparatus 1000 according to another example embodiment of the present invention.

As illustrated in FIG. 28, the image forming apparatus 1000 includes a front door 205, an opening 206, and an open-and-close detection switch 207.

The front door 205 is provided at a front wall 110 of the image forming apparatus 1000. The front door 205 is pivotally openable and closable relative to the front wall 110 of the image forming apparatus 1000.

The opening 206 is provided at the front wall 110 so as to be used in a maintenance operation of the image forming apparatus 1000. When the front door 205 is opened, the opening 206 is exposed to the exterior of the image forming apparatus 1000. When the opening 206 is opened as illustrated in FIG. 28, the transfer unit 40 and the process units 1Y, 1C, 1M, and 1K are exposed to the exterior of the image forming apparatus 1000.

For the maintenance operation, an operator slides the transfer unit 40 or the process units 1Y, 1C, 1M, and 1K toward the front side or the rear side of the image forming apparatus 1000. Thereby, the operator can pull the transfer unit 40 or the process units 1Y, 1C, 1M, and 1K out of or into the image forming apparatus 1000.

The open-and-close detection switch 207 is provided near a lower corner of the opening 206. The open-and-close detection switch 207 detects the open-and-close operation of the front door 205. In the image forming apparatus 1000, the open-and-close detection switch 207 is provided in consideration of safety so as to be capable of automatically terminating an image forming operation when the front door 205 is opened during the operation.

The image forming apparatus 1000 indirectly detects a dismount-and-mount operation of the process drive motors 120Y, 120C, 120M, and 120K relative to the image forming apparatus 1000 based on a detection result by the open-and-close detection switch 207, rather than directly detects the dismount-and-mount operation.

Specifically, when the open-and-close detection switch 207 detects an open operation of the front door 205 and then a close operation thereof, the control unit 1200 determines that a dismount-and-mount operation has been performed for at least one of the process units 1Y, 1C, 1M, and 1K.

Thus, the image forming apparatus 1000 indirectly detects a dismount-and-mount operation of the process units 1Y, 1C, 1M, and 1K based on a detection result by the open-and-close detection switch 207. Therefore, the image forming apparatus 1000 does not necessarily need to be provided with respective sensors for separately detecting dismount-and-mount operations of the process units 1Y, 1C, 1M, and 1K. Accordingly, the manufacturing cost of the image forming apparatus 1000 can be reduced.

In the above description, the image forming apparatus 1000 employs an indirect transfer method in which toner images of different colors formed on the photoreceptors 3Y, 3C, 3M, and 3K are first transferred to the intermediate transfer belt 41, and then are collectively transferred to a recording medium.

Alternatively, the image forming apparatus 1000 may employ a direct transfer method in which toner images of different colors formed on the photoreceptors 3Y, 3C, 3M, and 3K are directly transferred in a superimposing manner to a recording medium carried on a sheet conveyance belt, which serves as a transfer member. In such case, for the positional displacement correction control or the speed variation detection control, the image forming apparatus 1000 may detect the toner images of different colors transferred on the sheet conveyance belt by an optical sensor unit.

Figure 29:
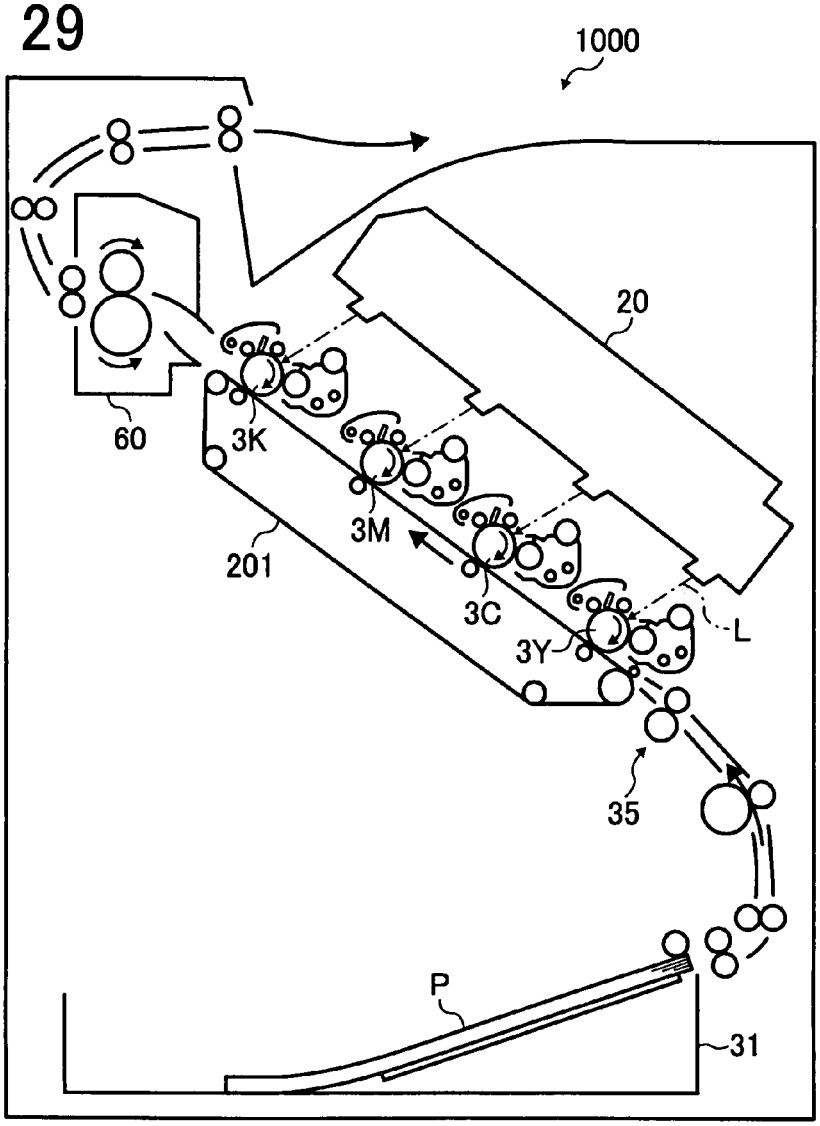
FIG. 29 is a schematic view illustrating a configuration of an image forming apparatus according to another example embodiment of the present invention.

For example, the image forming apparatus 1000 as illustrated in FIG. 29 is configured to form toner images of yellow, cyan, magenta, and black colors on the photoreceptors 3Y, 3C, 3M, and 3K, and directly transfer the toner images in a superimposing manner to a recording sheet P being carried on the surface of the sheet conveyance belt 201.

With such configuration, the image forming apparatus 1000 can also conduct the positional displacement correction control or the speed variation detection control by transferring the positional displacement detection pattern P1or the speed variation detection pattern P2 from the photoreceptors 3Y, 3C, 3M, and 3K to the sheet conveyance belt 201.

Next, an image forming apparatus 1000 according to another example embodiment is described.

A control unit 1200 for use in the image forming apparatus 1000 conducts the positional displacement correction control during the execution of an continuous print operation. Specifically, while the image forming apparatus 1000 is executing an continuous print operation for printing an image on a plurality of recording sheets P, the control unit 1200 temporarily stops the continuous print operation at a timing where the number of print jobs reaches a given number, and then conducts only the positional displacement correction control.

After finishing the positional displacement correction control, the control unit 1200 restarts the continuous print operation while continuously driving the process drive motors 120Y, 120C, 120M, and 120K. In this regard, preferably, the control unit 1200 appropriately adjusts the phases of speed variations between the photoreceptors 3Y, 3C, 3M, and 3K in advance of the continuous print operation. Further, the control unit 1200 preferably sets the linear velocity difference setting to "ON" for the photoreceptors 3Y, 3C, 3M, and 3K.

Hence, the control unit 1200 conducts a phase adjustment control for continuous operation, which is different from the phase adjustment control conducted in the above-described control flow. Specifically, the control unit 1200 determines rotational angles of the photoreceptors 3Y, 3C, 3M, and 3K based on detection timings of the marks 134Y, 134C, 134M, and 134K, which are provided on the photoreceptor gears 133Y, 133C, 133M, and 133K, respectively. At this time, the control unit 1200 finely changes the driving speeds of the photoreceptors 3Y, 3C, 3M, and 3K so that the phases of speed variations thereof are appropriately adjusted to each other.

After finishing the phase adjustment control for continuous operation, the control unit 1200 sets the linear velocity difference setting to "ON" for the process drive motors 120Y, 120C, 120M, and 120K so as to drive the photoreceptors 3Y, 3C, 3M, and 3K at the speeds calculated in the immediately preceding execution of the positional displacement correction control.

Further, when the photoreceptors 3Y, 3C, 3M, and 3K drives while maintaining the linear velocity difference, the control unit 1200 restarts the suspended continuous print operation.

Next, an image forming apparatus 1000 according to another example embodiment is described.

When the image forming apparatus 1000 performs a print operation based on an image forming instruction after the control flow, a control unit 1200 of the image forming apparatus 1000 executes a print operation without stopping the process drive motors 120Y, 120C, 120M, and 120K after the execution of the control flow.

In this regard, the phases of speed variations of the photoreceptors 3Y, 3C, 3M, and 3K should be appropriately adjusted to each other in advance of the print operation. Further, the linear velocity difference setting is preferably set to "ON" for the photoreceptors 3Y, 3C, 3M, and 3K.

Hence, in the phase adjustment control conducted just before the print operation, the control unit 1200 conducts the phase adjustment control of the type that can be conducted without stopping the photoreceptors 3Y, 3C, 3M, and 3K.

Specifically, the control unit 1200 determines rotational angles of the photoreceptors 3Y, 3C, 3M, and 3K based on detection timings of the marks 134Y, 134C, 134M, and 134K, which are provided on the photoreceptor gears 133Y, 133C, 133M, and 133K, respectively. Then, the control unit 1200 finely tunes the driving speeds of the photoreceptors 3Y, 3C, 3M, and 3K so that the phases of speed variations thereof are appropriately adjusted to each other.

After finishing the phase adjustment control, the control unit 1200 sets the linear velocity difference setting to "ON" for the process drive motors 120Y, 120C, 120M, and 120K so as to drive the photoreceptors 3Y, 3C, 3M, and 3K at the speeds calculated in the immediately preceding execution of the positional displacement correction control.

Next, an image forming apparatus 1000 according to another example embodiment is described.

A control unit 1200 for use in the image forming apparatus 1000 executes a substantially identical control flow to the control flow as illustrated in FIGS. 22A and 22B, except for the following steps in the control flow.

Specifically, if an error occurs during the execution of the positional displacement correction control of step S1 or S14, or if the positional displacement correction control is prematurely ended ("YES" at step S2 or S11), the control unit 1200 of the image forming apparatus 1000 controls the process drive motors 120Y, 120C, 120M, and 120K so as to drive in the subsequent image forming operation at the speeds calculated in the immediately preceding execution of the phase adjustment control.

With such configuration, even if an error occurs during the execution of the positional displacement correction control, or if the positional displacement correction control is prematurely ended, the control unit 1200 can also execute the positional displacement correction in the subsequent image forming operation.

In the above description, the image forming apparatus 1000 employs an indirect transfer method in which toner images of different colors formed on the photoreceptors 3Y, 3C, 3M, and 3K are first transferred to the intermediate transfer belt 41, and then are collectively transferred to a recording medium.

Alternatively, the image forming apparatus 1000 may employ a direct transfer method in which toner images of different colors formed on the photoreceptors 3Y, 3C, 3M, and 3K are directly transferred in a superimposing manner to a recording medium carried on a sheet conveyance belt, which is a transfer member. With the above configuration, in the positional displacement correction control or the speed variation detection control, the image forming apparatus 1000 may detect the toner images of different colors transferred on the sheet conveyance belt by an optical sensor unit.

For example, as illustrated in FIG. 29, the image forming apparatus 1000 may form toner images of yellow, cyan, magenta, and black colors on the photoreceptors 3Y, 3C, 3M, and 3K, and directly transfer the toner images in a superimposing manner to a recording sheet P, which is carried on the surface of the sheet conveyance belt 201.

With this configuration, the image forming apparatus 1000 can also conduct the positional displacement correction control or the speed variation detection control by transferring the positional displacement detection pattern P1or the speed variation detection pattern P2 from the photoreceptors 3Y, 3C, 3M, and 3K to the sheet conveyance belt 201.

As described above, if an error has occurred during the execution of the positional displacement correction control, the image forming apparatus 1000 separately sets the drive speeds of the process drive motors 120Y, 120C, 120M, and 120K in the subsequent image forming operation to respective values having been calculated in the immediately preceding execution of the positional displacement correction control.

Thus, even if an error occurs during the execution of the positional displacement correction control, the image forming apparatus 1000 can execute the positional displacement correction in the subsequent image forming operation.

As described above, if the positional displacement correction control is prematurely ended, the image forming apparatus 1000 separately sets the drive speeds of the process drive motors 120Y, 120C, 120M, and 120K in the subsequent image forming operation to the respective values calculated in the immediately preceding execution of the positional displacement correction control. Thus, even if the positional displacement correction control is prematurely ended, the image forming apparatus 1000 can also execute the positional displacement correction in the subsequent image forming operation.

As described above, the image forming apparatus 1000 may perform the continuous print operation without stopping the process drive motors 120Y, 120C, 120M, and 120K after the positional displacement correction control is normally ended.

In such case, the control unit 1200 of the image forming apparatus 1000 separately sets the driving speeds of the process drive motors 120Y, 120C, 120M, and 120K to the respective values calculated in the immediately preceding execution of the positional displacement correction control. In other words, the control unit 1200 sets the linear velocity difference setting to "ON" for the process drive motors 120Y, 120C, 120M, and 120K.

Thus, in the continuous print operation, the image forming apparatus 1000 can effectively suppress a positional displacement between toner images of different colors.

Further, for the image forming apparatus 1000 according to one of the above-described example embodiments, after a desired image is formed on a recording sheet P, the control unit 1200 separately stops the driving of the process drive motors 120Y, 120C, 120M, and 120K so that the phases of speed variations of the photoreceptors 3Y, 3C, 3M, and 3K are appropriately adjusted to each other. Thus, the control unit 1200 adjusts the phases of speed variations of the photoreceptors 3Y, 3C, 3M, and 3K in advance of the subsequent drive of the process drive motors 120Y, 120C, 120M, and 120K.

With this configuration, as described above, the image forming apparatus 1000 according to one of the above-described example embodiments can suppress an increase in the first print time, which may be caused by conducting the phase adjustment control at the start of print job.

Furthermore, when the image forming apparatus 1000 according to one of the above-described example embodiments executes the speed variation detection control, the control unit 1200 starts forming the speed variation detection pattern P2 *k* for the photoreceptor 3K based on a detection timing of the mark 134K by the position sensor 135K.

Thus, the image forming apparatus 1000 transfers the speed variation detection pattern P2 *k* for the photoreceptor 3K, which is the reference image carrier, and one of the photoreceptors 3Y, 3C, and 3M, to the first and second lateral sides, respectively, on the surface of the intermediate transfer belt 41 along the belt moving direction.

Meanwhile, the control unit 1200 also starts forming one of the speed variation detection patterns P2 *y*, P2 *c*, and P2 *m* for the photoreceptors 3Y, 3C, and 3M based on the detection timing of the mark 134K. Further, in the phase adjustment control, the control unit 1200 determines drive-stop timings of the process drive motors 120Y, 120C, and 120M for the photoreceptors 3Y, 3C, and 3M based on phase differences in speed variations between the speed variation detection patterns P2 *y*, P2 *c*, and P2 *m*.

As described above, with such configuration, the image forming apparatus 1000 according to one of the above-described example embodiments can detect a phase difference between the speed variation detection pattern P2 *k* for the photoreceptor 3K and one of the speed variation detection patterns P2 *y*, P2 *c*, and P2 *m* for the photoreceptors 3Y, 3C, and 3M, without referring to a detection timing of a corresponding one of the marks 134Y, 134C, and 134M.

Furthermore, the image forming apparatus 1000 can detect respective speed variations of the photoreceptors 3Y, 3C, 3M, and 3K with relatively high accuracy by suppressing an error in detection time interval that may be caused by a speed variation of the intermediate transfer belt 41 at the point facing the optical sensor unit 136.

In the image forming apparatus 1000 according to one of the above-described example embodiments, the control unit 1200 starts the driving of the process drive motors 120Y, 120C, 120M, and 120K in advance of the execution of the speed variation detection control.

Then, the control unit 1200 stops the driving thereof in accordance with the reference timings rather than the drive-stop timings calculated in the immediately preceding execution of the speed variation detection control. Further, the control unit 1200 restarts the driving of the process drive motors 120Y, 120C, 120M, and 120K, and conducts the speed variation detection control.

with such configuration, the control unit 1200 starts the rotation of the photoreceptors 3Y, 3C, 3M, and 3K from respective reference rotation positions on conducting the speed variation detection control. Thereby, the image forming apparatus 1000 detects respective speed variations of the photoreceptors 3Y, 3C, 3M, and 3K while clearly recognizing relationships in rotation phases between the photoreceptors 3Y, 3C, 3M, and 3K. Thus, phase differences in speed variations can be effectively determined between the photoreceptors 3Y, 3C, 3M, and 3K.

In the image forming apparatus 1000 according to one of the above-described example embodiments, the control unit 1200 starts the driving of the process drive motors 120Y, 120C, 120M, and 120K with the drive speeds thereof being set to substantially identical speeds.

With this configuration, as described above with reference to FIG. 19, the image forming apparatus 1000 can effectively suppress deterioration in the detection accuracy of speed variation, which may be caused by a linear velocity difference being set immediately after the restart between the photoreceptor 3K and one of the photoreceptors 3Y, 3C, and 3M.

Moreover, after executing the control flow including the speed variation detection control, the control unit 1200 may perform an image forming operation to transfer an image to a recording sheet P without stopping the process drive motors 120Y, 120C, 120M, and 120K.

In such case, the control unit 1200 conducts the phase adjustment control of the type that is conducted without stopping each process drive motor. Further, the control unit 1200 sets the driving speeds of the process drive motors 120Y, 120C, 120M, and 120K to the speeds calculated in the immediately preceding execution of the positional displacement correction control, and then starts the image forming operation.

With this configuration, the image forming apparatus 1000 can suppress an increase in the waiting time for a user that may be caused by temporarily stopping the process drive motors 120Y, 120C, 120M, and 120K. Further, the image forming apparatus 1000 can effectively suppress a positional displacement by setting linear velocity differences between the photoreceptors 3Y, 3C, 3M, and 3K in the image forming operation.

In the image forming apparatus 1000 according to one of the above-described example embodiments, the control unit 1200 conducts the positional displacement correction control or the speed variation detection control while driving the process drive motors 120Y, 120C, 120M, and 120K at substantially identical speeds.

When the positional displacement correction control or the speed variation detection control normally ends, the control unit 1200 may stop the process drive motors 120Y, 120C, 120M, and 120K. Further, the control unit 1200 sets the drive speeds of the process drive motors 120Y, 120C, 120M, and 120K to the drive speeds calculated in the immediately preceding execution of the positional displacement correction control.

Thus, the image forming apparatus 1000 according to one of the above-described example embodiments can effectively suppress an increase in positional displacement that may be caused by forgetting to set the linear velocity setting to "ON" at the start of subsequent drive of the process drive motors 120Y, 120C, 120M, and 120K.

Embodiments of the present invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present invention may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus, comprising:

a plurality of image carriers to carry respective latent images;

a plurality of drive sources to separately drive the plurality of image carriers;

an optical writing unit to write the respective latent images on the plurality of image carriers;

a plurality of developing units to separately develop the respective latent images written on the plurality of image carriers to form respective visible images;

a transfer member, including a surface, to move, the transfer member including an intermediate transfer member and a recording medium;

a transfer unit to transfer the respective visible images formed on the plurality of image carriers to the transfer member;

an image sensor to sense a positional displacement detection pattern including the visible images on the transfer member to detect a positional displacement between the visible images on each of the plurality of image carriers, and to output a detection result of the positional displacement; and a control unit to execute a positional displacement correction control to calculate an amount of the positional displacement based on the detection result and to determine respective target drive speeds of the plurality of drive sources based on calculation results, the control unit being usable to control so that the positional displacement detection pattern is formed when the plurality of drive sources are driven at substantially identical speeds, the image sensor being usable to sense the positional displacement detection pattern thus formed, wherein when an error occurs in the execution of the positional displacement correction control, the control unit separately resets drive speeds of the plurality of the drive sources to speeds calculated in an immediately preceding execution of the positional displacement correction control.

2. The image forming apparatus according to claim 1, wherein, when the positional displacement correction control is prematurely terminated, the control unit separately resets drive speeds of the plurality of the drive sources to speeds calculated in an immediately preceding execution of the positional displacement correction control.

3. The image forming apparatus according to claim 1, wherein, when the positional displacement correction control is normally terminated and an image forming operation is performed to transfer the visible images to the recording medium while continuously driving the drive sources, the control unit separately sets the drive speeds of the plurality of the drive sources to speeds calculated in the positional displacement correction control that is executed in advance of the image forming operation.

4. The image forming apparatus according to claim 1, wherein, when the plurality of drive sources are stopped after a normal termination of the positional displacement correction control or the speed variation detection control, the control unit sets a setting for driving the plurality of drive sources at drive speeds determined in the positional displacement correction control.

5. An image forming apparatus, comprising:

a plurality of image carriers to carry respective latent images;

a plurality of drive sources to separately drive the plurality of image carriers;

an optical writing unit to write the respective latent images on the plurality of image carriers;

a plurality of developing units to separately develop the respective latent images written on the plurality of image carriers to form respective visible images;

a transfer member, including a surface, to move, the transfer member including an intermediate transfer member and a recording medium;

a transfer unit to transfer the respective visible images formed on the plurality of image carriers to the transfer member;

an image sensor to sense the visible images formed on the transfer member, the visible images including a positional displacement pattern and a speed variation detection pattern;

a rotation angle sensor to sense respective rotation angles of the plurality of image carriers; and a control unit to execute controls including a positional displacement correction control, a speed variation detection control, and a phase adjustment control, the positional displacement correction control including forming the positional displacement detection pattern on the transfer member by transferring the visible images from the plurality of image carriers to the transfer member, sensing the positional displacement detection pattern by the image sensor, calculating an amount of a positional displacement between the visible images on each of the plurality of image carriers based on a sensed result of the positional displacement detection pattern, and separately determining drive speeds of the plurality of drive sources based on calculation results, the speed variation detection control including forming a speed variation detection pattern by transferring the visible images from each of the plurality of image carriers to the transfer member, sensing the speed variation detection pattern by the image sensor, sensing a rotation angle of each of the plurality of image carriers by the rotation angle sensor, detecting a speed variation during rotation of each of the plurality of image carriers based on sensed results of the speed variation detection pattern and the rotation angles, and the phase adjustment control including adjusting a phase in the speed variation of each of the plurality of image carriers based on the sensed results, the control unit being usable to control so that the speed variation detection pattern is formed when the plurality of drive sources are driven at substantially identical speeds, the image sensor being usable to sense the positional displacement detection pattern thus formed, wherein the control unit is usable to control so that the positional displacement detection pattern is formed when the plurality of drive sources are driven at substantially identical speeds, the image sensor being usable to sense the positional displacement detection pattern thus formed, and after an image is formed on the recording medium, in the phase adjustment control, the control unit stops the driving of the plurality of drive sources so that the phases of speed variations of the plurality of image carriers are appropriately adjusted, and thereby adjusts the phases of the speed variations of the plurality of image carriers for subsequent drive operations of the drive sources.

6. The image forming apparatus according to claim 5, wherein, in the speed variation detection control, the control unit is usable to control so that the speed variation detection patterns for a reference one and another one of the plurality of image carriers are transferred on first and second lateral sides, respectively, along a moving direction of the transfer member, wherein the control unit is usable to start forming the speed variation detection patterns for the reference and other image carriers based on sensed results of respective rotation angles thereof sensed by the rotation angle sensor, and wherein the control unit is usable to determine a stop timing of a corresponding one of the plurality of drive sources to the other image carrier with respect to the phase adjustment control, based on a phase difference in speed variations between the speed variation detection patterns for the reference image carrier and the other image carrier.

7. The image forming apparatus according to claim 6, wherein, before executing the speed variation detection control, the control unit starts driving of the plurality of drive sources, then stops the driving of the plurality of drive sources at a reference timing rather than the stop timing, and restarts the driving of the plurality of drive sources.

8. The image forming apparatus according to claim 7, wherein, on executing the speed variation detection control, the control unit starts the driving of the plurality of drive sources when the plurality of drive sources are set to drive at substantially identical speeds.

9. The image forming apparatus according to claim 8, wherein, when an image forming operation is performed to transfer an image to a recording medium while continuously driving the plurality of the drive sources after executing the speed variation detection control, the control unit executes the phase adjustment control, sets drive speeds of the plurality of drive sources to drive speeds determined in the positional displacement correction control, and then performs the image forming operation.

10. An image forming apparatus, comprising:

means for carrying respective latent images;

means for driving the means for carrying;

means for writing latent images on the means for carrying;

means for developing the respective latent images written on the means for carrying to form respective visible images;

means for sensing a positional displacement detection pattern including the visible images on a transfer member to detect a positional displacement between the visible images on each of the means for carrying, and for outputting a detection result of the positional displacement; and means for executing a positional displacement correction control for calculating an amount of the positional displacement based on the detection result and for determining respective target drive speeds of the means for driving based on calculation results, the means for executing being further for controlling so that the positional displacement detection pattern is formed when the means for driving are driven at substantially identical speeds, the means for sensing being further for sensing the positional displacement detection pattern thus formed, wherein when an error occurs in the execution of the positional displacement correction control, the means for executing separately resets drive speeds of the means for driving to speeds calculated in an immediately preceding execution of the positional displacement correction control.

11. The image forming apparatus according to claim 10, wherein, when the positional displacement correction control is prematurely terminated, the means for executing separately resets drive speeds of the plurality of the drive sources to speeds calculated in an immediately preceding execution of the positional displacement correction control.

12. The image forming apparatus according to claim 10, wherein, when the positional displacement correction control is normally terminated and an image forming operation is performed to transfer the visible images to the recording medium while continuously driving the means for driving, the means for executing separately sets the drive speeds of the plurality of the drive sources to speeds calculated in the positional displacement correction control that is executed in advance of the image forming operation.

* * * * *